US007267934B2

(12) United States Patent
Goto

(10) Patent No.: US 7,267,934 B2
(45) Date of Patent: Sep. 11, 2007

(54) METHOD OF FORMING AN IMAGE

(75) Inventor: Narito Goto, Sagamihara (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/177,149

(22) Filed: Jul. 7, 2005

(65) Prior Publication Data

US 2006/0014111 A1 Jan. 19, 2006

(30) Foreign Application Priority Data

Jul. 15, 2004 (JP) ..... 2004-208359

(51) Int. Cl.
*G03C 5/29* (2006.01)

(52) U.S. Cl. ..... 430/350; 430/353

(58) Field of Classification Search ..... 430/350, 430/353

See application file for complete search history.

(56) References Cited

U.S. PATENT DOCUMENTS

| | | | |
|---|---|---|---|
| 3,152,904 A | 10/1964 | Sorensen et al. | |
| 3,445,234 A | 5/1969 | Cescon et al. | |
| 3,457,075 A | 7/1969 | Morgan et al. | |
| 3,589,903 A | 6/1971 | Birkeland | |
| 3,593,863 A | 7/1971 | Kintner | |
| 3,770,448 A | 11/1973 | Poot et al. | |
| 3,773,512 A | 11/1973 | Poot et al. | |
| 3,846,136 A | 11/1974 | Sullivan | |
| 3,874,946 A | 4/1975 | Costa et al. | |
| 3,994,732 A | 11/1976 | Winslow | |
| 4,003,749 A | 1/1977 | Masuda et al. | |
| 4,009,039 A | 2/1977 | Masuda et al. | |
| 4,021,249 A | 5/1977 | Noguchi et al. | |
| 4,021,250 A | 5/1977 | Sashihara et al. | |
| 4,022,617 A | 5/1977 | McGuckin | |
| 4,123,282 A | 10/1978 | Winslow | |
| 4,368,247 A | 1/1983 | Fletcher, Jr. et al. | |
| 4,452,885 A | 6/1984 | Nozawa et al. | |
| 4,460,681 A * | 7/1984 | Frenchik | 430/502 |
| 4,461,681 A | 7/1984 | Barber | |

(Continued)

FOREIGN PATENT DOCUMENTS

JP 11-295844 A 10/1999

(Continued)

OTHER PUBLICATIONS

Abstract of JP 2002162713 Jun. 7, 2002.*

*Primary Examiner*—Hoa Van Le
(74) *Attorney, Agent, or Firm*—Frishauf. Holtz, Goodman & Chick, P.C.

(57) ABSTRACT

A method of forming an image comprising the steps of: (a) exposing a photothermographic material comprising a support having thereon an image forming layer comprising organic silver salt grains, silver halide grains, a reducing agent, a development accelerator and a binder, the image forming layer being formed by application of a coating composition comprising more than 30% water as a solvent of the coating composition, and (b) conducting thermal development of the exposed photothermographic material employing a thermal developing device at a distance of 0 to 50 cm between an exposing section and a developing section to obtain a maximum density of 3.8 to 5.0 of the photothermographic material after the thermal development.

18 Claims, 2 Drawing Sheets

U.S. PATENT DOCUMENTS

| | | | | |
|---|---|---|---|---|
| 4,515,888 | A | 5/1985 | Beretta et al. | |
| 4,536,473 | A | 8/1985 | Mihara | |
| 4,546,075 | A | 10/1985 | Kitaguchi et al. | |
| 4,756,999 | A | 7/1988 | Swain et al. | |
| 4,959,294 | A | 9/1990 | Lea et al. | |
| 5,028,523 | A | 7/1991 | Skoug | |
| 5,264,337 | A | 11/1993 | Maskasky | |
| 5,314,798 | A | 5/1994 | Brust et al. | |
| 5,320,958 | A | 6/1994 | Inouye et al. | |
| 5,464,738 | A | 11/1995 | Lynch et al. | |
| 5,545,505 | A | 8/1996 | Simpson | |
| 5,545,515 | A | 8/1996 | Murray et al. | |
| 5,635,339 | A | 6/1997 | Murray | |
| 5,654,130 | A | 8/1997 | Murray | |
| 5,705,324 | A | 1/1998 | Murray | |
| 2003/0157442 | A1* | 8/2003 | Oikawa | 430/350 |
| 2004/0091823 | A1* | 5/2004 | Kojima | 430/350 |
| 2004/0218033 | A1* | 11/2004 | Nariyuki | 347/264 |

FOREIGN PATENT DOCUMENTS

| | | | |
|---|---|---|---|
| JP | 11-352627 | A | 12/1999 |
| JP | 2001-209145 | A | 8/2001 |
| JP | 2002-278017 | A | 9/2002 |
| JP | 2003-066558 | A | 3/2003 |
| JP | 2003-195450 | A | 7/2003 |
| JP | 2004-138724 | A | 5/2004 |

* cited by examiner

METHOD OF FORMING AN IMAGE

This application is based on Japanese Patent Application No. 2004-208359 filed on Jul. 15, 2004, in Japanese Patent Office, the entire content of which is hereby incorporated by reference.

FIELD OF THE INVENTION

The present invention relates to a method of forming an image utilizing a photothermographic material provided with an image forming layer which contains on a support an organic silver salt, silver halide, a binder and a reducing agent.

BACKGROUND OF THE INVENTION

To the present, in the medical and printing-plate making fields, effluent resulting from wet processing of image forming materials has become problematic in terms of workability, and in recent years, from the view point of ecology as well as space saving, a drastic decrease in processing effluent has been increasingly demanded. Accordingly, photothermographic materials, which form images only via heat, have been brought to practicale and are rapidly prevailing in the above fields.

A photothermographic material (hereinafter, also referred to as a thermally developable material or a photosensitive material) itself has been proposed already for many years and is described, for example, in U.S. Pat. Nos. 3,152,904 and 3,457,075.

This thermally developable material is generally processed via a thermal development apparatus, which is known as a thermal developing device and stably heats a thermally developable material to form an image. As described above, in accordance with its rapid popularity in recent years, many thermal development apparatuses have come on the market. Further, in recent years, a compact laser imager and rapid processing have been desired.

For the above reason, characteristic improvements of a thermally developable material is essential. To obtain a sufficient image density even during rapid processing, it is effective to increase the covering power due to increased number of coloring points by employing silver halide provided with a smaller mean particle diameter as disclosed in JP-A Nos. 11-295844 and 11-352627 (hereinafter, JP-A refers to Unexamined Japanese Patent Application Publication); to utilize a highly active reducing agent provided with a secondary or tertiary alkyl group as disclosed in JP-A No. 2001-209145; and to utilize a development accelerator such as hydrazine compounds or vinyl compounds, and phenol derivatives and naphthol derivatives, as disclosed in JP-A Nos. 2002-278017 and 2003-66558.

Further, as means for rapid processing from the hardware aspect, disclosed is a technique in which a thermally developable material is exposed while being heated on a thermal development drum, or is thermally developed simultaneous during the exposure (JP-A Nos. 10-115889, 2002-162692 and 2004-85763).

However, in the case of simultaneous exposure and thermal development, a problem exists of vibration with exposing section being transffed to the thermal developing section due to proximity of the exposing section and the thermal developing section, or resulting in a time lag between the loading and the trailing end of the photosensitive sheet material with respect to time from exposure to thermal development, resulting in generation of uneven density at the time of thermal development (refer to Patent Document 1). Further, observed was uneven density due to variation of the coated layer thickness or coating application.

In addition to more rapid processing, recently, to achieve high image quality, a dry film specifically suitable for digital mammography diagnosis has been desired. For the mammography diagnosis, it is essential that no image defects due to uneven density or foreign matter particles are generated as well as to providing high maximum density, a wide range from the minimum density to the maximum density, and excellent sharpness. However, when the maximum density is increased, in the case of conventional photosensitive materials, particularly those prepared by coating a water-based coating composition, problems in the tone of higher density portions shifts from pure black to reddish, countermeasures of which have been sought. On the other hand, to overcome mottling defects (coating defects), generated at the time of coating, become noticably visible after thermal development, one countermeasure is in which a radiation absorptive substance such as an acutance dye is contained in photosensitive materials to achieve a density of 0.6-3.0 at the exposure wavelength (please refer to Patent Document 2).

However, even utilizing these countermeasures, it is insufficient to prevent uneven density at the time of thermal development nor to improve silver tone at higher density portions, resulting in insufficient desirable characteristics, particularly as a dry film for mammography.

Patent Document 1: Unexamined Japanese Patent Application Publication No. (hereinafter, referred to as JP-A) 2004-138724

Patent Document 2: JP-A 2003-195450

SUMMARY OF THE INVENTION

The present invention has been achieved in view of the above-described drawbacks and an object of this invention is to provide an method of forming an image which exhibits high image density, no generation of uneven density during thermal development, excellent tone at higher density portions, and excellent image storage stability in light irradiation, even when a photothermographic material, prepared by utilizing a water-based coating composition, is subjected to rapid development.

BRIEF DESCRIPTION OF THE DRAWINGS

Embodyments will be described, by way of of example only, with reference to the accompanying drawings which are meant to be exemplary, not limiting, and wherein like elements numbered alike in several figures, in which.

DESCRIPTION OF THE PREFERRED EMBODIMENT

Figure 1:
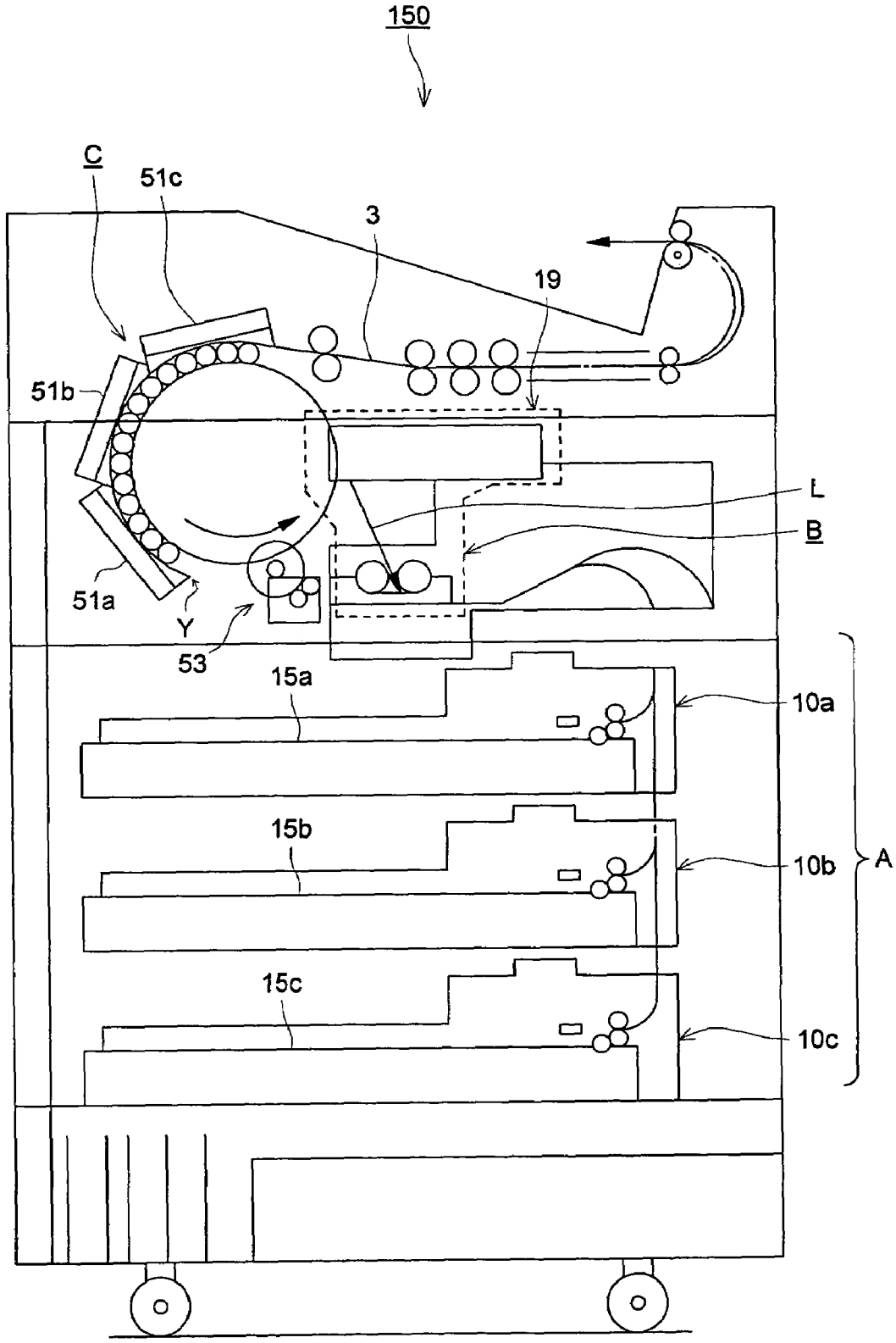
FIG. 1 is a brief constitutional drawing of a thermally developing recording device incorporaing a laser recording apparatus, employed in this invention.

The inventors, as a result of repeated studies to increase image density, light irradiation image storage stability, uneven density during thermal development and tone shift in high density portions, which are problematic particularly when a water-based photothermographic material, an image forming layer of which having been prepared by utilizing a coating composition containing not less than 30 weight % of water in the solvent, is subjected to rapid development by use of a thermal developing device in which the distance between the exposing section and the developing section is 0-50 cm. It was discovered that the above-described object can be achieved by incorporating a development accelerator in the image forming layer and carrying out thermal development to achieve an maximum optical density of 3.8-5.0, which led to this invention. That is, the object of this invention can be achieved by the following constitutions.

(Item 1)

A method of forming an image comprising the steps of:

(a) exposing a photothermographic material comprising a support having thereon an image forming layer comprising organic silver salt grains, silver halide grains, a reducing agent, a development accelerator and a binder, the image forming layer being formed by application of a coating composition comprising more than 30% water as a solvent of the coating composition, and (b) conducting thermal development of the exposed photothermographic material employing a thermal developing device having a distance of 0-50 cm between an exposing section and a developing section to obtain a maximum density of 3.8-5.0 of the photothermographic material after the thermal development.

(Item 2)

The method of forming an image of item 1, wherein the development accelerator is represented by any one of Formulas (A-1) and (A-2):

$Q_1$—NHNH-$Q_2$ Formula (A-1)

wherein, $Q_1$ is an aromatic group or a heterocyclic group which bonds to —NHNH-$Q_2$ via a carbon atom, and $Q_2$ is a carbamoyl group, an acyl group, an alkoxycarbonyl group, an aryloxycarbonyl group, a sulfonyl group or a sulfamoyl group.

Formula (A-2)

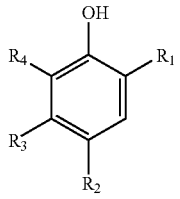

wherein, $R_1$ is an alkyl group, an acyl group, an acylamino group, a sulfonamide group, an alkoxycarbonyl group or a carbamoyl group, $R_1$ is a hydrogen atom, a halogen atom, an alkyl group, an alkoxy group, an aryloxy group, an alkylthio group, an arylthio group, an acyloxy group or a carboxylic acid ester group, $R_1$ and $R_2$ are each a group substituted on a benzene ring, and $R_3$ and $R_4$ may bond with each other to form a condensed ring.

(Item 3)

The method of forming an image of item 1 or 2, wherein the image forming layer incorporates a radiation absorbing compound having a total absorbance of 0.30-1.00 at an exposure wavelength as the sum of all layers applied onto the side of the support carrying the image forming layer.

(Item 4)

The method of forming an image of any one of items 1-3, wherein a surface sensitivity of the silver halide grains is lower, compared to sensitivity before the thermal development due to being converted from surface latent image type grains to internal latent image type grains, during the thermal development.

(Item 5)

The method of forming an image of any one of items 1-4, wherein a silver iodide content of the silver halide grains is 5-100 mol %.

(Item 6)

The method of forming an image of any one of items 1-5, wherein the photothermographic material contains a compound represented by following Formula (F).

Formula (F)

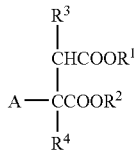

wherein, $R^1$ and $R^2$ are each a substituted or unsubstituted alkyl group, at least one of them is a fluoroalkyl group having at least 2 carbon atoms and at most 13 fluorine atoms, $R^3$ and $R^4$ are each a hydrogen atom or an alkyl group, "A" is -L-$SO_3M^1$ and $M^1$ is a hydrogen atom or a cation, and "L" is a single bond or a substituted or unsubstituted alkylene group.

(Item 7)

The method of forming an image of any one of items 1-6, wherein the silver halide grains are at a mean particle size of 10-50 nm.

(Item 8)

The method of forming an image of item 7, wherein the silver halide grains further contain silver halide grains having a mean particle size of 55-100 nm.

(Item 9)

The method of forming an image of any one of items 1-8, wherein the silver halide grains are chemically sensitized by a chalcogen compound.

(Item 10)

The method of forming an image of any one of items 1-9, wherein $R_z(E)/R_z(B)$ is 0.1-0.7 when $R_z$ (E) is a mean roughness measured at ten points of the outermost surface of the image forming layer side and $R_z(B)$ is a mean roughness measured at ten points of the outermost surface of the opposite side to the image forming layer on the support.

(Item 11)

The method of forming an image of any one of items 1-10, wherein $L_b/L_e$ is 2.0-10 when $L_e$ (μm) is a mean particle size of a matting agent having a maximum mean particle size among those contained in layers of the image forming layer side on the support, and $L_b$ (μm) is a mean particle size of the matting agent having the maximum mean particle size among those contained in layers on the opposite side of the image forming layer on the support.

(Item 12)

The method of forming an image of any one of items 1-11, wherein one sheet of the photothermographic material comprising a photothermographic material, starts to be partially developed having already been exposed while the remaining parts of the sheet are exposed.

(Item 13)

The method of forming an image of any one of items 1-12, wherein a conveying rate in the thermal developing section is 20-200 mm/sec.

(Item 14)

The method of forming an image of any one of items 1-13, wherein the thermal development is conducted employing a thermal developing device with a photothermographic material stock tray at not higher than 55 cm from a base of the floor.

(Item 15)

The method of forming an image of any one of items 1-14, wherein the photothermographic material exposing section of the thermal developing device is structured at a higher level than the photothermographic material stock tray.

(Item 16)

The method of forming an image of any one of items 1-15, wherein the image forming layer contains a dye image forming agent exhibiting an increased absorbance by oxidation of 360-450 nm.

(Item 17)

The method of forming an image of any one of items 1-16, wherein the image forming layer contains a dye image forming agent exhibiting an increased absorbance by oxidation of 600-700 nm.

(Item 18)

The method of forming an image of any one of items 1-17, wherein the conveying rate in the thermal developing section is 25-200 mm/sec.

(Item 19)

A photothermographic material comprising a support having thereon an image forming layer comprising organic silver salt grains, silver halide grains, a binder, a reducing agent, a development accelerator and a dye image forming agent exhibiting increased absorbance by oxidation of 600-700 nm, the image forming layer being formed by application of a coating composition comprising more than 30% water as a solvent of the coating composition, wherein a maximum image density of the photothermographic material after the thermal development is 3.8-5.0.

(Item 20)

The photothermographic material of item 19, wherein $R_z(E)/R_z(B)$ is 0.1-0.7 when $R_z$ (E) is a mean roughness measured at ten points of the outermost surface of the image forming layer side, and $R_z(B)$ is a mean roughness measured at ten points of the outermost surface of the opposite side to the image forming layer on the support.

In item 1, the maximum image density is preferably 3.9-4.7 but more preferably 4.0-4.5.

In item 3, the absorbance at an exposure wavelength is preferably 0.35-0.90 but more preferably 0.40-0.80.

Further, by employing the constitutions of items 10 and 11, it is further possible, during rapid thermal development, to improve transport characteristics and to reduce uneven density.

While the preferred embodiments of the present invention have been described using specific terms, such description is for illustrative purposes only, and it is to be understood that changes and variations may be made without departing from the sprit or scope of the appended claims.

EFFECTS OF THE INVENTION

Based on this invention, images exhibiting: high image density, no generation of uneven density during thermal development, excellent tone in high density portions and excellent image storage stability, can be obtained even when the photothermographic material, formed employing a water-based coating composition, is subjected to rapid processing. Further, a method of forming an image of this invention is ecologically superior.

DETAILED DESCRIPTION OF THE INVENTION

In the following paragraphs, constituent elements utilized in the methods of forming images of this invention will be detailed.

Organic Silver Salt

Organic silver salts employed in this invention are silver salts which are relatively stable against light, however, form a silver image when heated at a minimum of 80° C. in the presence of an exposed optical catalyst (such as the latent image of photosensitive silver halide) and a reducing agent.

Such photo-insensitive organic salt is described in, for example, paragraphs "0048"-"0049" of JP-A 10-62899; p. 18, line 24-p. 19, line 37 of European Pat. Publication Open to Public Inspection No. 803,764A1; European Pat. Publication Open to Public Inspection No. 962,812A1; JP-A Nos. 11-349591, 2000-7683, 2000-72711, 2002-23301, 2002-23303, 2002-49119, and 2002-196446; European Pat. Publication Open to Public Inspection Nos. 1,246,001A1 and 1,258,775A1; and JP-A Nos. 2003-140290, 2003-195445, 2003-295378, 2003-295379, 2003-295380 and 2003-295381.

In this invention, together with the organic salt described above, employed may be silver aliphatic carboxylate, specifically, silver salts of long chain aliphatic carboxylic acids having a carbon number of 10-30 but preferably of 15-28. The molecular weight of an aliphatic carboxylic acid to form silver salt is preferably 200-500 but more preferably 250-400. Preferable examples of silver salts of aliphatic acid include silver behenate, silve arachidinate, silver stearate, silver oleate, silver laurate, silver caproate, silver myristate, silver palmitate and mixtures thereof. Among these aliphatic acid silver salts, preferably employed are those having a silver behenate content of preferably not less than 50 mol %, more preferably 80-99.9% and further preferably 90-99.9 mol %.

As organic silver saits other than those described above, core/shell organic silver salts (JP-A No. 2002-23303), silver salts of polybasic carboxylic acid (EP 1246001, JP-A 2004-061948) and polymer silver salts (JP-A Nos. 2000-292881 and 2003-295378-295381) may be also employable.

The shape of organic silver salt grain is not specifically limited, and may be any of a needle form, a bar form, a tabular form or a flake form. In this invention, a flake form organic silver salt is preferred. Further, a short needle form, a rectangular form, a cubic form or an irregular shaped oblate spheroid, exhibiting a long to short axis ratio of not more than 5, is also preferably employed.

These organic silver salt grains are characterized by reduced fogging during the thermal development compared to long needle form grains exhibiting a long to short axis ratio of not less than 5. In this application, a flake form organic silver salt is defined as follows. An organic silver salt grain is observed through an electronmicroscope, the shape of organic silver salt grains being approximated to a cuboid, and the edges of this cuboid in the order from the shortest are designated a, b and c (where c may be equal to b), x is determined by calculating the shorter of values a and b.

$$x=b/a$$

In this manner, x is determined for approximately 200 random grains, where those satisfying the relationship of $x \geqq 1.5$ are designated as flake form grains when the mean value is designated as x (average). The relationship is preferably $30 \geqq x$ (average) $\geqq 1.5$ but more preferably $20 \geqq x$ (average) $\geqq 2.0$. Incidentally, a needle form means $1 \leqq x$ (average) $\leqq 1.5$.

In flake form grains, "a" can be considered as the thickness of a tabular grain having a primary plane with edges b and c. The average of "a" is preferably 0.01-0.23 μm but more preferably 0.1-0.20 μm. The average of c/b is preferably 1-6, more preferably 1.05-4, further preferably 1.1-3 and most preferably 1.1-2.

The particle size distribution of organic silver salt grains is preferably monodispersed. "Monodispersed" means that each of the percentage values, which are obtained by deviding the standard deviation of each length of the short axis and of the long axis by the lengths of the short axis and long axis respectively, is preferably not more than 100%, more preferably not more than 80% and further preferably not more than 50%.

As a measurement method of shape of organic silver salt grains, used may be transmittance electronmicroscopic images of an organic silver salt dispersion. Another method to measure monodispersibility includes a method which determines standard deviation of the volume weighted average diameter of organic silver salt grains, and the percentage of a value, divided by the volume weighting average diameter (a coefficient of variation), is preferably not more than 100%, more preferably not more than 80% but further more preferably not more than 50%. As another measurement method, for example, it can be determined from the particle size (volume weighting mean diameter) which is obtained by irradiating laser light onto organic silver salt grains dispersed in the liquid being irradiated via a laser and determining a self correlation function against variation over time of the scattered light fluctuation.

As manufacturing of organic silver salt employed in this invention and dispersion method thereof, commonly known and appropriate methods may be preferred and applied as appropriate, such as JP-A 10-62899 (described above), European Pat. Publication Open to Public Inspection Nos. 803,763A1 and 962,812A1; and JP-A Nos. 2001-167022, 2000-7683, 2000-72711, 2001-163889, 2001-163889, 2001-163827, 2001-33907, 2001-33907, 2001-188313, 2001-83652, 2002-6442, 2002-31870 and 2002-280135.

Herein, since fogging is increased and sensitivity is significantly lowered when photosensitive silver-salt coexists during dispersion of organic silver salt grains, it is preferable that essentially no photosensitive silver salt present during dispersion. In this invention, the photosensitive silver salt amount in the aqueous dispersion is preferably not more than 1 mol % against 1 mol of organic silver salt in the solution, more preferably not more than 0.1 mol % and further more preferably no addition of photosensitive silver salt is performed in a positive manner.

A photosensitive material may be produced by mixing an organic silver salt aqueous dispersion and a photosensitive silver salt aqueous dispersion, in which the mixing ratio of organic silver salt to photosensitive silver salt can be selected based on intended function, however, the ratio of photosensitive silver salt compared to organic silver salt is preferably in the range of 1-30 mol %, rmore preferably of 2-20 mol % and specifically preferably of 3-15 mol %. Mixing at least two types of organic silver salt aqueous dispersions with at least two types of photosensitive silver salt aqueous dispersions is a preferable method to achieve desired photographic characteristics.

Organic silver salt of this invention may be employed in any appropriate amount, however, it is preferably employed at 0.1-5 g/m$^2$, more preferably at 0.3-3 g/m$^2$ but still more preferably at 0.5-2 g/m$^2$ based on silver weight.

Silver Halide

Silver halide of this invention (hereinafter, also referred to as photosensitive silver halide grains or silver halide grains) will be now described. Herein, silver halide refers to silver halide crystal grains, which basically absorb light as their inherent property of a silver halide crystal, or absorb visible or infrared light by an artificially physicochemical method, as well as having been processed and manufactured so that physicochemical change will occur in the interior and/or on the surface of the silver halide crystal when absorbing light in any region within the optical wavelength region from ultraviolet to infrared.

The silver halide grains utilized in this invention can themselves be prepared as a silver halide grain emulsion employing an appropriate method. Namely, any of the acid method, neutral method or ammonia method may be utilized. Further, water-soluble silver salts may be allowed to react with water-soluble halide salts employing either a single-jet or a double-jet method, and a combination thereof, however, from among the avove methods, preferably employed is a so-called controlled double-jet method, in which silver halide grains are prepared while controlling the forming conditions.

Grain formation is generally divided into two steps of generating silver halide seed grains (being nuclei) and grain growth, and these steps may be performed sequentially, or nuclei (seed grains) formation and grain growth may be performed separately. A controlled double-jet method, in which grain formation is performed while conditions such as pAg and pH for grain formation are controlled, is preferable with respect to capability of controlling the grain shape and size. For example, in the case of performing nucleation and grain growth separately, after firstly performing nucleation (a seed grain forming process) by rapidly mixing a water-soluble silver salt and a water-soluble halide salt in a gelatin aqueous solution, silver halide grains are prepared by a grain growth process in which grains are grown while supplying a water-soluble silver salt and a water-soluble halide salt under controlled conditions of such as pAg and pH. After grain formation, excessive salts are eliminated by a commonly known desalting method such as a noodle method, a flocculation method, an ultra filtration method and an electric dialysis method, resulting in preparation of a silver halide emulsion with the desired parameters.

Particle size of silver halide grains is preferably monodispersed. In this invention, "monodispersed" means that a coefficient of variation of the particle diameter determined by the following equation is not more than 30%, preferably not more than 20% but more preferably not more than 15%.

$$\text{Coefficient of variation of particle diameter (\%)} = (\text{standard deviation of particle diameter}/\text{mean particle diameter}) \times 100$$

The shape of silver halide grains includes shapes such as: cubic, octahedral, tetradecahedral, tabular, spherical, bar-shaped and ovoid, of which specifically preferable are cubic, octahedral, tetradecahedral and tabular silver halide grains.

The mean aspect ratio, in the case of employing tabular silver halide grains, is preferably 1.5-100 but more preferably 2-50. These ratios are described in such as U.S. Pat. Nos. 5,264,337, 5,314,798 and 5,320,958, whereby taegeted tabular grains can be easily prepared. Further, silver halide grains having rounded corners are also preferably employed.

The crystal habit of the outer surface of silver halide grains is not specifically limited, however, silver halide grains provided with a crystal habit conforming to the selectivity at a higher ratio, are preferably employed in the case of employing a spectral sensitizing dye having a selectivity of a crystal habit (surface) in absorption reaction of the dye onto the surface of the silver halide grain. For example, when a sensitizing dye which selectively adsorbs on a crystal surface at a Miller's index of [100] is employed, it is preferable that the occupying ratio of [100] surfaces on the outer surfaces of silver halide grains is high, where this ratio is preferably not less than 50%, more preferably not less than 70% but specifically preferably not less than 80%. Herein, the ratio of Miller's index [100] surfaces can be determined based on T. Tani, J. Imaging Sci., 29, 165 (1985), which utilizes the adsorption dependence of [111] surfaces and [100] surfaces in adsorption of sensitizing dyes.

Silver halide grains utilized in this invention are preferably prepared by employing low molecular weight gelatin exhibiting a mean molecular weight of not more than 50,000 during grain formation. The gelatin is specifically preferably employed during nucleation of silver halide grains. Low molecular weight gelatin typically exhibits a mean molecular weight of not more than 50,000, preferably 2,000-40,000 and most preferably 5,000-25,000. The mean molecular weight of gelatin can be measured by means of gel permeation chromatography. Low molecular weight gelatin can be prepared: via enzyme decomposition by adding a gelatin decomposing enzyme, via hydrolysis by adding acid or alkali into an aqueous solution of gelatin, which is generally utilized and has a mean molecular weight of approximately 100,000, via thermal decomposition by heating under at least atmospheric pressure, via decomposition by irradiation of ultrasonic waves, or via combined methods thereof.

The concentration of a dispersion medium (gelatin) during nucleation is preferably not more than 5 weight %, however nucleation is more preferably performed at a concentration as low as 0.05-3.0 weight %.

Silver halide grains utilized in this invention may incorporate a compound represented by the following formula, during grain formation.

$$YO(CH_2CH_2O)_m(CH(CH_3)CH_2O)_p(CH_2CH_2O)_nY$$

wherein, Y represents a hydrogen atom, —$SO_3M$ or —CO—B—COOM; M is a hydrogen atom, an alkali metal atom, an ammonium group or an ammonium group substituted by an alkyl group having at most a carbon number of 5; and B is a chain or cyclic divalent group which forms an organic dibasic acid; m and n are each an integer of 0-50, and p is an integer of 1-100.

Polyethylene oxide compounds represented by the above Formula have been preferably employed as an agent to counter violent foaming during stirring or transporting of the emulsion raw materials, such as during the process to prepare a gelatin solution, a process to add a water-soluble halide compound and a water-soluble silver salt into the gelatin solution, and a process to coat a silver halide emulsion on a support, while manufacturing a general silver halide photosensitive material, and are described, for example, in JP-A 44-9497.

Above-described polyethylene oxide compounds also function as a defoaming agent during nucleation. The above compounds are preferably employed at not more than 1 weight % but more preferably at 0.01-0.1 weight % based on silver.

Above-described polyethylene oxide compounds are preferably present during nucleation and are added to a dispersion medium in advance to nucleation, however, they may also be added during nucleation, or may be employed by being added to an aqueous silver salt solution or an aqueous halide solution which is employed during nucleation. It is preferable to utilize the compound by adding it to the aqueous halide solution or in both aqueous solutions at 0.01-2.0 weight %. Further, the compound is preferably present during at least 50% of the time of the nucleation process but more preferably during at least 70% of the time. Polyethylene oxide compounds represented by the above formula may be added as powder or by being dissolved in a solvent such as methanol.

Herein, temperature during nucleation is 5-60° C. but preferably 15-50° C. However it is preferably controlled to be in such a temperature range that, in any case of a constant temperature pattern, being a rising temperature pattern (for example, the temperature at start of nucleation is 25° C., and the temperature is gradually raised during nucleation to reach 40° C. at the end of nucleation), or an appropriate alternative pattern.

The concentration of an aqueous silver salt solution and an aqueous halide solution employed for nucleation is preferably not more than 3.5 mol/L but more preferably in as low a concentration as 0.01-2.5 mol/L. The addition rate of a silver ion during nucleation is preferably $1.5\times10^{-3}$-$3.0\times10^{-1}$ mol/min but more preferably 3.0×10−3-8.0×10−2 mol/min.

The pH during nucleation can be set in the range of 1.7-10, however, is preferably set at 2-6 because pH of the alkaline range broadens the particle diameter distribution. Further, pBr during nucleation is generally 0.05-3.0, preferably 1.0-2.5 but more preferably 1.5-2.0.

The mean particle size of silver halide grains is generally 10-50 nm, preferably 10-40 nm but more preferably 10-35 nm. When the mean particle size is not more than 10 nm, image density may decrease or light irradiation image storage stability may deteriorate. Further, when it is over 50 nm, image density may also decrease.

Herein, "mean particle size" means an edge length of a silver halide grain in the case of a silver halide grain, being a so-called normal crystal such as a cube or an octahedron. Further, "mean particle size" means the diameter of a circular image having the same area as the projected area of the primary surface, in the case of a silver halide grain being a tabular grain. In addition, in the case of abnormal crystals such as a spherical grain and a bar-shaped grain, the diameter of a sphere, which has the same volume as the silver halide grains have, is determined by calculation of the mean particle size. These measurements are carried out via an electronmicroscope, and the mean particle size is determined by averaging grain size values of 300 random grains.

Further, it is possible to increase image density or to control image density decrease due to aging by combining silver halide grains exhibiting the mean particle size of 55-100 nm and those exhibiting the mean particle size of 10-50 nm. The weight ratio of silver halide grains exhibiting the mean particle size of 10-50 nm to 55-100 nm is preferably 95/5-50/50 but more preferably 90/10-60/40 respectively.

Silver Halide Exhibiting Silver Iodide Content of 5-100%

The silver iodide content of silver halide grains of this invention is preferably 5-100 mol %. Halogen composition distribution in the interior of the grain may be uniform, vary stepwise or vary continuously, provided that the silver iodide content is within this range. Further, silver halide grains provided with a core/shell structure, exhibiting a higher silver iodide content in the interior and/or on the surface are preferably utilized. Preferable are a 2-5 fold structure but more preferably a 2-4 fold structure.

A preferable silver iodide content ratio of the emulsion utilized in this invention is 10-100 mol %, more preferably 40-100 mol %, still more preferably 70-100 mol % and specifically preferably 90-100 mol %.

Silver halide of this invention is preferably provided via direct transition absorption arising from a silver iodide crystal structure in the wavelength range of 350-400 nm. Whether these silver halides exhibit direct transition absorption can be easily identified based on excimer absorption around 400-430 nm arising from direct transition. A method to introduce silver iodide into silver halide grains are preferably methods: in which an alkali aqueous iodide solution is added during grain formation, in which at least one of micro-particle silver iodide, micro-particle silver iodo-bromide, micro-particle silver iodo-chloride or micro-particle silver iodo-chloro-bromide is added, or in which an iodide ion releasing agent is utilized as described in JP-A Nos. 5-323487 and 6-11780.

Internal Latent Image after Thermal Development Type Silver Halide Grains

Photosensitive silver halide grains according to this invention are preferably silver halide grains, the surface sensitivity of which is decreased via thermal development due to conversion from a surface latent image type to an internal latent image type. That is, a latent image, which is able to function as a catalyst of a development reaction (a reduction reaction of silver ions by a silver ion reducing agent), is formed on the surface of the silver halide grains during exposure prior to thermal development, while, since a latent image is formed more in the interior than on the surface of the silver halide grains during exposure after the thermal development process, latent image formation on the surface is retarded. Herein, it has not been practiced, in a thermally developable material, to utilize silver halide grains, which significantly changes latent image forming function before and after the thermal development process.

Generally, when photosensitive silver halide grains are exposed, the silver halide grains themselves or a spectral sensitizing dye adsorbed on the surface of silver halide grains is photo-excited to generate a freely movable electron, and this electron is competitively trapped (captured) in an electron trap (sensitivity center) on the surface of silver halide grains, or an electron trap in the interior of the grains. Therefore, when such as chemically sensitized centers (chemically sensitized nuclei), or dopants effective as an electron trap, are existing more and in suitable numbers on the surface than in the interior of silver halide grains, a latent image is formed preferentially on the surface to make the silver halide grains developable. On the contrary, when more such as chemically sensitized centers or dopants effective as an electron trap exist in suitable numbers in the interior than on the surface of silver halide grains, a latent image is formed preferentially in the interior resulting in insufficient grain surface development. In other words, it can be said that sensitivity is higher on the surface than in the interior in the former case, while sensitivity is lower on the surface than in the interior in the latter case (Reference Literature 1: The Theory of the Photographic Process, the 4th edition, edited by T. H. James, published by Macmillan Publishing Co., Ltd. (1977); 2: Fundamentals of Photographic Technology (Silver Salt Photography), revised edition, edited by Photographic Society of Japan, published by Corona Co., Ltd. (1998)).

In a photosensitive silver halide grains of this invention, it is preferable with respect to sensitivity and image storage stability, to incorporate a dopant, which functions as an electron trapping dopant, in the interior of silver halide grains at least during exposure after thermal development.

Herein, it is specifically preferable to incorporate a dopant, which functions as a positive hole (hole) at the time of exposure for image formation before thermal development, or alternatively during the thermal development process to be an electron trap after thermal development.

An electron trapping dopant as utilized here refers to an element or a compound other than silver and halogen, which constitute silver halide grains, wherein the dopant itself is exhibits the property to trap (capture) a free electron or portions, such as an electron trapping lattice defect, are generated by incorporating the dopant in the interior of silver halide grains. For example, listed are metal ions, salts or complexes thereof; chalcogens (oxygen group elements) such as sulfur, selenium, tellurium; inorganic compounds or organic compounds containing a nitrogen atom, or metal complexes thereof; and rare earth ions or complexes thereof.

Metal ions, salts or complexes thereof include such as lead ions, bismuth ions, gold ions; or such as lead bromide, lead nitrate, lead carbonate, lead sulfate, bismuth nitrate, bismuth chloride, bismuth trichloride, bismuth carbonate, sodium bismuthate, chloroauric acid, lead acetate, lead stearate and bismuth acetate.

As compounds containing chalcogen such as sulfur, selenium and tellurium, utilized may be various charcogen releasing compounds generally known in the photographic industry as charcogen sensitizers. Further, organic compounds containing charcogen or nitrogen are preferably heterocyclic compounds, and include, for example, imidazole, pyrazole, pyridine, pyrimidine, pyradine, pyridazine, triazole, triazine, indole, indazole, purine, thiadiazole, oxadiazole, quinoline, phthalazine, naphthylizine, quinoxaline, quinazoline, cinnoline, pteridine, acridine, phenanthroline, phenazine, tetrazole, thiazole, oxazole, benzimidazole, benzoxazole, benzothiazole, indolenine and tetrazaindene; preferable among which are imidazole, pyridine, pyrimidine, pyradine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzothiazole and tetrazaindene.

Herein, the heterocyclic compounds described above may be provided with a substituent, and the substituents are preferably an alkyl group, an alkenyl group, an aryl group, an alkoxy group, an aryloxy group, an acyloxy group, an acyl group, an alkoxycarbonyl group, an aryloxycarbonyl group, an acyoxy group, an acylamino group, an alkoxycarbonylamino group, an aryloxycarbonylamino group, a sulfonylamino group, a sulfamoyl group, a carbamoyl group, a sufonyl group, an ureido group, a phosphoric amido group, a halogen atom, a cyano group, a sulfo group, a carboxyl group, a nitro group and a hetero cyclic group; and more preferable are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, an ureido group, a phosphoric amido group, a halogen atom, a cyano group, a nitro group and a hetero cyclic group; and furthermore preferable are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group and a hetero cyclic group.

Herein, silver halide grains utilized in this invention may contain an ion of a transition metal of the 6-11th groups of the Periodic Table, while chemically controlling the oxidation state of the metal with such as a ligand, so that the ion functions as an electron trapping dopant or as a hole trapping dopant similar to the above-described dopant. The above-described transition metals preferably include W, Fe Co, Ni, Cu, Ru, Rh, Pd, Re, Os, Ir and Pt.

In this invention, with respect to various types of dopants described above, either one type or combinations of at least two types of compounds or complexes from the same type or different types may be utilized. However, at least one type is necessary to function as an electron trapping dopant during exposure after thermal development. These dopants may be introduced into silver halide grains in any chemical form.

Herein, in this invention, not necessarily preferable is an embodiment to achieve doping by employing either one type of complex or salt of Ir or Cu alone.

The content of the dopant is preferably in the range of preferably $1\times10^{-9}$-$1\times10$ mol, more preferably $1\times10^{-8}$-$1\times10^{-1}$ mol and specifically preferably $1\times10^{-6}$-$1\times10^{-2}$ mol, compared 1 mol of silver. However, since the most preferable content depends on such as the type of dopant, the particle diameter and shape of silver halide grains, and other environmental conditions, it is preferable to study optimal dopant addition conditions corresponding to the above conditions.

In this invention, those represented by the following formula are preferable as transition metal complexes or complex ions.

$$[ML_6]^m \qquad \text{Formula}$$

wherein, M is a transition metal selected from elements of the 6th-11th groups of the Periodic Table, L is a ligand, and m is 0, -, 2-, 3- or 4-. Specific examples of ligands represented by L include each ligand of halogen ions (such as a fluorine ion, a chlorine ion, a bromine ion and an iodine ion), cyanide, cyanato, thiocyanato, selenocyanato, tellurocyanato, azide and aquo; nitrosyl and thionitrosyl; but preferably aquo, nitrosyl and thionitrosyl. In the case when an aquo ligand exists, it is preferable that the aquo ligand occupies one or two of the ligands. L may be the same or differ.

Compounds which provide these metal ions or complex ions are preferably incorporated into silver halide grains via addition during silver halide grain formation. These may be added during any of the preparation stages of silver halide grains, that is, before or after nucleation, growth, physical ripening, or chemical sensitization. However, these are preferably added during the stage of nucleation, growth or physical ripening, further more preferably at the stage of nucleation or growth but most preferably during the nucleation stage. The addition may be carried out several times by dividing the total amount, and uniform content in the interior of silver halide grains can be controlled or incorporated can be carried out so as to result in distribution formation in the interior of the grain, as described in such as JP-A Nos. 63-29603, 2-306236, 3-167545, 4-76534, 6-110146 and 5-273683.

These metal compounds may be added by dissolving in water or suitable organic solvents (such as alcohols, ethers, glycols, ketones, esters and amides). There are methods in which, for example, an aqueous metal compound powder solution or an aqueous solution, in which a metal compound is dissolved along with sodium chloride and potassium chloride, is then added to a water-soluble silver salt solution or a water-soluble halide solution, during grain formation; a method in which a metal compound is added as a third solution when a silver salt solution and a halide solution are mixed, to prepare silver halide grains by a simultaneous three solution mixing method; a method in which during grain formation, an aqueous solution comprising the necessary amount of a metal compound is charged into a reaction vessel; or a method in which dissolution of other silver halide grains, previously doped with metal ions or complex ions, is added and dissolved during silver halide preparation. The specifically preferred method is one in which an aqueous metal compound powder solution or an aqueous solution, in which a metal compound is dissolved along with sodium chloride and potassium chloride, is added to a water-soluble halide solution.

When the addition is carried out on the grain surface, an aqueous solution comprising the necessary amount of a metal compound is also possible to be charged into a reaction vessel immediately after grain formation, or during physical ripening or at the completion thereof, or during chemical sensitization.

Herein, non-metallic dopants may also be incorporated in the interior of silver halide grains via a method similar to that for the metallic dopant described above.

Whether the above-described dopant exhibits electron trapping property, can be evaluated by a method heretofore commonly employed in the photographic industry, which will now be described. That is, a silver halide emulsion comprising silver halide grains, the interior of which is doped with the above-described dopant or a decomposition product thereof, can be evaluated by measuring the decrease photoconductivity by means of such as a microwave photoconductivity measurement method employing a silver halide emulsion, which contains no dopants, as a standard. Further, evaluation is also possible by means of an experiment to compare the internal sensitivity and the surface sensitivity of the silver halide grains.

On the other hand, as a method to evaluate effects of an electron trapping dopant based on this invention after forming a photothermographic material, is possible for example, as follows: The photosensitive material before exposure is heated under the same conditions as general thermal development conditions, thereafter being exposed via white light or light in a specific spectral sensitization region (in the case of being spectrally sensitized to a laser of a specific wavelength region, to light of the wavelength region and, for example, in the case of being spectrally sensitized to infrared light, to infrared light) for a predetermined time (such as 30 seconds) through an optical wedge, and further being thermally developed under the same thermal processing conditions to obtain a characteristic curve, the sensitivity determined from which is compared with the sensitivity of an imaging material employing silver halide emulsion containing no electron trapping dopant. That is, it is necessary to confirm that the sensitivity of the former sample comprising a silver halide emulsion containing a dopant, of this invention, is lower than the sensitivity of the latter sample which does not contain the dopant.

Herein, compared to the sensitivity based on a characteristic curve obtained when the photosensitive material is exposed to white light or light of a specific spectral sensitization region (such as infrared light) through an optical wedge for a predetermined time (for example, for 30 seconds) followed by being thermally developed under general thermal development conditions, is the sensitivity determined based on a characteristic curve which is obtained by heating the photosensitive material under the same thermal development conditions as general thermal development conditions, subjecting the material to the same predetermined exposure for the same predetermined time as described above, and further thermally developing the material under general thermal development conditions, the ratio is preferably at most 1/10, preferably a maximum of 1/20, and still more preferably not exceeding 1/50 when the silver halide emulsion is chemically sensitized.

Silver halide grains of this invention may be incorporated in a photosensitive layer (an image forming layer) by any functional method, and silver halide grains are preferably arranged to be adjacent to a reducible silver source (silver aliphatic carboxylate) with the aim of obtaining a photothermographic material provided with high sensitivity and high covering power (CP).

Silver halide grains of this invention are specifically preferably prepared in advance and added into a solution to prepare silver aliphatic carboxylate grains, with respect to separate handling of the preparation process of silver halide grain and the preparation process of silver aliphatic carboxylate grains, as well as controlling the production, however, it is also possible to have in combination a halogen component such as a halide ion coexist with a component to form silver aliphatic carboxylate at the time of preparation of silver aliphatic carboxylate grains, and to inject silver ions thereto, resulting in utilization of silver halide grains which are formed nearly simultaneously with formation of silver aliphatic carboxylate grains. Further, it is also possible to have in combination a halogen-containing compound react with silver aliphatic carboxylate and to prepare silver halide grains by converting silver aliphatic carboxylate, resulting in utilization of the grains. That is, it is also possible to have a silver halide forming component react with a solution or dispersion of silver aliphatic carboxylate, which is prepared in advance, or with a sheet material containing silver aliphatic carboxylate, resulting in converting some of the silver aliphatic carboxylate into photosensitive silver halide.

The silver halide grain forming components described above include inorganic halogen compounds, onium halides, hydrocarbon halogenides, N-halogen compounds and other halogen-containing compounds, and specific examples thereof are disclosed in such as U.S. Pat. Nos. 4,009,039, 3,457,075, 4,003,749, B.Pat. No. 1,498,956, and JP-A Nos. 53-27027 and 53-25420.

Silver halide grains, which are manufactured by converting some of the silver aliphatic carboxylate, may be employed in combination with silver halide grains, prepared separately as described above.

These silver halide grains, both those of silver halide grains separately prepared and silver halide grains prepared by converting silver aliphatic carboxylate, are preferably employed at 0.001-0.7 mol but more preferably 0.03-0.5 mol, compared to 1 mol of silver aliphatic carboxylate.

Excess salts in photosensitive silver halide grains separately prepared can be desalted by a commonly known desalting method such as a noodle method, a flocculation method, an ultra-filtration method and an electrical dialysis method, however, the grains can also be utilized without desalting.

Chemical Sensitization

Photosensitive silver halide grains of this invention may be subjected to chemical sensitization, for example, via such methods as described in JP-A Nos. 2001-249428 and 2001-249426, chemically sensitized centers (chemically sensitized nuclei), which can capture an electron or a hole generated by optical excitation of photosensitive silver halide grains or a spectral sensitizing dye on the grains, can be formed to be provided by employing a chalcogen releasing compound such as sulfur, selenium and tellurium, or a noble metal compound which releases a noble metal ion such as a gold ion. Specifically, silver halide grains are preferably chemically sensitized by an organic sensitizer containing a chalcogen atom.

These organic sensitizers provided with a chalcogen atom are preferably compounds having a group adsorbable on silver halide, and an unstable chalcogen atom portion.

As these organic sensitizers, utilized may be organic sensitizers provided with various structures disclosed in such as JP-A Nos. 60-150046, 4-109240, 11-218874, 11-218875, 11-218876 and 11-194447, however, it is preferable, among them, to utilize at least one type of compound provided with a structure in which a chalcogen atom is bonded with carbon atom or a phosphor atom via a double bond. Specifically, preferable are thiourea derivatives and triphenylphosphin sulfide derivatives, which are provided with a heterocyclic ring.

As a method to achieve chemical sensitization, various chemical sensitization techniques employed in manufacturing of a conventional silver halide photosensitive material for wet processing may be utilized (Reference Literature 1 and 2, described previously). Specifically, in the case of chemical sensitization to silver halide emulsion in advance, and thereafter it is mixed with photo-insensitive organic silver salt, chemical sensitization can be applied based on a conventionally either commonly utilized method.

The used amount of chalcogen compound as an organic sensitizer varies depending on such as: the chalcogen compound, the silver halide grains and the reaction conditions during chemical sensitization, however, it is preferably $10^{-8}$-$10^{-2}$ mol and more preferably $10^{-7}$-$10^{-3}$ mol per mol of silver halide. The environmental conditions during chemical sensitization are not specifically limited, however, chalcogen sensitization may be achieved via an organic sensitizer containing a chalcogen atom in the presence of a compound which can negate silver chalcogenide or silver nuclei on photosensitive silver halide grains or decrease the size thereof. The sensitization conditions in this case are pAg of preferably 6-11 and more preferably 7-10, pH of preferably 4-10 and more preferably 5-8, and temperature of preferably not higher than 30° C.

Further, chemical sensitization employing these organic sensitizers is preferably carried out in the presence of a hetero atom containing compound provided with an adsorptive property compared to a spectral sensitizing dye or silver halide grains. By performing chemical sensitization in the presence of a compound provided with an adsorptive property, compared to silver halide grains, it is possible to prevent dispersion of chemical sensitivity centers, thereby achieving high sensitivity and low fogging.

Spectral sensitizing dyes will be described later, and a hetero atom containing compound provided with an adsorptive property to silver halide grains include, as preferable examples, nitrogen containing heterocyclic compounds described in JP-A No. 3-24537. Heterocyclic rings in nitrogen containing heterocyclic compounds include, for example, pyrazole, primidine, 1,2,4-triazole, 1,2,3-triazole, 1,3,4-thiadiazole, 1,2,3-thiadiazole, 1,2,4-thiadiazole, 1,2,5-thiadiazole, 1,2,3,4-tetrazole, pyridazine, 1,2,3-triazine, and rings in which 2-3 of the above rings are bonded, such as rings of triazotriazole, diazaindene, triazaindene and pentaazaindene. Heterocyclic rings in which a heterocycle of a single ring and aromatic ring are condensed, such as phthalazine, benzimidazole, indazole and benzothiazole rings are also applicable.

Preferable among them is an azaindene ring, and further more preferred are compounds having a hydroxyl group as a substituent group such as hydroxytriazaindene, tetrahydroxyazaindene and hydroxypentazaindene compounds.

The above-described heterocyclic rings may be provided with a substituent other than a hydroxyl group. The substituent includes such as an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom and a cyano group.

The addition amount of these heterocyclic ring containing compounds varies over a wide range depending on the size or composition of silver halide grains and other conditions, however, approximately $10^{-6}$-1 mol and more preferably $10^{-4}$-$10^{-1}$ mol, per mol of silver halide.

Noble metal sensitization can be applied to photosensitive silver halide via a noble metal ion, such as a gold ion, releasing compound. For example, chloro aurate and organic gold compounds may be utilized as a gold sensitizer. Herein, the gold sensitization technique, disclosed in JP-A No. 11-194447, may be referred to and employed.

Further, a reduction sensitization method in addition to the above-described sensitization methods may be utilized, and, for example, ascorbic acid, thiourea dioxide, stannous chloride, hydrazine derivatives, borane compounds, silane compounds and polyamine compounds may be employed. Further, reduction sensitization can be performed by ripening the emulsion while maintaining the pH at not lower than 7 and the pAg at not higher than 8.3.

In this invention, silver halide grains exhibiting chemical sensitization may be any of those formed in the presence of silver aliphatic carboxylate, those formed under conditions in absence of organic silver salt, or those in which both coexist.

In the case of chemical sensitization having been performed on the surface of photosensitive silver halide grains, it is necessary that the effect of the chemical sensitization essentially disappears after the thermal development process. Herein, that the effect of chemical sensitization essentially disappears means that sensitivity of the thermally developable material obtained by the foregoing chemical sensitization technique is decreased to a maximum of 1.1 times of the sensitivity without chemical sensitization after the thermal development process. To remove the effects of chemical sensitization via thermal development process, it is necessary to include an appropriate amount of an oxidant, such as the foregoing halogen radical releasing compound, which can destroy chemical sensitivity centers (chemical sensitivity nuclei) during thermal development in an emulsion layer or/and a photo-insensitive layer. The content of the oxidant is preferably adjusted based on such as oxidizing capability of the oxidant and a decreasing range of the chemical sensitization effect.

Spectral Sensitization

Photosensitive silver halide is preferably subjected to spectral sensitization by adsorbing a spectral sensitizing dye. As spectral sensitization dyes, utilized may be such as cyanine dyes, merocyanine dyes, complex cyanine dyes, complex merocyanine dyes, holopolar cyanine dyes, styryl dyes, hemicyanine dyes, oxonol dyes and hemioxonol dyes. Sensitization dyes which may be utilized are described, for example, in JP-A Nos. 63-159841, 60-140335, 63-231437, 63-259651, 63-304242 and 63-15245; and U.S. Pat. Nos. 4,639,414, 4,740,455, 4,741,966, 4,751,175 and 4,835,096.

Beneficial sensitizing dyes utilized in this invention are described, for example, in Research Disclosure (hereinafter, abbreviated as RD) 17643, item IV-A (December 1978, p. 23), RD 18431, item X (August 1978, p. 437), or literature cited therein. Specifically, it is preferable to utilize sensitizing dyes provided with spectral sensitivity suitable for the spectral characteristic of light sources of various types of laser imagers or scanners. For example, compounds which are described in JP-A Nos. 9-34078, 9-54409 and 9-80679, are preferably utilized.

Useful cyanine dyes are, for example, cyanine dyes provided with a basic nucleus such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes preferably also contains an acid nucleus such as a thiohydantoin nucleus, a rhodanine nucleus, an oxazolidinedione nucleus, a thizolinedione nucleus, a barbituric acid nucleus, a thiazolinone nucleus, a malonitrile nucleus and a pyrazolone nucleus, in addition to the above-described basic nucleus.

In this invention, sensitizing dyes provided with spectral sensitivity, specifically in the infrared region, may also be utilized. Infrared spectral sensitizing dyes preferably utilized include those disclosed, for example, in U.S. Pat. Nos. 4,536,473, 4,515,888 and 4,959,294.

In the photothermographic material of this invention, at least one type of sensitizing dye represented by following Formula (SD-1) and a sensitizing dye represented by Formula (SD-2) are preferably contained.

Formula (SD-1)

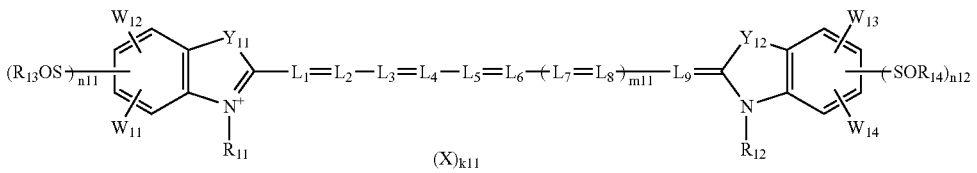

-continued

Formula (SD-2)

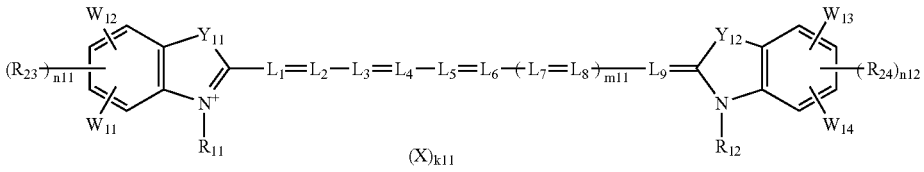

In the above formulas, $Y_{11}$ and $Y_{12}$ are each an oxygen atom, a sulfur atom, a selenium atom or a —CH═CH— group, and $L_1$, $L_2$, $L_3$, $L_4$, $L_5$, $L_6$, $L_7$, $L_8$, and $L_9$ each represent a methine group. $R_{11}$ and $R_{12}$ each represent an aliphatic group, $R_{13}$, $R_{14}$, $R_{23}$ and $R_{24}$ are each a lower alkyl group, a cycloalkyl group, an alkenyl group, a cycloalkyl group, an alkenyl group, an aralkyl group, an aryl group or a heterocyclic group; $W_1$-$W_4$ are each a hydrogen atom, a substituent or a nonmetallic element group necessary to form a condensed ring by bonding between $W_1$ and $W_2$, and $W_3$ and $W_4$; or a nonmetallic element group to a form 5- or 6-member condensed ring by bonding between $R_{13}$ and $W_1$, $R_{13}$, and $W_2$, $R_{23}$ and $W_1$, $R_{23}$ and $W_2$, $R_{14}$ and $W_3$, $R_{14}$ and $W_4$, $R_{24}$ and $W_3$, $R_{24}$ and $W_4$; X is an ion necessary to balance for charges in the molecule; k1 is the number of ions necessary to balance for charges in the molecule, m1 is an integer of 0 or 1, and n1 and n2 are each an integer of 0-2, when n1 and n2 are not simultaneously 0.

The above-described infrared sensitizing dyes can be easily synthesized via the described method, for example in by F. M. Harmer, The Chemistry of Heterocyclic Compounds, volume 18, and The Cyanine Dyes and Related Compounds (A. Weissberger ed. Interscience Corp., New York 1964).

The timing of addition of these infrared sensitizing dyes may be as appropriate after silver halide preparation, and the dyes may be added into silver halide grains of a photosensitive silver halide emulsion containing silver halide grains/silver aliphatic carboxylate grains, for example, by being dissolved in a solvent or dispersed in a micro-particle form, that is, a so-called solid dispersion state. Further, similar to a hetero atom containing compound exhibiting an adsorbing tendency for the foregoing silver halide grains, chemical sensitization can be performed after the dye is adsorbed on silver halide grains prior to chemical sensitization, thereby, dispersion of chemical sensitivity nuclei can be prevented resulting in achievement of high sensitivity and low fogging.

One type of the above-described spectral sensitizing dye may be utilized alone; however, it is preferable to utilize plural types of spectral sensitizing dyes in combination, and such combinations of sensitizing dyes are often utilized, specifically, for supersensitization, and broadening or adjustment, of the photosensitive wavelength range.

In an emulsion which contains photosensitive silver halide grains and silver aliphatic carboxylate, and is utilized for a photothermographic material, a substance which is not provided with a spectral photosensitizing effect or basically does not absorb visible light but exhibits a supersensitization effect itself, may be incorporated together with a sensitizing dye in the emulsion to supersensitize the silver halide grains.

Useful sensitizing dyes, dye combinations which exhibit supersensitization and substances which exhibit supersensitization are described in such as RD 17643, p. 23 item IV-J (December 1978), Examined Japanese Patent Application Publication Nos. (hereinafter, referred to as JP-B) 9-25500 and 43-4933, and JP-A Nos. 59-19032, 59-192242 and 5-341432, however, heterocyclic aromatic mercapto compounds or mercapto derivatives represented by the following formula are preferable.

Ar-SM wherein, M is a hydrogen atom or an alkalimetal atom, Ar is a hetero-aromatic ring or a condensed aromatic ring provided with at least one nitrogen, sulfur, oxygen, selenium or tellurium atom. The hetero-aromatic ring is preferably benzoimidazole, naphthoimidazole, benzothiazole, naphthothiazole, benzooxazole, naphthopoxazole, benzoselenazole, benzotellurazole, imidazole, oxazole, pyrazole, triazole, triazine, pyrimidine, pyridazine, pyridine, purine, quinoline or chinazoline. However, other hetero-aromatic rings may also be included.

Herein, mercapto derivative compounds, which typically generate the mercapto compound described above when incorporated in a dispersion of silver aliphatic carboxylate or a silver halide grain emulsion, are also included. Particularly, preferable examples include mercapto derivatives represented by the following formula.

Ar—S—S—Ar

In the formula, Ar is identical to that in the case of mercapto compounds represented previously.

The above hetro-aromatic ring may be provided with a substituent selected from a group comprising such as a halogen atom (chlorine, bromine, iodine), a hydroxyl group, an amino group, a carboxyl group, an alkyl group (exhibiting at least 1 and preferably 1-4 carbon atoms) and an alkoxy group (also exhibiting at least 1 and preferably 1-4 carbon atoms).

In addition to the super sensitizers described above, large cyclic compounds featuring a hetero atom, which are disclosed in JP-A No. 2001-330918, may be utilized as a super sensitizer.

A super sensitizer in an image forming layer which contains organic silver salt and silver halide grains is preferably utilized at 0.001-1.0 and specifically preferably at 0.01-0.5 mol, per mol of silver.

In this invention, spectral sensitization is performed by adsorbing a spectral sensitizing dye on the surface of photosensitive silver halide grains, scince it is necessary to lose most of the spectral sensitization effect after the thermal development process. Herein, "to lose a spectral sensitization effect" refers to the fact that the sensitivity of the thermally developable material, which is obtained by such as a sensitizing dye and a super sensitizer, is decreased after the thermal development process to not more than 1.1 times that of the sensitivity in the case of not being spectrally sensitized. Further, to negate the chemical sensitization effect during the thermal development process, it is necessary to utilize a spectral sensitizing dye which tends to be released from silver halide grains via heat, or/and to incorporate an oxidant which can negate a spectral sensitizing dye via an oxidation reaction, such as an appropriate amount of the foregoing halogen radical releasing compound, in an emulsion layer or/and a photo-insensitive layer of the thermally developable material. The content of the oxidant is preferably adjusted in view of the oxidizing capability of the oxidant, and the decreasing degree of the spectral sensitization effect.

Reducing Agent

In this invention, as a reducing agent (silver ion reducing agent), in particular, as at least one type of reducing agents, is a compound represented by following Formula (1) which is utilized alone or in combination with other reducing agent provided with a different chemical structure.

Formula (1)

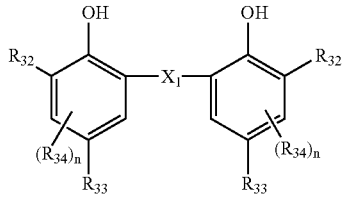

wherein, $X_1$ is a chalcogen atom or $CHR_{31}$, $R_{31}$ is a hydrogen atom, a halogen atom, an alkyl group, an alkenyl group, an aryl group or a heterocyclic group, the two $R_{32}$ are an alkyl group, and may be the same or different. $R_{33}$ is a hydrogen atom or a group capable of substituting onto a benzene ring, $R_{34}$ is a group capable of substituting onto a benzene ring, and m and n are each an integer of 0-2.

Among compounds represented by Formula (1), specifically, a highly active reducing agent [hereinafter, referred to as a compound of Formula (1a)], in which at least one of $R_{32}$ is a secondary or tertiary alkyl group, and is preferably utilized with respect to obtaining a photothermographic material which exhibits high density and excellent image storage stability. In this invention, it is preferable to utilize a compound of Formula (1a) and a compound of Formula (2) in combination to obtain desirable tone.

Formula (2)

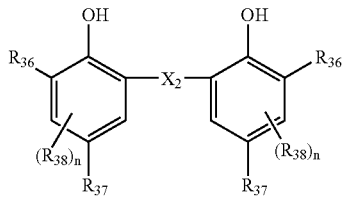

wherein, $X_2$ is a chalcogen atom or $CHR_{35}$, and $R_{35}$ is a hydrogen atom, a halogen atom, an alkyl group, an alkenyl group, an aryl group or a heterocyclic group. The two $R_{36}$ are an alkyl group, and may be the same or different; however, they are never a secondary or tertiary alkyl group. $R_{37}$ is a hydrogen atom or a group capable of substituting onto a benzene ring, $R_{38}$ is also a group capable of substituting onto a benzene ring, and m and n are each an integer of 0-2.

The used amount ratio, [compound of Formula (1a)]/[compound of Formula (2)] is preferably 5.95-45.55 (weight ratio), but more preferably 10/90-40/60 (weight ratio).

In Formula (1), a chalcogen atom represented by $X_1$ is sulfur, selenium or tellurium but preferably a sulfur atom. Further, $R_{31}$ of $CHR_{31}$ represented by $X_1$ is a hydrogen atom, a halogen atom, an alkyl group, an alkenyl group, an aryl group or a heterocyclic group. The halogen atom is a fluorine atom, a chlorine atom or a bromine atom; the alkyl group is preferably a substituted or unsubstituted alkyl group exhibiting 1-20 carbon atoms and specific examples are separate groups of such as methyl, ethyl, propyl, butyl, hexyl and heptyl; alkenyl groups are such as vinyl, allyl, butenyl, hexenyl, hexadienyl, ethenyl-2-propenyl, 3-butenyl, 1-methyl-3-propenyl, 3-pentenyl and 1-methyl-3-butenyl; aryl groups are such as phenyl and naphthyl; and heterocyclic groups are such as thienyl, furyl, imidazolyl and pyrrolyl.

These groups may be provided with a substituent and specific examples of the substituent include halogen atoms (such as fluorine, chlorine and bromine); alkyl groups (such as methyl, ethyl, propyl, butyl, pentyl, i-pentyl, 2-ethylhexyl, octyl and decyl); cycloalkyl groups (such as cyclohexyl and cycloheptyl); alkenyl groups (such as ethenyl-2-propenyl, 3-butenyl, 1-methyl-3-propenyl, 3-pentenyl and 1-methyl-3-butenyl); cycloalkenyl groups (such as a 1-cycloalkenyl group and a 2-cycloalkenyl group); alkynyl groups (such as ethynyl and 1-propynyl); alkoxy groups (such as methoxy, ethoxy and propoxy); alkylcarbonyloxy (such as acetyloxy); alkylthio groups (such as methylthio and trifluoromethylthio); acyl groups (such as an acetyl group and a benzoyl group); a carboxyl group, alkylcarbonylamino groups (such as acetylamino); ureido groups (such as methylaminocarbonylamino); alkylsulfonylamino groups (such as methanesulfonylamino); alkylsulfonyl groups (such as methane sulfonyl and trifluoromethanesulfonyl); carbamoyl groups (such as carbamoyl, N,N-dimethylcarbamoyl and N-morphorinocarbonyl); sulfamoyl groups (such as sulfamoyl, N,N-dimethylsulfamoyl and morphorinosulfamoyl); a trifluoromethyl group, a hydroxyl group, a nitro group, an cyano group, alkylsulfonamido groups (such as methanesulfonamido and butanesulfonamido); alkylamino (such as amino, N,N-dimethylamino and N,N-diethylamino); a sulfo group, a phosphono group, a sulfite group, a sulfino group, an alkylsulfonylaminocarbonyl groups (such as methanesulfonylaminocarbonyl and ethanesulfonylaminocarbonyl); alkylcarbonylaminosulfonyl groups (such as acetoamidosulfonyl and methoxyacetoamidosulfonyl); alkylaminocarbonyl groups (such as acetoamidocarbonyl and methoxyacetoamidocarbonyl) and alkylsulfinylaminocarbonyl groups (such as methanesulfinylaminocarbonyl and ethanesulfinylaminocarbonyl). Further, in the case of at least two substituents being provided, they may be same or different. The specifically preferable substituent as $R_{31}$ is an alkyl group.

Alkyl groups represented by $R_{32}$ may be the same or different, however, at least one of them is preferably a secondary or tertiary alkyl group. The alkyl groups are preferably substituted or unsubstituted ones having 1-20 carbon atoms, and specifically include groups of such as methyl, ethyl, propyl, i-propyl, butyl, i-butyl, t-butyl, t-pentyl, t-octyl, cyclohexyl, cyclopentyl, 1-methylcyclohexyl and 1-methylcyclopropyl.

Substituents of the alkyl groups are not specifically limited and include such as an aryl group, a hydroxyl group, an alkoxy group, an aryloxy group, an alkylthio group, an arylthio group, an acyamino group, a sulfonamide group, a sulfonyl group, a phosphoryl group, an acyl group, a carbamoyl group, an ester group and a halogen atom. Further, $R_{32}$ may form a saturated ring together with $(R_{34})_n$ and $(R_{34})_m$. Both $R_{32}$ are preferably a secondary or tertiary alkyl group having 2-20 carbon atoms, are more preferably a tertiary alkyl group, still more preferably t-butyl, t-pentyl or 1-methylcyclohexyl, but most preferably t-butyl.

$R_{33}$ is a hydrogen atom or a group which can be substituted onto a benzene ring; and a group which can be substituted onto a benzene ring includes, for example, a halogen atom (such as fluorine, chlorine and bromine), an alkyl group, an aryl group, a cycloalkyl group, an alkenyl group, a cycloalkenyl group, an alkynyl group, an amino group, an acyl group, an acyoxy group, an acyamino group, a sulfonylamino group, a sulfamoyl group, a carbamoyl group, an alkylthio group, a sulfonyl group, an alkylsulfonyl group, a sulfinyl group, a cyano group and a heterocyclic group. $R_{33}$ is preferably methyl, ethyl, i-propyl, t-butyl, cyclohexyl, 1-methylcyclohexyl or 2-hydroxyethyl, and is more preferably methyl or 2-hydroxyethyl.

These groups may be further provided with a substituent and those listed for above $R_{31}$ may be employed as the substituent. $R_{33}$ is preferably an alkyl group having 1-20 carbon atoms, provided with a hydroxyl group or a precursor group thereof, more preferably an alkyl group having 1-5 carbon atoms, and most preferably 2-hydroxyethyl. The most preferable combination of $R_{32}$ and $R_{33}$ is one in which $R_{32}$ is a tertiary alkyl group (such as t-butyl and 1-methycyclohexyl) and $R_{33}$ is a primary alkyl group (such as 2-hydroxyethyl) provided with a hydroxyl group or a precursor group thereof. A plural number of $R_{32}$ and $R_{33}$ may be the same or different.

$R_{34}$ is a group to be substituted onto a benzene ring, and specifically includes alkyl groups having 1-25 carbon atoms (such as methyl, ethyl, propyl, i-propyl, t-butyl, pentyl, hexyl and cyclohexyl); halogenated alkyl groups (such as trifluoromethyl and perfluorooctyl); cycloalkyl groups (such as cyclohexyl and cyclopentyl); alkynyl groups (such as propargyl); a glycidyl group, an acrylate group, a methacrylate group, aryl groups (such as phenyl); heterocyclic groups (such as pyridyl, thiazolyl, oxazolyl, imidazolyl, furyl, pyrrolyl, pyrazinyl, pirimidinyl, pyridazinyl, selenazolyl, sulforanyl, pyperidinyl, pyrazolyl and tetrazolyl); halogen atoms (such as chlorine, bromine, iodine and fluorine); alkoxy groups (such as methoxy, ethoxy, propyloxy, pentyloxy, cyclpentyloxy, hexyloxy and cyclohexyloxy), aryloxy groups (such as phenoxy); alkoxycarbonyl groups (such as methyloxycarbonyl, ethyloxycarbonyl and butyloxycarbonyl); aryloxycarbonyl groups (such as phenyloxycarbonyl); sulfonamide grops (such as methanesulfonamide, ethanesulfonamide, butanesulfonamide, hexanesulfonemide, cyclbhexanesulfonemide and benzenesulfonamide); sulfamoyl groups (such as aminosulfonyl, methylaminosulfonyl, dimethyaminosulfonyl, butylaminosulfonyl, hexylaminosulfonyl, cyclohexylaminosulfonyl, phenylaminosulfonyl and 2-pyridylaminopsulfonyl); urethane groups (such as methylureido, ethylureido, pentylureido, cyclohexylurido, phenylureido and 2-pyridylureido); acyl groups (such as acetyl, propionyl, butanoyl, hexanoyl, cyclohexanoyl, benzoyl and pyridinoyl); carbamoyl groups (such as aminocarbonyl, methylaminocarbonyl, dimethyaminocarbonyl, propylaminocarbonyl, pentylaminocarbonyl, cyclohexylaminocarbonyl, phenyaminocarbonyl and 2-pyridylaminocarbonyl); amido groups (such as acetamido, propioneamido, butaneamido, hexaneamido and benzamido); sulfonyl groups (such as methylsulfonyl, ethylsulfonyl, butylsylfonyl, cyclohexylsulfonyl, phenylsulfonyl and 2-pyridylsulfonyl); amino groups (such as amino, ethylamino, dimethylamino, butylamino, cyclopentylamino, aniline and 2-pyridylamino); a cyano group, a nitro group, a sulfo group, a carboxyl group, a hydroxyl group and an oxamoyl group. These groups may be further substituted by others of these groups.

n and m are an integer of 0-2, but most preferably n and m are both 0.

Further, $R_{34}$ may form a saturated ring with $R_{32}$ and $R_{33}$. $R_{34}$ is preferably a hydrogen atom, a halogen atom or an alkyl group but more preferably a hydrogen atom. A plural number of the $R_{34}$ may be the same or different.

In Formula (2), $R_{35}$, $R_{37}$ and $R_{38}$ are each groups similar to $R_{31}$, $R_{33}$ and $R_{34}$, respectively. Alkyl groups represented by $R_{36}$ may be the same or different, however, are never a secondary or tertiary alkyl group. The alkyl groups are preferably those having 1-20 carbon atoms, and specifically include groups of such as methyl, ethyl and butyl.

Substituents of the alkyl groups are not specifically limited, and include such as an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group and a halogen atom. Further, the $R_{36}$ are preferably methyl and may form condensed rings together with $(R_{38})_n$ and $(R_{38})_m$. Preferably employed compounds described above, represented by Formula (2), are those which satisfy Formula (S) and Formula (T) described in European Patent No. 1,278,101, and specifically, include compounds of (1-24), (1-28)-(1-54), (1-56)-(1-75) described in pp. 21-28 of the publication.

In the following, specific examples compounds represented by Formulas (1) and (2) are listed; however, this invention is not limited thereto.

(1-1)

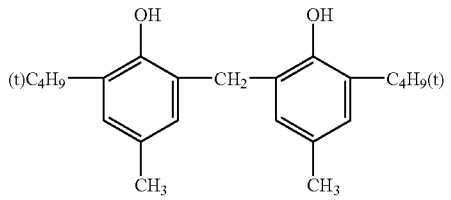

(1-2)

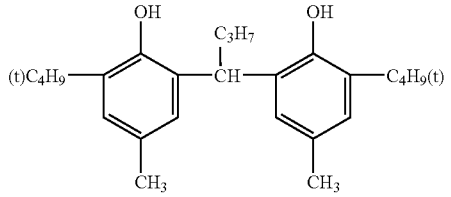

(1-3)

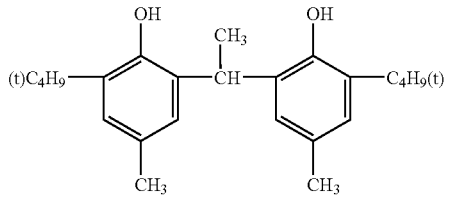

(1-4)

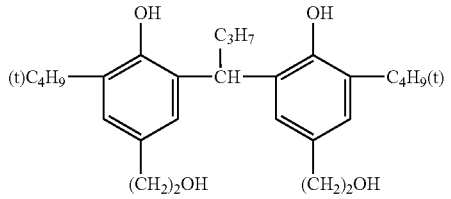

-continued
(1-5)
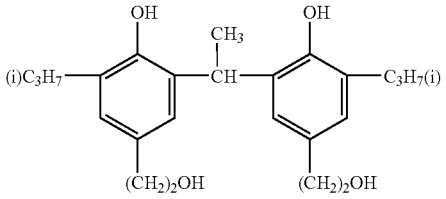
(1-6)
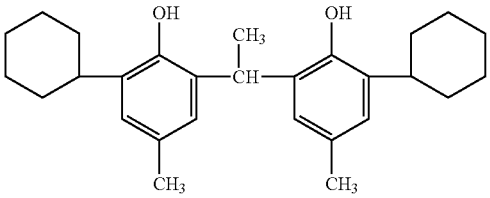
(1-7)
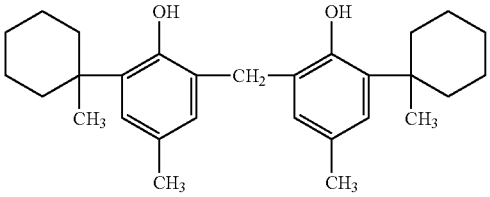
(1-8)
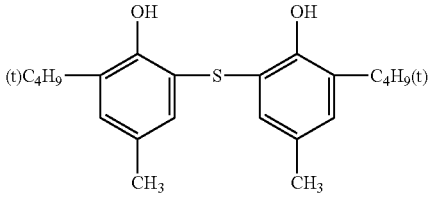
(1-9)
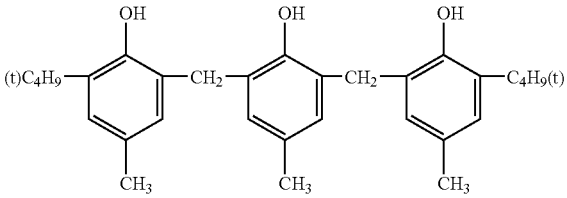
(1-10)
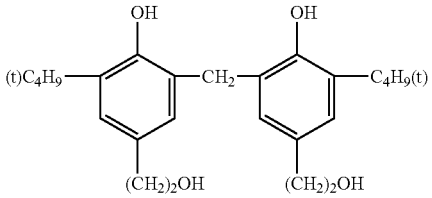
(2-1)
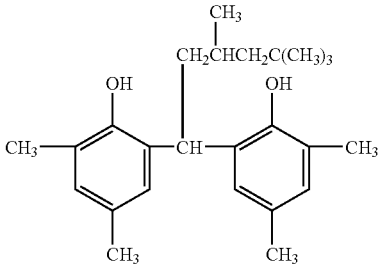
-continued
(2-2)
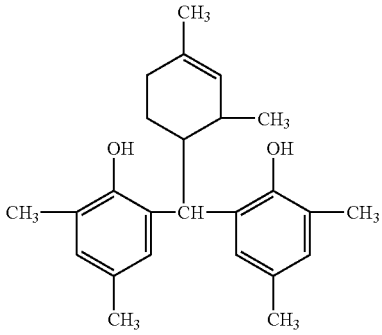
(2-3)
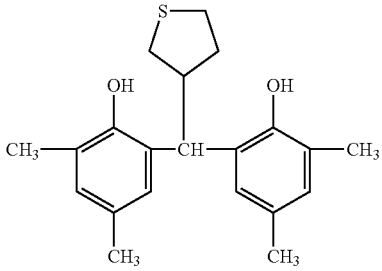
(2-4)
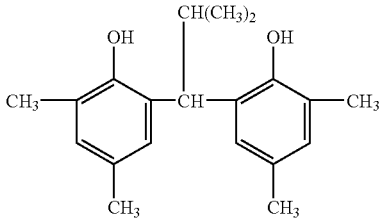
(2-5)
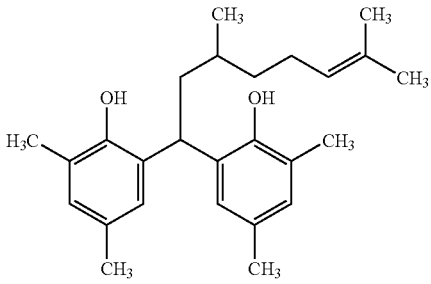
(2-6)
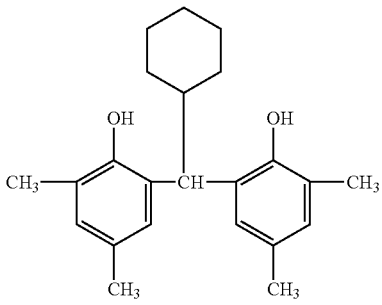

-continued (2-7)

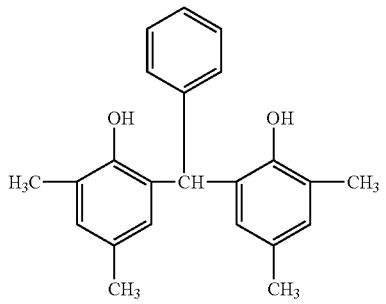

(2-8)

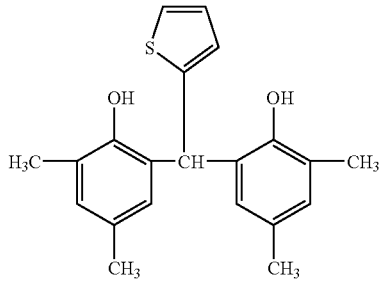

Bisphenol compounds represented by Formulas (1) and (2) described above can be easily synthesized by a conventional method.

A reducing agent incorporated in a photothermographic material forms a silver image by reducing organic silver salt. Reducing agents which can be employed in combination with reducing agents of this invention are described in such as U.S. Pat. Nos. 3,770,448, 3,773,512 and 3,593,863; RD Nos. 17029 and 29963; and JP-A Nos. 11-119372 and 2002-62616.

The used amount of a reducing agent such as compounds represented by foregoing Formula (1) is preferably $1\times10^{-2}$-10 mol per mol of silver, but more preferably $1\times10^{-2}$-1.5 mol.

Image Tone

Next, image tone obtained by thermal development of a photothermographic material will be described.

It is generally agreed that tone of output images for medical diagnostic application such as conventional X-ray photographic film preferably employs cold image tone to more easily enable accurate diagnostic observation results by medical staff. Herein, cold image tone referrs to a pure black tone, or a bluish black tone in which black images have a bluish tone. On the other hand, warm tone refers to warm black tone in which black images have a brownish tone, however, to more precisely discuss and quantity the following, tone will be explained based on the expressions proposed by the International Commission on Illumination (CIE).

Terms related to tone, "colder tone" and "warmer tone" can be expressed by hue angles $h_{ab}$ at the minimum density Dmin and an optical density of 1.0. That is, hue angle $h_{ab}$ is determined according to the following equation by utilizing color coordinates a*, b* in a color space exhibiting basically uniform visual steps, having been recommended by International Commission on Illumination, 1976.

$$h_{ab}=\tan^{-1}(b^*/a^*)$$

As a result of study in regard to the above expression based on color angle, it has been proved that tone after development of a photothermographic material of this invention is preferably $180°<h_{ab}<270°$, more preferably $200°<h_{ab}<270°$, but most preferably $220°<h_{ab}<260°$, as the range of color angle, which values are disclosed in JP-A 2002-6463.

Herein, conventionally, it is generally accepted that a diagnostic image having a preferable visual tone can be obtained by adjusting u*, v* or a*, b* in CIE 1976 (L*u*v*) or (L*a*b*) color space around an optical density of 1.0 to specific values and which is further described in JP-A 2000-29164.

However, as a result of further intensive study on the thermal developable photosensitive material of this invention, it has been found that when u*, v* or a*, b* are plotted at various photographic densities on a graph employing u* or a* as the abscissa and v* or b* as the ordinate in CIE, 1976 (L*u*v*) space or (L*a*b*) space to form a linear regression line, diagnostic capability, higher than conventional wet processing silver salt photosensitive material, can be obtained by adjusting the linear regression line in specific regions. In the following paragraphs, the preferable region of such conditions will be described.

1) Each density at optical densities of 0.5, 1.0, 1.5 and the minimum of a silver image obtained by thermally developing a photothermographic material was measured, whereby the coefficient of determination (double determination) R2 of a linear regression line, which is formed by u* and v* at the above optical densities being arranged in a two dimensional coordinate using u* as the abscissa and v* as the ordinate in CIE 1976 (L*u*v*) color space, is preferably 0.998-1.000. Further, v* value at the crossing point of the linear regression line with the ordinate is −5 to 5 and the slope (v*/u*) is preferably 0.7-2.5.

2) Further, each density at optical densities of 0.5, 1.0, 1.5 and the minimum, of the photothermographic material was measured, the coefficient of determination (double determination) R2 of a linear regression line, which is formed by a* and b* at the above optical densities being arranged in a two dimensional coordinate having a* as the abscissa and b* as the ordinate in CIE 1976 (L*a*b*) color space, is preferably 0.998-1.000. Further, b* value at the crossing point of the linear regression line with the ordinate is −5 to 5 and the slope (b*/a*) is preferably 0.7-2.5.

Next, a forming method of the above-described linear regression line, that is, an example of a measuring method of u*, v* and a*, b* in CIE 1976 color space will be explained.

A four-step wedge sample including an unexposed portion and optical densities of 0.5, 1.0 and 1.5 was prepared via a thermal developing device. Each wedge density portion thus prepared is measured via a spectral color meter, such as CM-3600d, (manufactured by Minolta Co. Ltd.) to calculate u*, v* and a*, b*. As measurement conditions at that time, measurement is carried out employing F7 light source at a visional degree of 10° via a transparent measurement mode. Measured u*, v* or a*, b* are plotted on a graph having u* or a* as the abscissa and v* or b* as the ordinate to determine a linear regression line and determining coefficient R2 and the coefficient of determination (a double determination) R2, an intercept and an inclination are obtained.

Next, a specific method to obtain a linear regression line provided with the above characteristics will be explained.

In this invention, it is possible to optimize the developed silver particle shape to result in a preferable tone by adjusting the addition amount of directly or indirectly related compounds in a development reaction process of such as a toning agent, a developer, silver halide grains and silver aliphatic carboxylate. For example, to form a dendrite shaped results in a tendency in the bluish range, while to form a filament shaped developed silver results in a of a tendency of being yellowish. That is, it is possible to control the tone in consideration of such characteristics of a developed silver particle shape.

Conventionally, phthalazinone or phthalazine, and phthalic acids or phthalic acid anhydrides, are generally utilized as a toning agent. Examples of preferable toning agents are disclosed in such as RD 17029, and U.S. Pat. Nos. 4,123,282, 3,994,732, 3,846,136 and 4,021,249.

In addition to such toning agents, couplers disclosed in such as JP-A No. 11-288057 and European Patent No. 1,134,611 A2, and leuco dyes which will be detailed below can be utilized to control the tone. Specifically, it is preferable to utilize a coupler or a leuco dye for fine adjustment of tone.

Leuco Dye

A leuco dye is preferably any compound which is colorless or minimally colored and is oxidized to a colored state when heated at a temperature of approximately 80-200° C. for approximately 0.5-30 seconds, and any leuco dye, which is oxidized by a silver ion to form a dye, can be also utilized. A compound which is provided with pH sensitivity and can be oxidized into a colored state, is useful.

Typical leuco dyes suitable to be utilized in this invention are not specifically limited, and include such as bisphenol leuco dyes, phenol leuco dyes, indoaniline leuco dyes, acrylated azine leuco dyes, phenoxazine leuco dyes, phenodiazine leuco dyes and phenothiazine leuco dyes. Further, useful are leuco dyes disclosed in such as U.S. Pat. Nos. 3,445,234, 3,846,136, 3,994,732, 4,021,249, 4,021,250, 4,022,617, 4,123,282, 4,368,247 and 4,461,681; and JP-A Nos. 50-36110, 59-206831, 5-204087, 11-231460, 2002-169249 and 2002-236334.

To adjust the tone to a predetermined value, it is preferable to utilize leuco dyes of various colors alone or in combination of plural types. In this invention, to prevent change of tone (particularly yellowish tone) depending on the used amount and used ratio thereof in the case of employing a highly active reducing agent, or to prevent the image particularly at a density portion at a high of at least 2.0 from having excessive reddish tone in the case of employing micro-particle silver halide, it is preferable to utilize leuco dyes which provide yellow color and cyan color in combination, and then adjust the used amount.

The color density is suitably controlled depending on the tone of the developed silver itself. In this invention, it is preferable colored as to exhibit an optical reflection density of 0.01-0.05, or a transparent density of 0.005 to 0.50, and to adjust the tone of an image in a preferable range described above. The total of the maximum densities at the maximum absorption wavelength of color images formed by leuco dyes is preferably set to 0.01-0.50, more preferably 0.02-0.30 and most preferably 0.03-0.10.

Yellow Coloring Leuco Dye

In this invention, a color image forming agent which increases absorbance at 360-450 nm via oxidation is preferably utilized, particularly as yellow color leuco dyes, and further color image forming agents represented by following Formula (YA) are preferred.

Formula (YA)

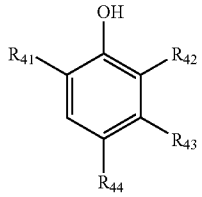

wherein, $R_{41}$ is a substituted or unsubstituted alkyl group, while $R_{42}$ is a hydrogen atom, a substituted or unsubstituted alkyl group, or is a substituted or unsubstituted acylamino group, however, $R_{41}$ and $R_{42}$ may never be a 2-hydroxyphenylmethyl group, $R_{43}$ is a hydrogen atom or a substituted or unsubstituted alkyl group, while $R_{44}$ is a group which can be substituted to a benzene ring.

In the following paragraphs, compounds of Formula (YA) will be detailed.

In above Formula (YA), $R_{41}$ is a substituted or unsubstituted alkyl group, however, $R_{41}$ represents an alkyl group in the case of $R_{42}$ being a substituent other than a hydrogen atom. The alkyl group is preferably an alkyl group having 1-30 carbon atoms which may be provided with a substituent. Specifically, such as methyl, ethyl, butyl, octyl, i-propyl, t-butyl, t-octyl, t-pentyl, sec-butyl, cyclohexyl and 1-methyl-cyclohexyl are preferable, and groups being sterically larger than i-propyl (such as i-propyl, i-nonyl, t-butyl, t-amyl, t-octyl, cyclohexyl, 1-methyl-cyclohexyl and adamantyl) are preferable; of these, secondary and tertiary alkyl groups are preferable; and tertiary alkyl groups such as t-butyl, t-octyl and t-pentyl are most preferable. Substituents in which $R_{41}$ may be provided include such as a halogen atom, an aryl group, an alkoxy group, an amino group, an acyl group, an acyamino group, an alkylthio group, an arylthio group, a sulfonamide group, an acyloxy group, an oxycarbonyl group, a carbamoyl group, a sulfamoyl group, a sulfonyl group and a phosphoryl group.

$R_{42}$ is a hydrogen atom, or is a substituted or unsubstituted alkyl group, or also a substituted or unsubstituted acylamino group. Alkyl groups represented by $R_{42}$ are preferably alkyl groups having 1-30 carbon atoms, and acylamino groups are preferably acylamino groups also having 1-30 carbon atoms, and of these, explanation of the alkyl group is similar to that of $R_{41}$ described above.

Acylamino groups represented by $R_{42}$ may be either substituted or unsubstituted, and specifically include such as an acetylamino group, an alkoxy acetylamino group and an aryloxy acetylamino group. $R_{42}$ is preferably a hydrogen atom or an unsubstituted alkyl group having 1-24 carbon atoms, and specifically include such as methyl, i-propyl and t-butyl. Further, $R_{41}$ and $R_{42}$ are never a 2-hydroxyphenylmethyl group.

$R_{43}$ is a hydrogen atom or a substituted or unsubstituted alkyl group. Of alkyl groups preferably having 1-30 carbon atoms, the explanation of the alkyl groups is similar to that of foregoing $R_{41}$. $R_{43}$ is preferably a hydrogen atom or an unsubstituted alkyl group having 1-24 carbon atoms, and specifically include such as methyl, i-propyl and t-butyl. Further, either $R_{42}$ or $R_{43}$ is preferably a hydrogen atom.

$R_{44}$ is a group on which a benzene ring may be substituted, and is, for example, a group similar to the explained as substituent of $R_{34}$ in foregoing Formula (1). $R_{44}$ is preferably an alkyl group having 1-30 carbon atoms, or an oxycarbonyl group having 2-30 carbon atoms, but more preferably an alkyl group having 1-24 carbon atoms, which may be substituted or unsubstituted. Substituents to an alkyl group include such as an aryl group, an amino group, an alkoxy group, an oxycarbonyl group, an acylamino group, an acyloxy group, an imido group and an ureido group, bit more preferable are an aryl group, an amino group, an oxycarbonyl group and an alkoxy group. These substituents of an alkyl group may be further substituted by these substituents.

Bisphenol compounds represented by following Formula (YB), which are specifically preferably employed among compounds represented by Formula (YA), will be now explained.

Formula (YB)

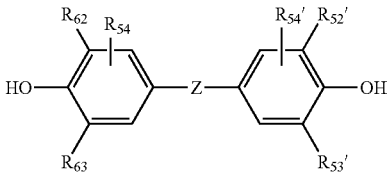

wherein, Z is —S— or —C($R_{51}$)($R_{51'}$)—, and $R_{51}$ and $R_{51'}$ are each a hydrogen atom or a substituent. Substituents represented by $R_{51}$ and $R_{51'}$ include groups similar to substituents listed in the explanation of $R_{31}$. $R_{51}$ and $R_{51'}$ are preferably a hydrogen atom or an alkyl group.

$R_{52}$, $R_{53}$, $R_{52'}$ and $R_{53'}$ are each a substituent, and the substituents include groups similar to substituents listed up as $R_{32}$ and $R_{33}$ in Formula (1).

$R_{52}$, $R_{53}$, $R_{52'}$ and $R_{53'}$ are preferably an alkyl group, an alkenyl group, an alkynyl group, an aryl group or a heterocyclic group, however, it is more preferably an alkyl group. Substituents on the alkyl group include groups similar to substituents listed in the explanation of substituents in Formula (1).

$R_{52}$, $R_{53}$, $R_{52'}$ and $R_{53'}$ are more preferably tertiary alkyl groups such as t-butyl, t-pentyl, t-octyl and 1-methyl-cyclohexyl.

$R_{54}$ and $R_{54'}$ are each a hydrogen atom or a substituent, and the substituent includes groups similar to the substituents listed in the explanation of $R_{34}$.

Compounds represented by Formulas (YA) and (YB) include, for example, compounds (II-1)-(II-40) described in paragraphs "0032"-"0038" of JP-A 2002-169249, and compounds (ITS-1)-(ITS-12) described in paragraphs "0026" of European Patent No. 1,211,093.

In the following paragraphs, specific examples of bisphenol compounds represented by Formulas (YA) and (YB) will be described, however this invention is not limited thereto.

(YA-1)

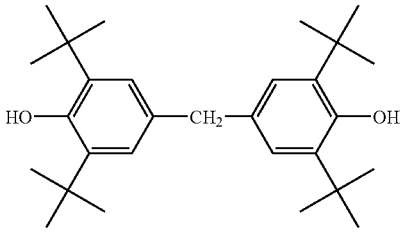

-continued (YA-2)

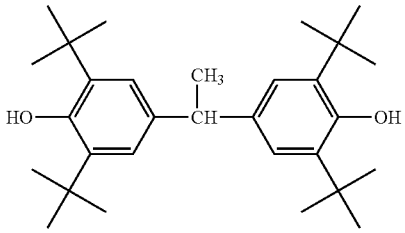

(YA-3)

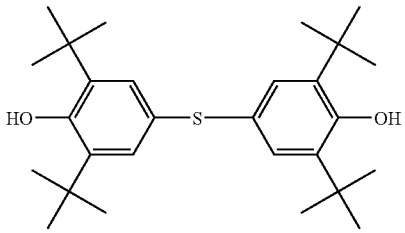

(YA-4)

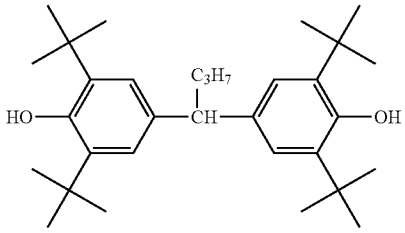

(YA-5)

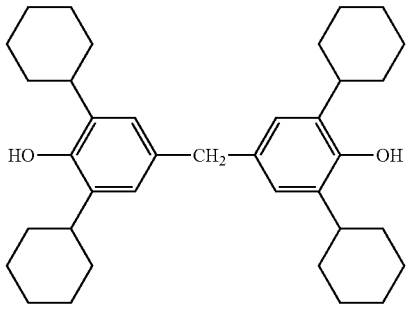

(YA-6)

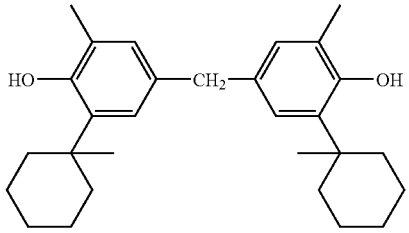

(YA-7)

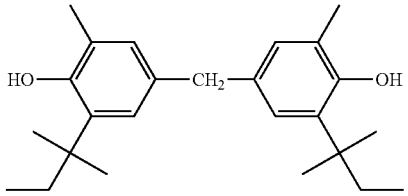

-continued (YA-8)

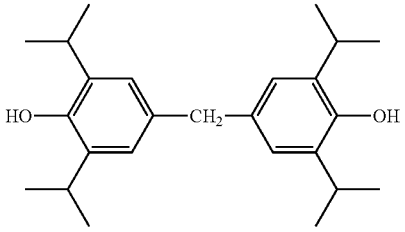

(YA-9)

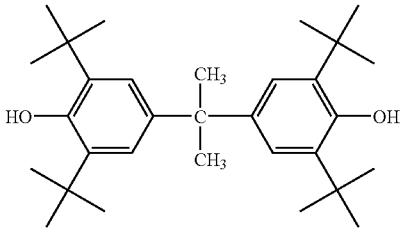

(YA-10)

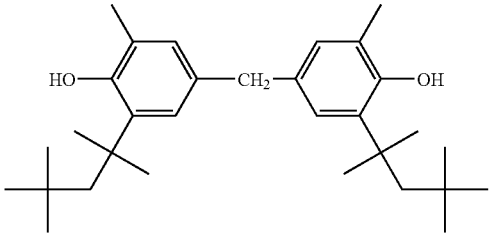

(YA-11)

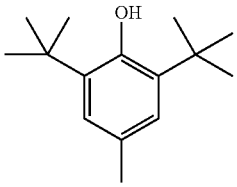

(YA-12)

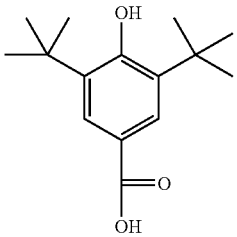

(YA-13)

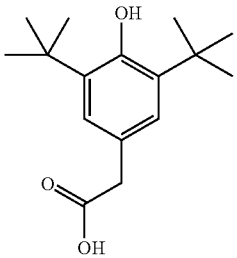

-continued (YA-14)

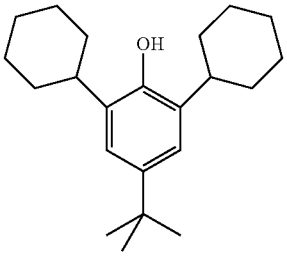

(YA-15)

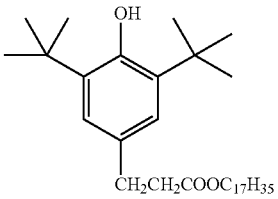

The added amount of a compound represented by Formula (YA) [including hindered phenol compounds represented by Formula (YB)] is generally 0.00001-0.01 mol per mol of silver, preferably 0.0005-0.01 mol but more preferably 0.001-0.008 mol.

Further, the addition ratio of a yellow coloring leuco dye to the total amount of reducing agents represented by foregoing Formulas (1) and (2) is preferably 0.001-0.2 but more preferably 0.005-0.1 based on mol ratio.

Cyan Coloring Leuco Dye

Next, a cyan coloring leuco dye, preferably utilized in this invention, will be explained. A leuco dye is preferably any compound which is colorless or only slightly colored and is oxidized to a colored state via at a temperature of about 80-200° C. for about 0.5-30 seconds, and any leuco dye, and any leuco dye which is oxidized by a silver ion to form a dye, may also be utilized. A compound which is provided with pH sensitivity and can be oxidized to a colored state, is useful.

Cyan coloring leuco dyes are preferably color image forming agents which increase absorbance at 600-700 nm via oxidation, and include compounds represented by Formulas (I)-(IV) described in JP-A Nos. 59-206831 and 5-204087 (specifically, compounds (1)-(18), described in paragraphs "0032"-"0.037"), and compounds represented by Formulas. 4-7 described in JP-A 11-231460 (specifically, compound Nos. 1-79, described in paragraph "0105").

In this invention, cyan coloring leuco dyes, which are specifically preferably utilized, are represented by following Formula (CL).

Formula (CL)

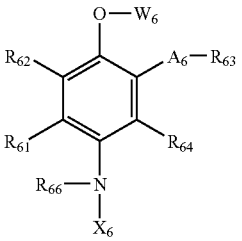

wherein, $R_{61}$ and $R_{62}$ are a hydrogen atom or a halogen atom, an alkyl group, an alkenyl group or a —$NHCOR_{60}$ group, $R_{60}$ is an alkyl group, an aryl group or a heterocyclic group, which may be substituted or unsubstituted; or groups which bond with each other to form an aliphatic hydrocarbon ring, an aromatic hydrocarbon ring or a heterocyclic ring. $A_6$ is an —NHCO— group, a —CONH— group or an —NHCONH— group, and $R_{63}$ is an alkyl group, an aryl group or a heterocyclic group, each of which may be substituted or unsubstituted. Further, -$A_6$-$R_{63}$ may be a hydrogen atom. $W_6$ is a hydrogen atom, or a —$CONHR_{65}$ group, a —$COR_{65}$ group or a —$COOR_{65}$ group ($R_{65}$ is an alkyl group, an aryl group or a heterocyclic group, which may be substituted or unsubstituted), and $R_{64}$ is a hydrogen atom, a halogen atom, or an alkyl group, an alkenyl group, an alkoxy group, a carbamoyl group or a nitrile group, each of which may be substituted or unsubstituted. $R_{66}$ is a —$CONHR_{67}$ group, a —$COR_{67}$ group or a —$COOR_{67}$ group ($R_{67}$ is an alkyl group, an aryl group or a heterocyclic group, which may be substituted or unsubstituted). $X_6$ is an aryl group or a heterocyclic group which may be substituted or unsubstituted.

In Formula (CL), halogen atoms represented by $R_{61}$ and $R_{62}$ include such as fluorine, bromine and chlorine, alkyl groups include alkyl groups having at most 20 carbon atoms (such as methyl, ethyl, butyl and dodecyl), alkenyl groups include alkenyl groups having at most 20 carbon atoms (such as vinyl, allyl, butenyl, hexenyl, hexadienyl, ethenyl-2-propenyl, 3-butenyl, 1-methyl-3-propenyl, 3-pentenyl and 1-methyl-3-butenyl), and alkoxy groups include alkoxy groups having at most 20 carbon atoms (such as methoxy and ethoxy). Further, alkyl groups represented by $R_{60}$ in an —$NHCOR_{60}$ group include alkyl groups having at most 20 carbon atoms (such as methyl, ethyl, butyl and dodecyl), aryl groups include groups having 6-20 carbon atoms such as phenyl and naphthyl, and heterocyclic groups include such as a thiophene group, a furan group, an imidazole group, a pyrazole group and a pyrrole group. Alkyl groups represented by $R_{63}$ are preferably alkyl groups having at most 20 carbon atoms and include such as methyl, ethyl, butyl and dodecyl; aryl groups are preferably aryl groups having 6-20 carbon atoms and include such as phenyl and naphthyl; and heterocyclic groups include such as thienyl, furyl, imidazolyl, pyrazolyl and pyrolyl. In a —$CONHR_{65}$ group, a —$COR_{65}$ group or a —$COOR_{65}$ group, which is represented by $W_6$, alkyl groups represented by $R_{65}$ are alkyl groups having at most 20 carbon atoms, and include such as methyl, ethyl, butyl and dodecyl; aryl groups are groups having 6-20 carbon atoms and include such as phenyl and naphthyl; and heterocyclic groups include such as thienyl, furyl, imidazolyl, pyrazolyl and pyrolyl.

Halogen atoms represented by $R_{64}$ include such as fluorine, chlorine, bromine and iodine; alkyl groups include chain or cyclic alkyl groups such as methyl, butyl, dodecyl and cyclohexyl; alkenyl groups include alkenyl groups having a carbon number of not more than 20 (such as vinyl, allyl, butenyl, hexenyl, hexadienyl, ethenyl-2-propenyl, 3-butenyl, 1-methyl-3-propenyl, 3-pentenyl and 1-methyl-3-butenyl); alkoxy groups include such as methoxy, butoxy and tetradecyloxy; and carbamoyl groups include such as diethylcarbamoyl and phenylcarbamoyl. Further, a nitrile group is also preferable, of which more preferable are a hydrogen atom and an alkyl group. Foregoing $R_{63}$ and $R_{64}$ may bond with each other to form a ring structure.

The above groups may be provided with a single substituent or a plural number of substituents. Typical substituents include halogen atoms (such as fluorine, chlorine and bromine), alkyl groups (such as methyl, ethyl, propyl, butyl and dodecyl), a hydroxyl group, a cyano group, a nitro group, alkoxy groups (such as methoxy and ethoxy), an alkylsulfonamido groups (such as methylsulfonamido and octylsulfonamido), arylsulfonamido groups (such as phenylsulfonamido and naphthylsulfonamido), alkylsulfamoyl groups (such as butylsulfamoyl), arylsulfamoyl groups (such as phenylsulfamoyl), alkyloxycarbonyl groups (such as methoxycarbonyl), aryloxycarbonyl groups (such as phenyloxycarbonyl), an aminosulfoneamido group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group or an aminocarbonyl group.

$R_{60}$ or $R_{65}$ is preferably a phenyl group but more preferably a phenyl group provided with a plural number of halogen atoms, while cyano groups as substituents.

In a —$CONHR_{67}$ group, a —$COR_{67}$ group and a —$COOR_{67}$ group, which is represented by $R_{66}$, alkyl groups represented by $R_{67}$ are preferably alkyl groups having at most 20 carbon atoms, and include such as methyl, ethyl, butyl and dodecyl; aryl groups are preferably aryl groups having 6-20 carbon atoms and include such as phenyl and naphthyl; and heterocyclic groups include such as thienyl, furyl, imidazolyl, pyrazolyl and pyrrolyl.

As substituents, with which the group represented by $R_{67}$ can be provided, employed may be substituents similar to those listed above in the explanation for $R_{61}$-$R_{64}$ in Formula (CL).

Aryl groups represented by $X_6$ include aryl groups having 6-20 carbon atoms, such as phenyl and naphthyl, and heterocyclic groups include such as thienyl, furyl, imidazolyl, pyrazolyl and pyrrolyl.

Groups represented by $X_6$ may incorporate substituents, which include ones similar to those listed above in the explanations for $R_{61}$-$R_{64}$ in Formula (CL). Groups represented by $X_6$ are preferably aryl groups or heterocyclic groups which are provided with an alkylamino group (such as a diethylamino group) at the para-position.

These groups may contain a photographically functional group.

In the following paragraphs, specific examples of cyan coloring leuco dyes (LC) will be discussed, however, cyan coloring leuco dyes employable in this invention are not limited thereto.

(CA-1)

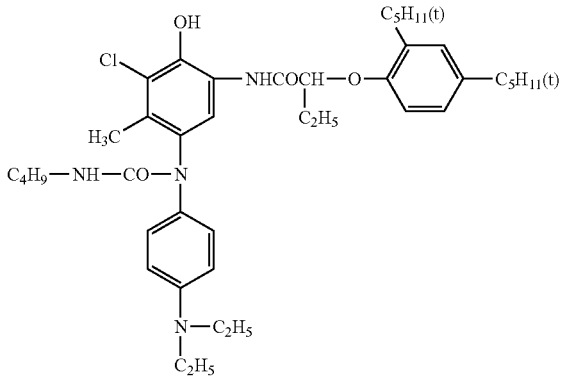

-continued
(CA-2)
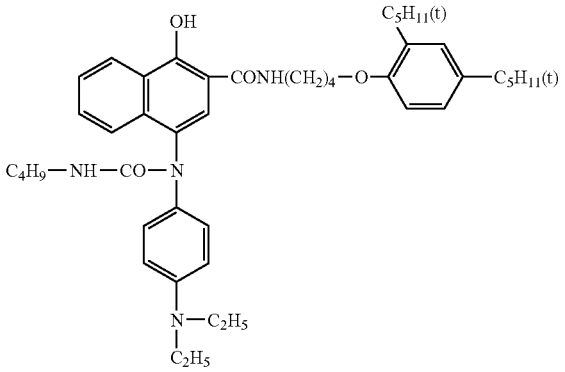
(CA-3)
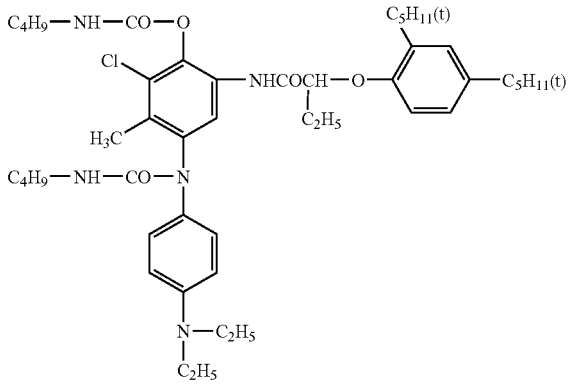
(CA-4)
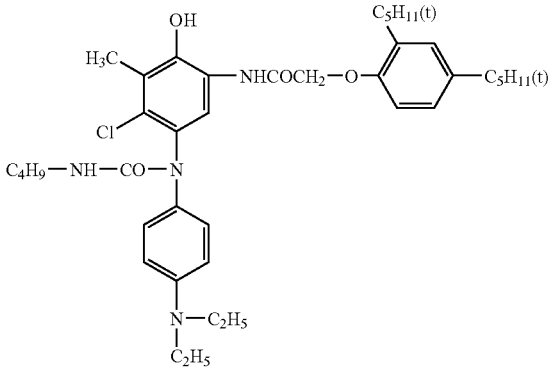
(CA-5)
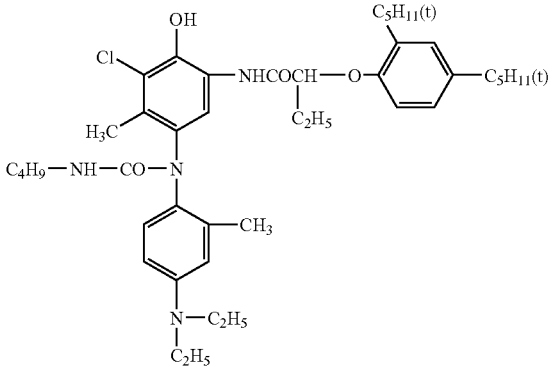
-continued
(CA-6)
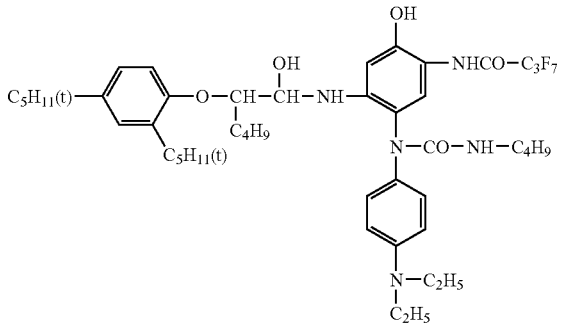
(CA-7)
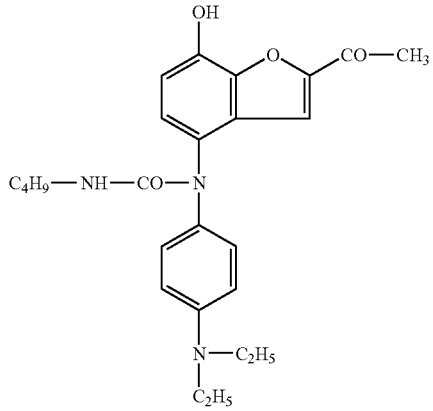
(CA-8)
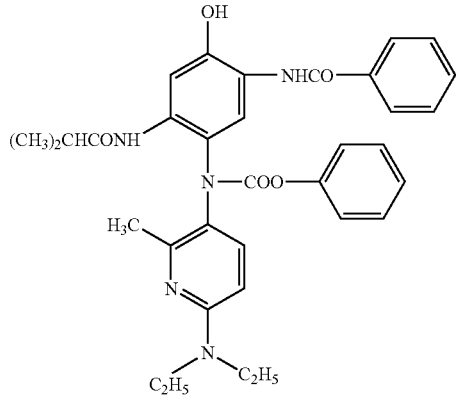
(CA-9)
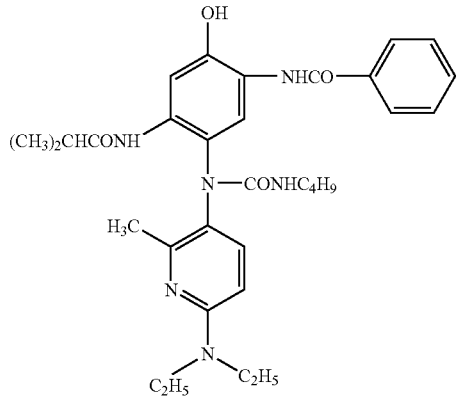

-continued (CA-10)

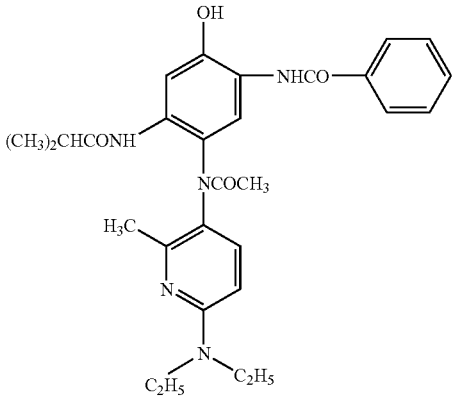

(CA-11)

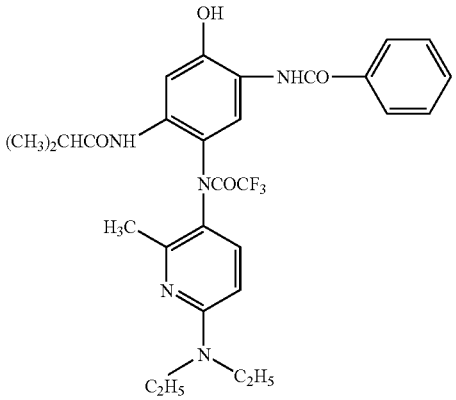

(CA-12)

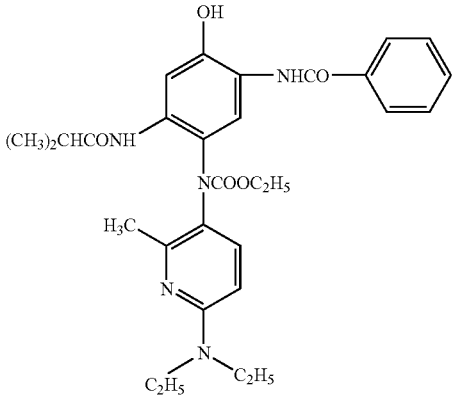

The added amount of a cyan coloring leuco dye is generally 0.00001-0.05 mol per mol of silver, preferably 0.0005-0.02 mol but more preferably 0.001-0.01 mol.

The addition ratio of a cyan coloring leuco dye to the total amount of reducing agents represented by foregoing Formulas (1) and (2) is preferably 0.001-0.2 but more preferably 0.005-0.1 based on mol ratio. Further, the total of the maximum densities at a maximum absorption wavelength of a dye image formed by a cyan leuco dye is preferably 0.01-0.50, more preferably 0.02-0.30 but still more preferably 0.03-0.10.

It is possible to further control delicate tone by incorporating in combination a magenta coloring leuco dye or a yellow coloring leuco dye in addition to the above-described cyan coloring leuco dye.

Compounds represented by Formulas (YA) and (YB) and cyan coloring leuco dyes may be added in a manner similar to the addition method of a reducing agent represented by Formula (1), and may be incorporated in a coating composition by any appropriate method such as a solution form, an emulsified dispersion form or solid micro-particle dispersion form.

Compounds represented by Formelas (1) and (2), Formulas (YA) and (YB), and a cyan coloring leuco dye are preferably added in an image forming layer which contains organic silver; however, one is preferably contained in an image forming layer, which contains organic silver salt, and the other may be added in a non-image forming layer; or both may be added in a non-image forming layer. Further, when an image forming layer is comprised of plural layers, each may be incorporated in the different layer.

Binder

A binder suitable for a thermally developable material is transparent or translucent and generally colorless, and includes natural polymers, synthetic resin, polymers and oligomers, or other compounds to form a film such as described in paragraph "0069" of JP-A 2001-330918. Of these, polymer latex is preferable in a photosensitive layer of a thermally developable material of this invention, of which latex of styrene-butadiene copolymer is specifically preferable, which will be detailed later.

Further, for photo-insensitive layers such as an overcoating layer and an undercoating layer, and in particular, such as a protective layer and a backcoating layer, preferable are cellulose esters having a high softening point, but specifically preferable are polymers such as triacetyl cellulose (TAC) and cellulose acetate butyrate. Herein, the above-described binders may be appropriately employed in combination of at least two types.

It is preferable to employ a binder in which at least one polar group selected from such as —COOM, —$SO_3M$, —$OSO_3M$, ——P═O$(OM)_2$, —O—P═O$(OM)_2$, —N$(R)_2$, —$N^+(R)_3$ (where M is a hydrogen atom or an alkali metal base, and R is a hydrocarbon group), an epoxy group, a mercapto group and a cyano group is introduced by copolymerization or an addition reaction, of which specifically preferably are —$SO_3M$ and —$OSO_3M$. The amount of such a polar group is $1\times10^{-1}$-$1\times10^{-8}$ mol/g but preferably $1\times10^{-2}$-$1\times10^{-6}$ mol/g.

Such binders are employed in the effective range to function as a binder. The effective range is readily supplied by the manufacturer in the corresponding field. For example, as an index, in the case of holding organic silver salt in an image forming layer, the ratio of the binder to organic silver salt is preferably 15/1-1/2 (weight ratio) but specifically preferably 8/1-1/1. That is, the amount of binder in the image forming layer is preferably 1.5-6 g/$m^2$ and more preferably 1.7-5 g/$m^2$. When it is less than 1.5 g/$m^2$, density in unexposed areas may be significantly increased, resulting in unusable material.

The glass transition temperature (Tg) of the binder employed in this invention is preferably 0-80° C. Employing a binder of a Tg in this range, is preferable because sufficient maximum density can be obtained during image formation. This Tg can be determined by measurement via a differential scanning calorimeter, and the crossing point of a base line and a tangent of an endothermal peak is designated as the Tg. Tg in this invention is determined via a method described in "Polymer Hand Book", edited by Brandrupp et al, III, pp. 139-179 (1996, published by Wiley & Sons).

In the case of the binder being a copolymer resin, Tg is determined based on the following equation.

$$Tg(\text{copolymer})(^\circ\text{ C.})=v_1Tg_1+v_2Tg_2+\ldots+v_nTg_n$$

wherein, $v_1$, $v_2$, . . . , $v_n$ represent weight fractions of monomers in the copolymer, each of $Tg_1$, $Tg_2$, . . . $Tg_n$ represents a Tg (° C.) of a homopolymer obtained from each monomer in the copolymer. The accuracy of a Tg calculated based on the above equation is ±5° C.

As polyurethane resins usable in this invention, those commonly comprising a structure of such as polyester polyurethane, polyether polyurethane, polyetherpolyester polyurethane, polycarbonate polyurethane, polyesterpolycarbonate polyurethane and polycaprolactone polyurethane may be utilized. Further, preferably provided at the ends of polyurethane molecules of at least each one, is a total of at least two hydroxyl groups. Since hydroxyl groups form a three dimensional structure by cross-linking with polyisocyanate as a hardener, it is preferable the more hydroxyl groups are contained in the molecule. In particular, it is preferred that a hydroxyl group exists at the molecule ends since reactivity with a hardener is high. Polyurethane is provided with preferably at least 3 hydroxyl groups at the molecule ends and specifically preferably at least 4 hydroxyl groups. In this invention, when polyurethane is utilized, a Tg of 70-105° C., a breaking elongation of 100-2000% and a breaking stress of 0.5-100 N/mm$^2$ are preferable.

These polymer compounds (polymer) may be employed singly or in combination by blending of at least two types.

In an image forming layer of this invention, the above polymer is preferably utilized as a primary binder. "A primary binder" as referred to here means "a state of the above described binder occupying not less than 50 weight % of the total binder". Therefore, other polymers may be blended within a range of less than 50 weight %. These polymers to be blended are not limited, provided they are soluble in a solvent which can dissolve a polymer of this invention. More preferably, listed are such polymers as polyvinyl acetate, polyacryl resin and urethane resin.

An organic gelatinizing agent may be contained in an image forming layer. Herein, "an organic gelatinizing agent" refers to a compound which functions to negate or minimize the fluidity of the system by being added into an organic liquid to provide the system with a yield value, similar to such as polyhydric alcohols.

In this invention, it is a preferred embodiment to contain water-based dispersed polymer latex in an image forming layer coating composition. In this case, a water-based dispersion preferably occupies not less than 50 weight %, but more preferably not less than 70 weight %, of the total binder in an image forming layer coating composition.

Polymer latex is a water-insoluble hydrophobic polymer dispersed in a water-soluble dispersion medium of such as micro-particles. The dispersed state may be any of the polymers emulsified in a dispersion medium, emulsion polymerized, micellarly dispersed, or the polymer molecule may be provided with a hydrophilic structure to enable the molecular chain itself being molecularly dispersed. The mean particle diameter of dispersed particles is preferably in a range of about 1-50,000 nm but more preferably 5-1,000 nm. The particle diameter distribution of dispersed particles is not specifically limited, and either those having a wide particle diameter distribution or those having a monodispersed particle distribution is applicable.

As polymer latex employed in this invention, polymer latex of a so-called core/shell type may be employed in addition to general polymer latex having a uniform structure. In this case, it may be preferable to have differing Tg between the core and the shell. The minimum film forming temperature of polymer latex of this invention is preferably approximately −30 to 90° C. but more preferably 0 to 70° C. Further, to control the minimum film forming temperature, an aid for film formation may be added. This aid for film formation is also called a plastisizer, which is an organic compound to lower the minimum film forming temperature of polymer latex, and is described in, for example, "Chemistry of Synthetic Latexes" (by Soichi Muroi, published by Polymer Publishing Association, 1970).

Polymers employed for polymer latexes include such as acryl resin, vinyl acetate resin, polyester resin, polyurethane resin, rubber type resin, vinyl chloride resin, vinylidene chloride resin, polyolefin resin and copolymers thereof. Polymer may be either a straight chain, a branched chain or a cross-linked polymer. Further, the polymer may be either a homopolymer in which a single monomer has been polymerized or a copolymer in which at least two types of monomers have been polymerized. In the case of a copolymer, either a random copolymer or a block copolymer may be utilized. The molecular weight of polymer is generally as a number average molecular weight about 5,000-1,000,000 but preferably 10,000-100,000. The dynamic strength of a photosensitive layer becomes insufficient when the molecular weight is too low, while the film forming property deteriorats when the molecular weight is too large, neither case being preferable.

The polymer latex is provided with an equilibrium water content of preferably 0.01-2 weight % but more preferably 0.01-1 weight %. One definition and measurement method of the equilibrium water content can be referred to, for example, in "Polymer Technology Course 14, Polymer Material Test Methods (edited by The Society of Polymer Science, published by Chijinshokan Co., Ltd.)".

Specific examples of polymer latex include each latex described in paragraph "0173" of JP-A 2002-287299, which may be utilized alone or in combination of at least two types. The preferred polymer type of polymer latex is that containing a carboxylic acid component such as an acrylate or methacrylate component of approximately 0.1-10 weight %. Further, a hydrophilic polymer such as gelatin, polyvinyl alcohol, methyl cellulose, hydroxypropyl cellulose, carboxymethyl cellulose or hydroxypropylmethyl cellulose may be appropriately added at a range of not more than 50 weight % compared to the total binder. The addition amount of these hydrophilic polymers is preferably not more than 30 weight % compared to the total binder in the foregoing photosensitive layer.

In preparation of an image forming layer coating composition, with respect to the addition order of organic silver salt and water-base dispersed polymer latex, either they may be added first or both may be simultaneously added, however, the polymer latex is preferably added later. Further, organic silver salt and a reducing agent are generally mixed before addition of polymer latex. Further, since there is a problem of deterioration of the coated surface state when the temperature, at which the coating composition is temporarily stored after mixing an organic silver salt and polymer latex, is too low, while fogging increases when the temperature is too high, thus the coating composition after mixing is preferably kept at 30-65° C. for the abovestated time, while it is more preferably kept at 35-60° C. but most preferably at 35-55° C. To maintain such temperatures, the preparation vessel holding the coating composition may be heated.

For coating an image forming layer coating composition, after an organic silver salt and water-base dispersed polymer latex having been mixed, it is preferably utilized before an elapse of 0.5-24 hours, more preferably for 1.0-12 hours but specifically preferably for 2.0-10 hours. Herein, "after having been mixed" means that after an organic silver salt and water-base dispersed polymer latex were added in to the system and the added raw materials had been uniformly dispersed.

Cross-Linking Agent

It is generally known in the art that film adhesion is improved and uneven development is decreased by employing a cross-linking agent compared to the above-described binder, however, other desirable effects are depressing fogging during storage and depressing generation of printout silver after development.

Employable cross-linking agents include various cross-linking agents conventionally employed for photographic materials, such as an aldehyde type, an epoxy type, an ethyleneimine type, a vinylsulfon type, a sulfonic acid ester type, an acryloyl type, a carbodiimide type or silane compound type cross-linking agents, which are described in JP-A 50-69216, however preferable are an isocyanate type, a silane compound type, epoxy compounds and acid anhydrides.

Isocyanate type cross-linking agents are isocyanates provided with at least two isocyanate groups and adducts thereof, more specifically aliphatic diisocyanates and aliphatic diisocyanates provided with a cyclic group, which include benzene diisocyanates, naphthalene didisocyanates, biphenyl isocyanates, diphenylmethane diisocyanates, triphenylmethane diisocyanates, triisocyanates, tetraisocyanates, adducts of these isocyanates, and adducts of these isoyanates with secondary or tertiary polyhydric alcohols. As specific examples, isocyanate compounds described on pp. 10-12 of JP-A 56-5535 may be utilized. Herein, adducts of isocyanate with polyhydric alcohol are provided with a high tendency of prevention of layer peeling, image slippage and random bubbles. Such cross-linking agents may be incorporated in any portion of the thermally developable material. For example, the cross-linking agent may be added in a support (specifically, in the case of a paper support, it may be contained in the sizing composition), or in any layer on the photosensitive layer side of a support such as a photosensitive layer, a surface protective layer, an intermediate layer and an undercoating layer, and further may be added in one or more of these layers.

Further, as an isocyanate type cross-linking agent applicable in this invention, compounds provided with thioisocyanate structures corresponding to the above isocyanates are also beneficial. Isocyanate compounds and thioisocyanate compounds are preferably compounds which function as the above cross-linking agent, however, preferable results may be obtained even by compounds provided with only one of the functional groups.

The used amount of the above cross-linking agent is generally 0.001-2 mol per mol of silver, but preferably 0.005-0.5 mol.

Examples of silane compounds include compounds represented by Formulas (1)-(3) disclosed in JP-A 2001-264930.

Further, an epoxy compound employable as a cross-linking agent is one provided with at least one epoxy group, of which there is no limitation with respect to the number of epoxy groups, molecular weight and other factors. The epoxy group is preferably contained in the molecule as a glycidyl group via an ether or imino bond. Further, epoxy compounds may be any of such as a monomer, an oligomer or a polymer, the number of epoxy groups existing in a molecule is generally approximately 1-10 but preferably 2-4. In the case of an epoxy compound being a polymer, either a homopolymer or a copolymer may be employed, and the mean number average molecular weight Mn is specifically preferably in the range of approximately 2,000-20,000.

An acid anhydride is a compound provided with at least one acid anhydride group represented by the following structural formula. There is no theoretical limitation with respect to the number of acid anhydride groups, the molecular weight and other factors, provided that at least one such acid anhydride group exist.

—CO—O—CO—

The above-described epoxy compounds and acid anhydrides may be employed singly or in combination of at least two types. The added amount is not specifically limited, however, it is preferably in the range of $1\times10^{6}$-$1\times10^{-2}$ mol/m$^2$ but more preferably $1\times10^{5}$-$1\times10^{3}$ mol/m$^2$. These epoxy compounds and acid anhydrides may be incorporated in any layer on the photosensitive layer side of a support such as a photosensitive layer, a surface protective layer, an intermediate layer, an anti-halation layer or an undercoating layer, and may be added to one or more of these layers.

Development Accelerator

A development accelerator employed in this invention refers to a compound which reduces the required amount of silver to obtain a predetermined silver image density. Various mechanisms of this reducing function may be considered, however, a compound provided with a function to improve covering power of developed silver is preferred. Herein, "covering power" of developed silver refers to the optical density per unit amount of silver. This development accelerator can be incorporated in a photosensitive layer, a photo-insensitive layer or in both of these layers. Preferable examples of development accelerators include hydrazine derivative compounds, vinyl compounds, phenol derivatives, naphthol derivatives, quaternary onium compounds and silane compounds.

Specific examples of hydrazine compounds include such as compounds H-1-H-29 described in columns 11-20 of U.S. Pat. No. 5,545,505, compounds 1-12 described in columns 9-11 of U.S. Pat. No. 5,464,738, compounds H-1-1-H-1-28, H-2-1-H-2-9, H-3-1-H-3-12, H-4-1-H-4-21 and H-5-1-H-5-5 described in paragraphs "0042"-"0052" of JP-A 2001-27790.

Specific examples of vinyl compounds include such as compounds CN-01-CN-13 described in columns 13-14 of U.S. Pat. No. 5,545,515, compounds HET-01-HET-02 described in column 10 of U.S. Pat. No. 5,635,339, compounds MA-01-MA-07 described in columns 9-10 of U.S. Pat. No. 5,654,130, compounds IS-01-IS-04 described in columns 9-10 of U.S. Pat. No. 5,705,324, compounds 1-1-218-2 described in paragraphs "0043"-"0088" of JP-A 2001-125224.

Specific examples of phenol derivatives and naphthol derivatives include compounds A-1-A-89 described in paragraphs "0075"-"0078" of JP-A 2000-267222, and compounds A-1-A-258 described in paragraphs "0025"-"0045" of JP-A 2003-66558.

Specific examples of quaternary onium compounds include triphenyl tetrazolium.

Specific examples of silane compounds include alkoxy silane compounds or salts thereof, which are provided with at least two primary or secondary amino groups, such as compounds A1-A-33 described in paragraphs "0027"-"0029" of JP-A 2003-5324.

The added amount of the above silver saving agent is in the range of $1\times10^{-5}$-1 mol per mol of organic silver salt, but preferably $1\times10^{-4}$-$1\times10^{-1}$ mol.

Specifically preferable development accelerators of this invention are compounds represented by Formulas (A-1) and (A-2) of (item 2).

In Formula (A-1), an aromatic group or a heterocyclic group represented by $Q_1$ is preferably a 5-7 membered unsaturated ring. Preferable examples include each ring of benzene, pyridine, pyrazine, pyrimidine, pyridazine, 1,2,4-triazine, 1,3,5-triazine, pyrrole, imidazole, pyrazole, 1,2,3-triazole, 1,2,4-triazole, tetrazole, 1,3,4-thiazole, 1,2,4-thiazole, 1,2,5-thiazole, 1,3,4-oxathiazole, 1,2,4-oxathiazole, 1,2,5-oxathiazole, thiazole, oxazole, isothiazole, isooxazole and thiophene; and further preferable are condensed rings in which these rings are condensed with each other.

These rings may be provided with a substituent and, in the case of having at least two substituents, the substituents may be either identical or different. Examples of the substituents include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group and an acyl group. When these substituents are capable of being substituted, they may be further provided with a substituent, examples of which include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, an cyano group, a sulfamoyl group, an alkylsulfonyl group, an arylsulfonyl group and an acyloxy group.

A carbamoyl group represented by $Q_2$ is one having preferably 1-50 carbon atoms but more preferably 6-40, and include such as unsubstituted carbamoyl, methylcarbamoyl, ethylcarbamoyl, propylcarbamoyl, sec-butylcarbamoyl, octylcarbamoyl, cyclohexylcarbamoyl, t-butylcarbamoyl, dodecylcarbamoyl, (3-dodecyloxypropyl)carbamoyl, octadecylcarbamoyl, {3-(2,4-di-t-pentylphenoxy)propyl}carbamoyl, (2-hexyldecyl)carbamoyl, N-phenylcarbamoyl, (4-dodecyloxyphenyl)carbamoyl, (2-chloro-5 dodecyloxycarbonylphenyl)carbamoyl, naphthylcarbamoyl, 3-pyridylcarbamoyl and benzylcarbamoyl.

An acyl group represented by $Q_2$ is one having preferably 1-50 carbon atoms but more preferably 6-40, and include such as formyl, acetyl, 2-methylpropanoyl, cyclohexylcarbonyl, octanoyl, 2-hexyldecanoyl, dodecanoyl, chloroacetyl, trifluoroactyl, benzoyl, 4-dodecyloxy benzoyl and 2-hydroxymethyl benzoyl.

An alkoxycarbonyl group represented by $Q_2$ is one having preferably 2-50 carbon atoms but more preferably 6-40, and include such as methoxycarbonyl, ethoxycarbonyl, i-butyloxycarbonyl, cyclohexyloxycarbonyl, dodecyloxycarbonyl and benzyloxycarbonyl. An aryloxycarbonyl group represented by $Q_2$ is one having preferably 7-50 carbon atoms but more preferably 7-40, and include such as phenoxycarbonyl, 4-octyloxyphenoxycarbonyl, 2-hydroxymethylphenoxycarbonyl and 4-dodecyloxyphenoxycarbonyl.

A sulfonyl group represented by $Q_2$ is one having a carbon number of preferably 1-50 but more preferably 6-40, and include such as methylsulfonyl, butylsulfonyl, octylsulfonyl, 2-hexadecylsulfonyl, 3-dodecyloxypropylsulfonyl, 2-octyloxy-5-t-octylphenylsulfonyl and 4-dodecyloxyphenylsulfonyl.

A sulfamoyl group represented by $Q_2$ is one having preferably 0-50 carbon atoms but more preferably 6-40, and include such as unsubstituted sulfamoyl, ethylsulfamoyl, (2-ethylhexyl)sulfamoyl, decylsulfamoyl, hexadecylsulfamoyl, 3-(2-ethylhexyloxy)propylsulfamoyl, 2-chloro-(5-dodecyloxycarbonylphenyl)sulfamoyl and (2-tetradecyloxyphenyl)sulfamoyl.

Groups represented by $Q_2$ may be provided with a group which was listed above as an example of substituents for the foregoing 5-7-membered unsaturated rings represented by $Q_1$ at a substitutable position, and, in the case when at least two substituents are provided, the substituents may be identical or differ from each other.

Next, the preferable range of compounds represented by formula (A-1) will be described.

$Q_1$ is preferably a 5-6-membered unsaturated ring, but more preferably a ring of benzene, pyrimidine, 1,2,3-triazole, 1,2,4-triazole, tetrazole, 1,3,4-thiazole, 1,2,4-thiazole, 1,3,4-oxazole, 1,2,4-oxadiazole, thiazole, oxazole, isothiazole and isooxazole, and rings, in which these rings are condensed with a benzene ring or an unsaturated heterocyclic ring, are more preferable.

Further, $Q_2$ is preferably a carbamoyl group but specifically preferably a carbamoyl group provided with a hydrogen atom bound the nitrogen atom.

In Formula (A-2), $R_1$ is preferably an alkyl group of 1-20 carbon atoms (such as methl, ethyl, i-propyl, butyl, t-octyl and cyclohexyl), an acylamino group (such as acetylamino, benzoylamino, methylureido and 4-cyanophenylureido) and a carbamoyl group (such as butylcarbamoyl, diethylcarbonyl, phenylcarbamoyl, 2-chlorophenylcarbamoyl and 2,4-dichlorophenylcarbamoyl), of which more preferably is an acyl amino group (including an ureido group and a urethane group).

$R_2$ is preferably a halogen atom (but more preferably a chlorine atom or a bromine atom), an alkoxy group (such as methoxy, butoxy, hexyloxy, decyloxy, cyclohexyloxy and benzyloxy) or an aryloxy group (such as phenoxy and naphthoxy).

$R_3$ is preferably a hydrogen atom, a halogen atom or an alkyl group of 1-20 carbon atom but most preferably a halogen atom.

$R_4$ is preferably a hydrogen atom, an alkyl group or an acylamino group, but preferably an alkyl group or an acylamino group. Examples of which preferable groups are identical to $R_1$. In the case of $R_4$ being an acylamino group, $R_4$ also preferably forms a carbostyryl ring by connecting with $R_3$.

In Formula (A-2), when $R_3$ and $R_4$ connect to each other to form a condensed ring, the condensed ring is preferably a naphthalene ring, which may be provided with a substituent identical to substituent examples listed in Formula (A-1). When Formula (A-2) is a naphthol type compound, $R_1$ is preferably a carbamoyl group, of which, a benzoyl group is specifically preferable. $R_2$ is preferably an alkoxy group or an aryloxy group, but specifically preferably an alkoxy group.

In the following paragraphs, specific examples of preferable development accelerators of this invention will be listed, however, this invention is not limited thereto.

(A-1)
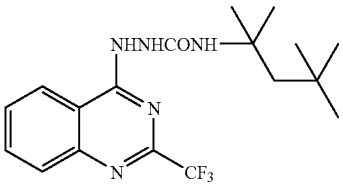
(A-2)
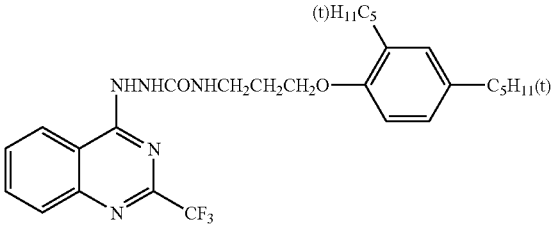
(A-3)
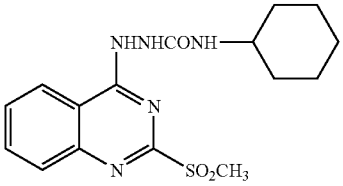
(A-4)
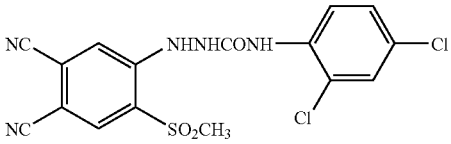
(A-5)
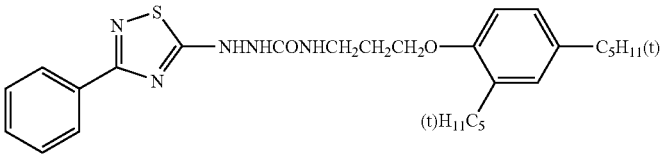
(A-6)
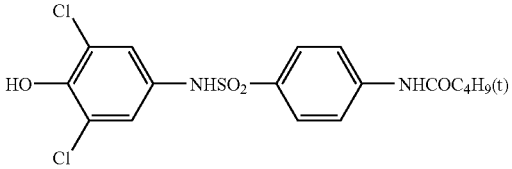
(A-7)
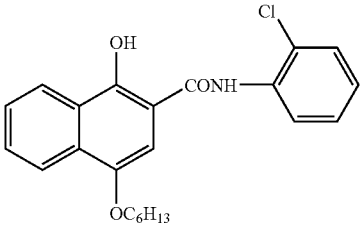
(A-8)
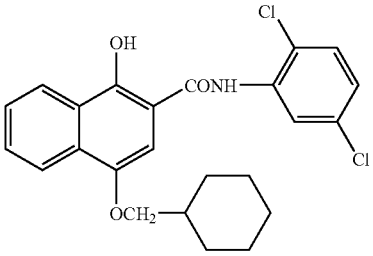

-continued (A-9)

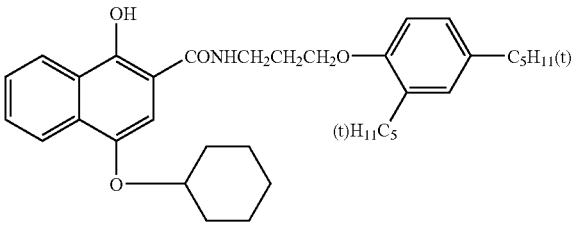

(A-10)

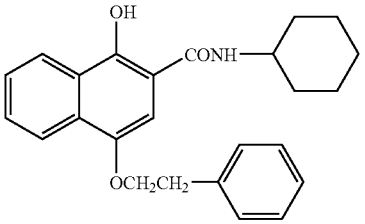

(A-11)

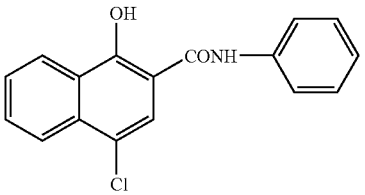

(A-12)

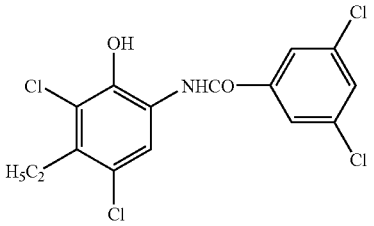

Antifoggant and Image Stabilizer

An antifoggant and an image stabilizer employed in the photothermographic material of this invention will now be described. Since primarily utilized as a reducing agent of this invention, a reducing agent provided with a proton, such as bisphenols and sulfonamidephenols, it is preferable to incorporate a compound which can inactivate a reducing agent by generating an active species capable of extracting hydrogen. Suitably, a colorless photooxidative substance is preferably a compound which can generate a free radical as a reactive species at the time of exposure.

Thus, any compound is applicable if it provides these functions, however, an organic free radical comprising plural atoms is preferred. A compound of any structure provided having such a function and not causing significant deterrents to a thermally developable material can be employed.

Further, these free radical generating compounds are preferably those incorporating a homocyclic or heterocyclic aromatic group, to provide a generating radical with enough stability as to enable the radical to contact with a reducing agent for sufficient time to inactivate the reducing agent. Typical examples of these compounds include biimidazolyl compounds and iodonium compounds.

The added amount of the imidazolyl compound or iodonium compound is in the range of 0.001-0.1 mol/$m^2$ and preferably 0.005-0.05 mol/$m^2$. Herein, in the photothermographic material of this invention, the compound may be incorporated in any constituent layer, however, it is preferably incorporated close to a reducing agent.

Further, as an antifoggant and an image stabilizer, many compounds, which can release a halogen atom as an active species, are known. Specific examples of these compounds, which can release an active halogen, include compounds of Formula (9) described in paragraphs "0264"-"0271" of JP-A 2002-287299.

The added amount of these compounds is preferably in the range which essentially causes no problem of increasing printout silver due to generation of silver halide, of not more than 150% but more preferably not more than 100%, based on a ratio compared to a compound not producing an active halogen radical. Specific examples of these compounds producing an active halogen atom include compounds (III-1)-(III-23) described in paragraphs "0086"-"0087" of JP-A 2002-169249, compounds 1-1a-1-1o and 1-2a-1-2o described in paragraphs "0031"-"0034", and compounds 2a 2z, 2aa-211 and $_2$-1a-2-1f described in paragraphs "0050"-"0056", of JP-A 2003-50441, and compounds 4-1-4-32 described in paragraphs "0055"-"0058", and compounds 5-1-5-10 described in paragraphs "0069"-"0072", of JP-A 2003-91054.

Antifoggants preferably utilized in this invention include, for example, example compounds a-j described in paragraph "0012" of JP-A 8-314059, thiosulfonate esters A-K described in paragraph "0028" of JP-A 7-209797, example compounds (1)-(44) described on p. 14 of JP-A 55-140833, compounds (I-1)-(I-6) described in paragraph "0063" and compounds (C-1)-(C-3) described in paragraph "0066" of JP-A 2001-13627, compounds (C-1)-(C-3) described in paragraph "0066" of JP-A 2001-13627, compounds (III-1)-(III-108) described in paragraph "0027" of JP-A 2002-90937, compounds VS-1-VS-7 and compounds HS-1-HS-5 described in paragraph "0013" of JP-A 6-208192 as vinylsulfones and/or β-halosulfones, compounds KS-1-KS-8 described in JP-A 2000-330235 as sulfonylbenzotriazole compounds, compounds PR-01-PR-08 described in Japanese Translation of PCT International Application Publication No. 2000-515995 as substituted propenenitrile compounds, and compounds (1)-1-(1)-132 described in paragraphs "0042"-"0051" of JP-A 2002-207273.

An antifoggant is added in a range of at least 0.001 mol per mol of silver, generally 0.01-5 mol but preferably 0.02-0.6 mol.

Herein, in addition to the above compound, compounds conventionally known as antifoggants may be incorporated in the photothermographic material of this invention, and the antifoggant may be either a compound, which generates a reactive species similar to the above compounds, or a compound of a different antifogging mechanism. For example, listed are compounds described in U.S. Pat. Nos. 3,589,903, 4,546,075 and 4,452,885, and JP-A 59-57234; U.S. Pat. Nos. 3,874,946, and 4,756,999, and JP-A Nos. 9-288328 and 9-90550. Further, in addition to these antifoggants, listed are compounds disclosed in U.S. Pat. No. 5,028,523, and European Patent Nos. 600,587, 605,981 and 631,176.

In the case of the reducing agent employed in this invention being provided with an aromatic hydroxyl group (—OH), especially in the case of bisphenols, it is preferable to employ in combination a non-reducing compound, having a group capable of forming a hydrogen bond with these groups.

Specific examples of hydrogen bonding compounds in this invention include, for example, compounds (II-1)-(II-40) described in paragraphs "0061"-"0064" of JP-A 2002-90937.

Tone Modifier

The photothermographic material of this invention forms a photographic image via thermal development, and preferably contains a tone modifier generally dispersed in an (organic) binder matrix which appropriately controls the silver tone. Examples of utilized suitable tone modifiers are disclosed in RD No. 17029, U.S. Pat. Nos. 4,123,282, 3,994,732, 3,846,136 and 4,021,249 and include the following.

Listed are imides (such as succinimide, phthalimide, naphthalimide and N-hydroxy-1,8-naphthalimide); mercaptans (being such as 3-mercapto-1,2,4-triazole); phthalazinone derivatives or metal salts thereof (such as phthalazinone, 4-(1-naphthyl)phthalazinone, 6-chlorophthalazinone, 5,7-dimethyloxyphthalazinone and 2,3-dihydro-1,4-phthalazinone); combinations of phthalazine and phthalic acids (such as phthalic acid, 4-methylphthalic acid, 4-nitrophthalic acid and tetrachlorophthalic acid); combinations of phthalazine and at least one compound selected from maleic acid anhydride; and phthalic acid, 2,3-naphthalenedicarboxylic acid or o-phenylenic acid derivatives and anhydrides thereof (such as phthalic acid, 4-methylphthalic acid, 4-nitrophthalic acid and tetrachlorophthalic acid). Specifically preferable tone modifiers are combinations of phthalazinone or phthalazine, and phthalic acids or phthalic acid anhydrides.

Fulorine-Containing Surfactant

In the photothermographic material of this invention, preferably employed is a fluorine-containing compound provided with, at least one fluoroalkyl group of not less than two carbon atoms nor more than 13 fluorine atoms, and either an anionic or a nonionic hydrophilic group. It is possible to minimize defects of a photosensitive material due to dust and adhesive materials, which exist in a large number specifically near the manufacturing floor, by employing these specific fluorine-containing compounds. The fluorine-containing compound may be of any appropriate structure provided that it incorporates either a hydrophilic group or a nonionic hydrophilic group.

The fluoroalkyl group is typically provided with at most 13 fluorine atoms, preferably 3-12 but more preferably in the range of 5-9. Further, the carbon atom number of this fluoroalkyl group is at least 2, preferably 4-16, more preferably 5-12 but most preferably 6-10.

Further, fluorine-containing compounds employed in this invention are preferably provided with at least two carbon atoms but at most 13 fluorine atoms. Further, at least two fluoroalkyl groups are preferably identical with respect to ease of synthesis. Fluoroalkyl groups are preferably groups represented by following Formula (3).

-Lb-Raf-W Formula (3)

wherein, Lb is an alkylene group or alkyleneoxy group each of which may be substituted or unsubstituted, or a divalent group comprising combinations thereof. The substituent may be any group, however, is preferably an alkenyl group, an aryl group, an alkoxy group, a halogen atom (preferably chlorine), a carboxylic acid ester group, a carbonamido group, a carbamoyl group, an oxycarbonyl group or a phosphoric acid ester group. Lb preferably has a carbon number of 8 or less but more preferably not more than 4. Further, Lb is preferably unsubstituted alkylene.

Raf is a perfluoroalkylene group of 1-6 carbon atoms, but preferably a perfluoroalkylene group of 2-4 carbon atoms. Herein a perfluoroalkylene group refers to an alkylene group in which all the hydrogen atoms are substituted by fluorine atoms. The above perfluoroalkylene group may be a straight chain form, a branched chain form or provided with a cyclic structure.

W is a hydrogen atom, a fluorine atom or an alkyl group, but preferably a hydrogen or fluorine atom.

Specific examples of fluoroalkyl groups include: $—C_2F_5$, $—C_3F_7$, $—C_4F_9$, $—C_5F_{11}$, $—CH_2C_4F_9$, $—C_4F_8H$, $—CH_2CH_2C_4F_9$, $—(CH_2)_4C_3F_9$, $—(CH_2)_6C_4F_9$, $—(CH_2)_8C_4F_9$, $—(CH_2)_4C_2F_5$, $—(CH_2)_4C_3F_7$, $—(CH_2)_4C_5F_{11}$, $—(CH_2)_8C_2F_5$, $—CH_2CH_2C_4F_8H$, $—(CH_2)_4C_4F_8H$, $—(CH_2)_6C_4F_8H$, $—(CH_2)_6C_2F_4H$, $—(CH_2)_8C_2F_4H$, $—(CH_2)$ 6 $(CF_2)_4CH_3$, $—CH_2CH_2C_3F_7$, $—CH_2CH_2C_5F_{11}$, $—(CH_2)_4CF(CF_3)_2$, $—CH_2CF_3$, $—(CH_2)_4CH(C_2F_5)_2$, $—(CH_2)_4CH(CF_3)_2$, $—(CH_2)_4C(CF_3)_3$, $—CH_2(CF_2)_4H$, $—CH_2(CF_2)_6H$, and $—CH_2CH_2C_6F_{13}$.

An anionic hydrophilic group, with which a fluorine-containing compound is provided, refers to an acid group having a pKa of not more than 7, and an alkali metal salt or ammonium salt thereof. Specifically listed are a sulfo group, a carboxyl group, a phosphonic acid group, a carbamoylsulfamoyl group, a sulfamoylsulfamoyl group, an acylsulfamoyl group and salts thereof. Of these, the sulfo group, the carboxyl group, the phosphonic acid group and salts thereof are preferable and further more preferable are the sulfo group and salts thereof. A cationic species which constitutes the salts includes such as lithium, sodium, potassium, cesium, ammonium, tetramethylammonium, tetrabutylammonium and methylpyridinium, of which the lithium, sodium, potassium and ammonium are preferable.

A nonionic hydrophilic group, with which a fluorine-containing compound is provided, includes a hydroxyl group and a polyalkyleneoxy group, but preferably a polyalkyleneoxy group.

A polyalkyleneoxy group and the above anionic hydrophilic group may exist in the same molecule, which is a preferred embodiment of this invention. Further, it is also specifically preferable to employ an anionic compound and a nonionic compound in combination as an effective means of application.

In this invention, more preferable fluorine compounds are those represented by Formula (F) of foregoing item 6.

In Formula (F), $R^1$ and $R^2$ are each an alkyl group, however, at least one of them is to be a fluoroalkyl group of a carbon number of not less than 2 and a fluorine number of not more than 13. When $R^1$ and $R^2$ are an alkyl group other than a fluoroalkyl group, $R^1$ and $R^2$ are preferably an alkyl group having 2-18 carbon atoms but more preferably 4-12. $R^3$ and $R^4$ are each a hydrogen atom, or a substituted or unsubstituted alkyl group.

Specific examples of fluoroalkyl groups represented by $R^1$ and $R^2$ include the foregoing groups and the preferable structures being the foregoing structures represented by Formula (3). Further, preferable structures among them are also similar to the description of the foregoing fluoroalkyl group. Any alkyl group represented by $R^1$ or $R^2$ is preferably the foregoing fluoroalkyl group.

Substituted or unsubstituted alkyl groups represented by $R^1$ and $R^2$ may be a straight chain form, a branched chain form or provided with a cyclic structure. Any appropriate substituent is applicable, however, preferable are an alkenyl group, an aryl group, an alkoxy group, a halogen group (preferably chlorine), a carboxylic acid ester group, a carbonamido group, a carbamoyl group, an oxycarbamoyl group and a phosphoric acid ester group.

M in -Lb-$SO_3M$, which is represented by A, is a metal ion or an ammonium group which provides a cation. Herein, the cation represented by M is preferably exemplified by alkali metal ions (such as lithium, sodium and potassium ions), alkali earth metal ions (such as barium and calcium ions) and an ammonium group. Of these, lithium, sodium, potassium ions and an ammonium group are more preferable, and lithium, sodium and potassium are most preferable, which are suitably selected based on such as the total carbon number, the substituents and the degree of branching of alkyl group, of compounds of Formula (F). When the total carbon numbers of $R^1$, $R^2$, $R^3$ and $R^{24}$ is not less than 16, a lithium ion is superior with respect to compatibility of solubility (particularly in water) and antistatic capability or coating uniformity.

Lb is a single bond or a substituted or unsubstituted alkylene group. The substituents are preferably those listed above for $R^3$. When Lb is an alkylene group, the carbon number is preferably at most 2. Lb is preferably a single bond or a methylene group but is most preferably a methylene group.

Above-described Formula (F) is more preferably a combination of the preferred embodiments described above. Specific examples of fluorine compounds represented by Formula (F) include compounds (F-1)-(F-56) described in paragraphs "0024"-"0027" of JP-A 2004-12587.

(F-1)

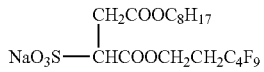

(F-2)

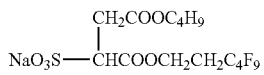

(F-3)

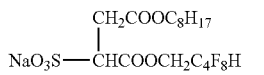

(F-4)

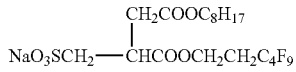

(F-5)

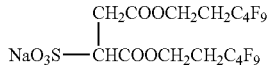

(F-6)

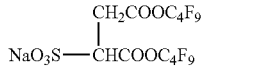

(F-7)

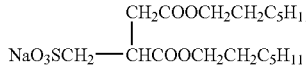

(F-8)

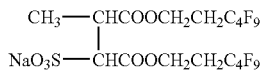

(F-9)

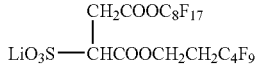

(F-10)

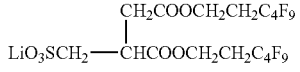

(F-11)

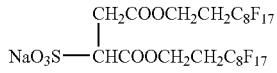

Compounds provided with a fluoroalkyl group, preferably employed in this invention, are preferably employed as surfactants in a coating composition to form layers constituting a silver halide photosensitive material (particularly, in such as a protective layer, an undercoating layer and a back-coating layer). Among them, it is specifically preferable to employ the compound in the hydrophilic colloid layer as the uppermost layer of a photosensitive material because effective antistatic capability and coating uniformity can thus be attained. Fluorine compounds of this invention are also useful with respect to exhibiting similar desired effects, however, they have also been found to be effective to retard dust adhesion, storage stability and a decrease of environment dependence in use. To obtain these effects, it is preferable to employ the fluorine compound in the outermost layer of an emulsion surface or a rear surface. Further, similar effects can also be attained when the compound is employed in an undercoating layer of a support.

In the following paragraphs, a coating composition containing a fluorine compound will be described.

A water-based coating composition, containing a fluorine compound employed in this invention, contains a medium which dissolves and/or disperses the compound of this invention. A surfactant other than this invention may also be appropriately incorporated. Further, other components can appropriately be incorporated depending on functions. The water-based coating composition of this invention is preferably a water-based medium, which includes water and mixed solvents of an organic solvent other than water (such as methanol, ethanol, i-propylalcohol, butanol, methyl cellosolve, dimethylformamide and aceton) with water. In this invention, the foregoing medium of a coating composition contains water preferably of not less than 50 weight % and more preferably of not less than 70 weight %.

In this invention, either a single type of fluorine compound or at least two types may be employed in combination. Further, other surfactants may be employed together with the above surfactants. Surfactants, which can be employed in such combination, include various types of surfactants of an anionic type, a cationic type and a nonionic type. A surfactant employed in combination may be a polymer surfactant or a fluorine-containing surfactant other than surfactants of this invention. A surfactant employed in combination is more preferably an anionic type or a nonionic type surfactant. Surfactants employed in combination include those described in such as JP-A 62-215272 (pp. 649-706); RD Nos. 17643, pp. 26-27 (December 1978), 18716, p. 650 (November 1979) and 307105, pp. 875-876 (November 1989).

Other components, which may be employed in combination, include a polymer compounds as a typical example. The polymer compound may be either a polymer soluble in a water-based medium (hereinafter, referred to as "soluble polymer") or an aqueous dispersion of a polymer (being a so-called latex). Soluble polymers are not specifically limited, and include such as gelatin, polyvinyl alcohol, casein, agar, gum arabic, hydroxyethyl cellulose, methyl cellulose and carboxymethyl cellulose; while polymer latexes include various vinyl monomers (such as acrylate derivatives, methacrylate derivatives, acrylamide derivatives, methacrylamide derivatives, styrene derivatives, conjugated diene derivatives, N-vinyl compounds, O-vinyl compounds and vinylnitriles), homopolymers or copolymers of other vinyl compounds (such as ethylene and vinilidene chloride) and dispersion of condensed polymers (polyester, polyurethane, polycarbonate and polyamide). Specific examples of such polymer compounds include those described in such as JP-A 62-215272 (pp. 707-763), and RD Nos. 17643, p. 651 (December 1978), 18716, p. 650 (November 1979) and 307105, pp. 873-874 (November 1989).

A water-based coating composition containing a utilized fluorine compound may contain various other compounds, which may be dissolved in a solvent or dispersed depending on the type of layers utilized in the photosensitive material. For example, listed are various types of couplers, an ultraviolet absorber, an anti-fading agent, an antistatic agent, a scavenger, an antifoggant, a hardener, a dye and an anti-mold agent. Further, as described above, a water-based coating composition containing a fluorine compound of this invention is preferably employed to form a hydrophilic colloid layer as the uppermost layer of the photothermographic material, and in this case, such as other surfactants, a matting agent, a lublicating agent, colloidal silica and a gelatin plastisizer, in addition to the fluorine compounds of this invention may be incorporated in the coating composition.

The used amount of a fluorine compound is not specifically limited provided it achieves the desired effects, and the used amount can be appropriately determined depending on such as the structure and the addition location of the utilized compound, as well as the types and amounts of other materials incorporated in the composition. For example, in the case of employing the fluorine compound for a hydrophilic colloid (gelatin) layer coating composition of the uppermost layer of the photothermographic material, the concentration of the fluorine compound in the coating composition is preferably 0.003-0.5 weight % and preferably 0.03-5 weight % compared to the solid amount of gelatin.

Surface Roughness

Mean roughness measured at ten points (Rz), maximum roughness (Rt) and center-line mean roughness (Ra) in this invention are defined based on following JIS surface roughness (B0601). "Mean roughness measured at ten points (Rz)" refers to a difference expressed in micrometers (μm) between an average of the height of peaks from the highest to the fifth highest and an average of a height of lowest from the lowest to the fifth lowest, which are measured at the standard length portion extracted from the cross sectional curve and in the longitudinal magnification direction from a straight line which is parallel to an average line and does not cross the cross-sectional curve. "Maximum roughness (Rt)" refers to the value expressed in micrometers (μm) which is the interval between the two straight lines measured in the longitudinal magnification direction, when standard length L is extracted from the roughness curve and which is sandwiched with two straight lines parallel to the center line. "Center-line mean roughness. (Ra)" refers to the value expressed in micrometers (μm) which is determined by the following equation, when measurement length L in the center-line direction is extracted from the roughness curve, and the center-line of this extracted portion is set on the X axis, the longitudinal magnification direction is set on the Y axis and the roughness curve is set to y=f(x).

$$Ra = \frac{1}{L}\int_0^L |f(x)|\,dx$$

As a measurement method of Rz, Rt and Ra, the samples to be measured were rehumidified under an environment of 25° C.·65% RH without overlapping and measurement was carried out under the environment. Herein, condition of "without overlapping" refers to any one of a method in which a film is wound up by making the film edge portions higher, a method in which film is superimposed by on paper between the film sheets, or a method in which a frame is formed with such as thick paper and the four corners of the film are affixed thereto. Measurement apparatus utilized include such as RSTPlus, a non-contacting three-dimensional micro surface form measurement system, manufactured by Wyko Co., Ltd.

Rz, Rt and Ra of the front surface and the rear-surface of a photosensitive material to be in the range of this invention, it is easy to adjust them by utilizing the technological means described below being, when appropriately combined.

(1) The type, the mean particle diameter, the addition amount and the surface treatment method of a matting agent (inorganic or organic powder), which is incorporated in a layer on the image forming layer side and in a layer opposite to the image forming layer (2) Dispersion conditions of a matting agent (the type of a homogenizer employed, the homogenizing time, the type and the mean particle size of beads utilized in homogenization, the type and amount of a dispersant employed at homogenization, a type and content of a polar group of a binder)

(3) Drying conditions at the time of coating (coating rate, distance between hot blown air nozzles and the coating surface, and amount of drying air), and residual solvent amount (4) The type of filter utilized for filtration of a coating composition, and filtering duration (5) In case of performing a calendaring treatment after coating, conditions thereof (for example, a calendaring temperature of 40-80° C., a roll pressure of $4.9\times10^2$-$29.4\times10^2$ N/cm, a line speed of 20-100 m/min and a nip number of 2-6)

In this invention, the value of Rz (E)/Rz (B) is preferably 0.1-0.7, more preferably 0.2-0.6 but most preferably 0.3-0.5. By setting the value in this range, among the effects of this invention, excellent film transport property can specifically be achieved and generation of uneven density at thermal development can be significantly minimized.

Further, in this invention, the value of Ra (E)/Ra (B) is preferably 0.6-1.5, more preferably 0.6-1.3 but still more preferably 0.7-1.1. By setting the value in this range, among the effects of this invention, fogging increase due to aging can be minimized, excellent film transport property can be achieved and generation of uneven density during thermal development can be further decreased.

In a method of forming an image of this invention, when mean particle diameter of a matting agent, having the maximum mean particle diameter among matting agents contained in the surface of the image forming layer side is Le (μm), and the mean particle diameter of a matting agent having the maximum mean particle diameter among matting agents incorporated in the surface of the backcoating layer side is Lb (μm), Lb/Le is preferably 2.0-10 but more preferably 3.0-4.5. By setting Lb/Le in this range, among the effects of this invention, uneven density during thermal development can specifically be reduced. Further, in a method of forming an image of this invention, Rz(E)/Ra(E) is preferably 12-60 but more preferably 14-50. By setting Rz(E)/Ra(E) in this range, among the effects of this invention, uneven density during thermal development can specifically be reduced and storage stability can be improved. Further, in a method of forming an image of this invention, Rz(B)/Ra(B) is preferably 25-65 but more preferably 30-60. By setting Rz(B)/Ra(B) in this range, among the effects of this invention, uneven density during thermal development can specifically be reduced and storage stability can be improved.

In this invention, organic or inorganic powder is preferably incorporated in a front surface layer of a thermally developable material as a matting agent for targeted purposes of this invention and to control the surface roughness. As utilized powder, preferable is powder provided with a Mohs' hardness of not less than 5.

As powder, commonly known inorganic or organic powder can be utilized after appropriate selection. Inorganic powder includes such as titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, the garnet group, garnet, mica, silica, silicon nitride and silicon carbide. Organic powder includes such as powder of polymethyl methacrylate (PMMA), polystyrene and Teflon (a trade mark). Of these, inorganic powder of $SiO_2$, titanium oxide, barium sulfate, $\alpha$-$Al_2O_3$, $\alpha$-$Fe_2O_3$, $\alpha$-FeOOH, $Cr_2O_3$ and mica are preferable, while $SiO_2$ and $\alpha$-$Al_2O_3$ are more preferable but $SiO_2$ is most preferable.

In this invention, the foregoing powder preferably has been subjected to a surface processing, for example. To form a surface processed layer, after an inorganic powder raw material is dry ground, water and a dispersant are added thereto and the resulting solution is subjected to coarse grain classification by means of wet grinding and centrifugal separation. Thereafter, a micro-grain slurry is transferred into a surface processing vessel, where surface covering via metal hydroxide is performed. First, a predetermined amount of an aqueous salt solution of such as Al, Si, Ti, Zr, Sb, Sn and Zn is added, and acid or alkali to neutralize this is added resulting in covering the surface of inorganic powder grains by a formed hydrated hydroxide. By-product water-soluble salts are removed by decantation, filtration and washing, and finally the slurry, the pH of which is adjusted and filtered, and then washed with pure water. The washed cake is dried via a spray dryer or a common hand dryer. Finally, this dried substance is ground by a jet mill to a finished product. Further, in addition to water based processing, it is possible that an $AlCl_3$ or $SiCl_4$ vapor is passed through a non-magnetic inorganic powder followed by water vapor being introduced, resulting in surface processing of Al or Si. For other surface processing methods, please refer to "Characterization of Powder Surfaces", published by Academic Press.

In this invention, the surface processing is preferably performed with a Si or Al compound. Utilizing powder, having been subjected to such surface processing, results in an excellent dispersed state during dispersion of a matting agent. The content of the foregoing Si or Al is preferably 0.1-10 weight % for both Si and Al compared to the foregoing powder, is more preferably 0.1-5 weight % for Si and Al and, and is specifically preferably 0.1-2 weight % for both Si and AL. Further, the weight ratio of Si and Al is preferably Si<Al, and surface processing can be performed via the method described in JP-A 2-83219.

Herein, "mean particle diameter of powder in this invention" means a mean diameter in the case of spherical powder, a mean longitudinal axis in the case of needle form powder, and an average of the maximum diagonal line length of the plate surface in the case of plate form powder, respectively, and can be easily determined by measurement via an electronmicroscope.

The mean particle diameter of the above-described organic or inorganic powder is preferably 0.5-10 μm but more preferably 1.0-8.0 μm.

The mean particle diameter of organic or inorganic powder contained in the outermost layer of an image forming layer side is generally 0.5-8.0 μm, preferably 1.0-6.0 μm but more preferably 2.0-5.0 μm. The addition amount is generally 1.0-20 weight %, preferably 2.0-15 weight % but more preferably 3.0-10 weight %, compared to the binder amount utilized in the outermost layer (a cross-linking agent being included in the binder amount).

The mean particle diameter of organic or inorganic powder contained in the outermost layer of the side opposite to the image forming layer side on the support, is generally 2.0-15.0 μm, preferably 3.0-12.0 μm but more preferably 4.0-10.0 μm. The addition amount is generally 0.2-10 weight %, preferably 0.4-7 weight % but more preferably 0.6-5 weight %, compared to the binder amount utilized in the outermost layer (a cross-linking agent being included in the binder amount).

Further, the coefficient of variation of particle size distribution is preferably not more than 50%, more preferably not more than 40%, but most preferably not more than 30%. Herein, the coefficient of variation of the particle size distribution is a value represented by the following equation.

(Standard deviation of particle diameter/mean particle diameter)×100 (%)

The addition method of organic or inorganic powder is either a method in which the powder is dispersed in a coating composition in advance, or a method in which organic or inorganic powder is sprayed on after the coating composition is applied but before completion of drying. Further, in the case of adding plural types of powder, both methods may be utilized in combination.

Radiation Absorbing Compound

As a radiation absorbing compound utilized in a layer on the side carrying an image forming layer, of a thermally developable material, various commonly known types of dyes and pigments may be utilized.

Dyes and pigments utilized on the image forming layer side may be any appropriate type such as dyes and pigments described in Color Index, and specific examples include pyrrazoloazole dyes, anthraquinone dyes, azo dyes, azomethine dyes, oxonole dyes, carbocyanine dyes, styryl dyes, triphenylmethane dyes, indoaniline dyes and indophenol dyes, as well as organic pigments such as phthalocyanine and inorganic pigments.

Preferable dyes utilized in this invention include anthraquinone dyes (such as compounds 1-9 described in JP-A 5-341441, compounds 3-6-18 and 3-23-38 described in JP-A 5-165147), azomethine dyes (such as compounds 17-47 described in JP-A 5-341441), indoaniline dyes (such as compounds 11-19 described in JP-A 5-289227, compound 47 described in JP-A 5-341441 and compounds 2-10-11 described in JP-A 5-165147), as well as azo dyes (such as compounds 10-16 described in JP-A 5-341441). For example, in the case of applying a thermally developable material as an image forming material via infrared light, it is preferable to utilize squalilium dyes provided with a thiopyrilium nuclei or a pyrilium nuclei, or thiopyriliumcroconium dyes or pyriliumcroconium dyes similar to a squalilium dye, disclosed in JP-A 2001-83655. Herein, a compound provided with a squalilium nuclei is a compound provided with 1-cyclobutene-2-hydroxy-4-one in the molecular structure, and a compound provided with a croconium nuclei is a compound provided with 1-cyclopentene-2-hydroxy-4,5-dione in the molecular structure. Herein, a hydroxyl group may be dissociated, and preferable dyes also include compounds of JP-A 8-201959, and compounds AD-1-AD-55 described in JP-A 2003-195450.

An addition method of these dyes may be any such as a solution, an emulsion, a solid micro-particle dispersion and a state of being mordanted on a polymer mordant. The used amount of these compounds is determined depending on the targeted absorbed amount, however, it is preferably utilized in the range of 1 μg-1 g per $m^2$ of the photothermographic material.

In the photothermographic material of this invention, by incorporating a radiation absorbing compound in a layer on the image forming layer side on a support, specifically in an intermediate layer or a protective layer, but more preferably in an image forming layer, to bring the absorbance at an exposure wavelength of these whole layers into a specific range, it is possible to improve the targeted effects of this invention, particularly, to depress uneven density or to improve silver tone at higher density portions. Further, for anti-halation, it is more preferable to provide an anti-halation layer on the side opposite the image forming layer. As dyes and pigments utilized in an anti-halation layer, dyes and pigments similar to those ones utilized in the above-described image forming layer, intermediate layer or protective layer may be utilized.

Support

Raw material of a support utilized in a thermally developable material includes such as various types of polymer materials, glass, wool and cotton fabric, paper, metal (such as aluminum), however, a flexible sheet or a material capable of being processed into a roll is more suitable, with respect to handling as an information recording material. Therefore, as a support in a photosensitive material of this invention, plastic films such as cellulose acetate film, polyester film, polyethylene terephthalate (PET) film, polyethylene naphthalate (PEN) film, polyamide film, polyimide film, cellulos triacetate film (TAC) or polycarbonate film (PC), and bi-axially stretched PET are specifically preferred. The thickness of such a support is approximately 50-300 μm, but preferably 70-180 μm.

To improve antistatic property, conductive compounds such as a metal oxide and/or a conductive polymer may be incorporated in a constituting layer, which may be incorporated in any layer, however, preferably in a backing layer, a surface protective layer or an undercoating layer on the image forming layer side. Such conductive compounds, as described in columns 14-20 of U.S. Pat. No. 5,244,773, are preferably utilized, of which, it is preferable to incorporate a conductive metal oxide compound in a surface protective layer on the backing layer side. It has thereby been proved that the desired effects (particularly transport property during the thermal development process) of this invention are further enhanced.

Herein, generally speaking, specifically preferable conductive metal oxides are crystalline metal oxide particles and such as those containing oxygen defects and a small amount of a hetero atom which forms a donor compared to the utilized metal oxides, because of high conductivity, and the latter is specifically preferable because it results no fogging of the silver halide emulsion. Examples of metal oxides are preferably such as ZnO, $TiO_2$, $SnO_2$, $AL_2O_3$, $In_2O_3$, $SiO_2$, MgO, BaO, $MoO_3$ and $V_2O_5$ and complex oxides thereof, but specifically preferable are ZnO, $TiO_2$ and $SnO_2$. As examples containing a hetero atom, addition of such as Al and In to ZnO, addition of such as Sb, Nb, P and a halogen element to $SnO_2$, and addition of such as Nb and Ta to $TiO_2$ are effective. The addition amount of these hetero atoms is preferably in the range of 0.01-30 mol % but specifically preferably 0.1-10 mol %. Further, a silicon compound may be added during micro-particle preparation to improve micro-particle dispersibility and transparency.

Metal oxide micro-particles utilized in this invention provide conductivity, the volume specific resistance of which is preferably not more than $10^7$ Ω·cm but specifically preferably not more than $10^5$ Ω·cm. These oxides are described in such as JP-A Nos. 56-143431, 56-120519 and 58-62647. In addition to these, utilized may be conductive materials, in which the above-described metal oxide adheres to other crystalline metal oxide particles or fiber form substances (such as titanium oxide), as described in Examined Japanese Patent Application Publication No. hereinafter, referred to as JP-B) 59-6235.

The utilixed particle size is preferably not more than 1 μm; however, excellent stability after dispersion is exhibited when it is not more than 0.5 μm. Further, when conductive particles of not more than 0.3 μm are utilized to minimize light scattering, it is specifically preferable since a transparent photosensitive material can thereby be prepared. Further, when the conductive metal oxide is in a needle-form or a fiber-form, a length of not more than 30 μm and a diameter of not more than 1 μm are preferable, and a length of not more than 10 μm, a diameter of not more than 0.3 μm and a length/diameter ratio of not less than 3 are specifically preferable. Herein, $SnO_2$ is available on the market from Ishihara Sangyo Kaisha, Ltd., but also utilized may be such as SNS-10M, SN-100P, SN-100D and FSS-10M.

A thermally developable material of this invention is provided with at least one image forming layer as a photosensitive layer on a support. Only one image forming layer may be formed on a support, however, it is preferable to form at least one photo-insensitive layer on the image forming layer. For example, a protective layer is preferably provided on an image forming layer to protect the image forming layer, and a backcoating layer is preferably provided on the opposite side of a support to prevent "adhesion" between photosensitive materials or between the photosensitive material and the transport rollers.

A binder utilized in these protective layers and backcoating layers is selected from polymers, exhibiting a glass transition temperature (Tg) higher than that of the image forming layer, and resistant to abrasion or deformation, being polymers such as cellulose acetate, cellulose acetate-butyrate and cellulose acetatepropionate.

Further, to control gradation, at least two image forming layers on one side of a support, or at least one image forming layer on each of both sides of a support may be arranged.

Coating of Constituent Layers

The photothermographic material of this invention is preferably formed by preparing coating compositions in which the above-described materials of each constituent layer are dissolved or dispersed in a solvent, and by performing a heating treatment after the coating compositions have been simultaneously multi-coated. Herein, "simultaneously multi-coating" means that a coating composition of each constituent layer is prepared and each constituent layer is formed by simultaneously multilayer-coating under a state of also capable of being simultaneously dried without repeating coating-drying for each separate layer, at the time of coating the solution on a support. That is, to provide an upper layer before the residual amount of the total solvent in the under layer reaches not more than 70 weight %, but more preferably not more than 90 weight %.

The simultaneous multi-layer coating method of any constituent layer is not specifically limited, and such as a bar coater method, a curtain coat method, an immersion method, an air-knife method, a hopper coat method, a reverse roll coat method, a gravure coat method, a slide-hopper coat method and an extrusion coat method may be utilized, the more preferable among these are the slide-hopper coating method and the extrusion coating method. These coating methods were described previously with respect to the side provided with an image forming layer, however, it is similar also in the case of preparing a backcoating layer which is coated together with an undercoating layer. A simultaneous multi-layer coating method in a thermally developable material is detailed in JP-A 2000-15173.

Herein, in this invention, the coating weight of silver is typically 1.45-2.70 g/m$^2$, preferably 1.50-2.50 g/m$^2$ but more preferably 1.55-2.30 g/m$^2$. Among the coating weight of silver, that arising from silver halide occupies preferably 2-18 weight % and more preferably 5-15 weight %, compared to the total silver weight.

Further, in this invention, the coating density of silver halide grains of not smaller than 0.01 μm (being an equivalent spherical particle diameter) is preferably $1\times10^{14}$-$1\times10^{18}$ particles/m$^2$ but more preferably $1\times10^{15}$-$1\times10^{17}$ particles/m$^2$.

Further, the coating density of photo-insensitive silver long chain aliphatic carboxylate is preferably $1\times10^{17}$-$1\times10^{-14}$ g but more preferably $1\times10^{-16}$-$1\times10^{-15}$ g per particle of silver halide grain of not smaller than 0.01 μm (being an equivalent spherical particle diameter).

In the case of coating performed under the conditions in the above-described range, a preferable result is obtained with respect to the maximum optical density of silver image per predetermined coated silver weight, that is, with respect to the silver covering amount (CP being covering power) as well as tone of the silver image.

In this invention, a solvent is preferably contained at a range of 5-1,000 mg/m$^2$ in the photothermographic material during the thermal development. It is more preferably adjusted to 100-500 mg/m$^2$. Thereby, it is possible to prepare the photothermographic material which exhibits high sensitivity, low fogging and high density. The preferred solvents include those described in paragraph "0030" of JP-A 2001-264930, however, this invention is not limited thereto. Further, these solvents can be utilized alone or in combination of a few types. The content of the above solvents in the thermally developable material may be adjusted by changing the conditions of such as temperature in such as the drying process after the coating process. Further, the content of the solvents can be measured by means of gas chromatography under conditions suitable to detect the residued solvent.

Packaging

In the case of storage of the photothermographic material of this invention, to prevent density variation and fogging generation due to aging, or to minimize such as curling and core set curling, a packaging material having a low oxygen permeability and/or moisture permeability is preferable for the packaging. The oxygen permeability at 25° C. is preferably not more than 50 ml/atm·m$^2$·day, more preferably not more than 10 ml/atm·m$^2$·day but still more preferably not more than 1.0 ml/atm·m$^2$·day. The moisture permeability is preferably not more than 10 ml/atm·m$^2$·day, more preferably not more than 5 ml/atm·m$^2$·day, still more preferably not more than 1.0 ml/atm·m$^2$·day.

Specific examples of a packaging material for the photothermographic material are those described in such as JP-A Nos. 8-254793, 2000-206653, 2000-235241, 2002-062625, 2003-015261, 2003-057790, 2003-084397, 2003-098648, 2003-098635, 2003-107635, 2003-131337, 2003-146330, 2003-226439 and 2003-228152. Further, the vacant ratio of the inside of a package is 0.01-10% and preferably 0.02-5%, and the nitrogen partial pressure within the package is set to not less than 80% but preferably at not less than 90% by nitrogen sealing. Further, relative humidity of the interior of the package is typically set at 10-60%, but preferably not less than 40% and not more than 55%.

Exposure of Photothermographic Material

A photothermographic material generally employs a laser light during image recording. Herein, it is preferable to employ a light source appropriate for the spectral sensitivity provided to the photosensitive material. For example, in the case of the photothermographic material being prepared to be sensitized to infrared light, any infrared light source is applicable, however, an infrared semiconductor laser (780 nm, 820 nm) is preferably utilized with respect to creating a transparent photosensitive material.

Further, the photosensitive material of this invention exhibits the capability of being exposed at an illuminance of not less than 1 mW/mm$^2$ over a short duration. Herein, "illuminance" refers to illuminance at which a photothermographic material provides an optical density of 3.0. When exposure is performed at such a high illuminance, the light amount (being illuminance×exposure time) necessary to attain a required density can be reduced, enabling a design of a high sensitive system. It is more preferably 2 mW-50 W/m$^2$ but still more preferably 10 mW-50 W/mm$^2$.

Provided it is such a light source, any light source may be employed, however, laser light generally achieves more excellent results. As a preferably employed laser light, a gas laser ($Ar^+$, Kr, He—Ne), a YAG laser, a dye laser and a semiconductor laser are preferable. Further, a semiconductor laser in combination with a second-harmonic generating element may be employed. Further, a semiconductor laser of a blue-violet emitting light (such as having the peak strength at a wavelength of 350-440 nm) can be used. A blue-violet emitting high output power laser includes the NLHV 3000E semiconductor laser, manufactured by Nichia Chemicals Co., Ltd.

Exposure is preferably performed via laser scanning exposure, however, various other methods may also be applied. For example, preferable methods include one utilizing a laser scanning exposing apparatus in which the angle between the exposure surface of a photosensitive material and the scanning laser light basically does not become perpendicular.

Herein, "not become perpendicular" refers to an angle approaching to perpendicularity during laser scanning exposure being preferably 55-88°, more preferably 60-86°, still more preferably 65-84° but most preferably 70-82°.

The beam spot diameter on the exposure surface of a photosensitive material during laser light scanning of the photosensitive material is preferably not more than 200 μm but more preferably not more than 100 μm. This is because the smaller the spot diameter, the lower the deviation angle from perpendicular of laser light incident angle. Herein, the minimum functional beam spot diameter is 10 μm. By performing such laser scanning exposure, it is possible to maintain image quality by minimizing reflected light which tends to generate uneven exposure via interference fringes.

Further, as the second method, exposure is also preferably performed via a laser scanning exposure apparatus which emits scanning laser light of a longitudinal multiple modulation. Longitudinal multiple modulation scanning laser light maintains image quality by preventing such as generation of uneven exposure via interference fringes, compared to longitudinal single-mode scanning laser light. To provide longitudinal multiple modulation, methods such as wave coupling, utilizing returning light, and high frequency superposition may be employed. Herein, longitudinal multiple modulation means that the wavelength of the exposure light is not single, and generally the distribution of exposure wavelength is not less than 5 nm and preferably not less than 10 nm. The upper limit of the distribution of exposure wavelength is not specifically limited, however, it is generally about 60 nm.

As the third embodiment, it is also preferable to form an image by scanning exposure employing at least two sets of laser lights. Such an image recording method employing plural sets of laser light is a technique utilized as an image writing means in a laser printer and a digital copier to write plural lines per scan, with respect to requirements of high resolution and high production rate, which is disclosed in such as JP-A 60-166916. This is a method in which the laser light emitted from a light source unit is inclined via a polygon mirror and focused on a photosensitive unit through such as an fθ lens, which is a laser scanning exposure apparatus basically identical to a laser imager.

In focusing of laser light on a photosensitive element in an image writing means of such as a laser printer or a digital copier, the subsequent laser light beam is focused at a position shifted by one line from the previous focused position of one laser light beam to achieve writing plural lines of an image per scanning. Specifically, two adjacent light beams in the vertical scanning direction at an interval on the order of a few 10 μm on the image surface, and the vertical scanning direction pitch of 2 beams is 63.5 μm when the printing density is 400 dpi (dpi is a dot number per 1 inch or 2.54 cm), and is 42.3 μm when the printing density is 600 dpi. Different from such a method in which laser light is shifted by an amount of one resolution in the vertical scanning direction, as in this invention, an image is preferably formed by condensing at least two sets of laser beams on the same location of the exposure surface at different incident angles. At such time, it is preferable to set the condition to satisfy $0.9\times E \leqq En\times N \leqq 1.1\times E$, when the exposure energy in the case that writing is generally performed with one set of laser beams (wavelength of λ) is E, and N sets of laser light beams utilized for exposure have the same wavelength (wavelength of λ nm) and the same exposure energy (En). By setting such conditions, the energy on the exposure surface is assured while reflection of each laser light on an image forming layer is decreased due to lower exposure energy of the laser, which results in reduced generation of interference fringes.

Herein, in the above description, utilized are plural sets of laser light beams, the wavelengths of which are identical; however, beams provided at different wavelengths may also be utilized. In the latter case, with respect to λ nm, it is preferable to set the conditions to satisfy $(\lambda-30)<\lambda 1, \lambda 2, \ldots \lambda n \leqq (\lambda+30)$.

Herein, in the foregoing first, second and third embodiments of image recording methods, as a laser utilized for scanning exposure, are commonly known lasers such as: solid lasers such as a ruby laser, a YAG laser, and a glass laser; gas lasers such as a He—Ne, an Ar ion laser, a Kr ion laser, a $CO_2$ laser, a CO laser, a He—Cd laser, a $N_2$ laser and an excimer laser; semiconductor lasers such as an InGaP laser, an AlGaAs laser, a GaAsP laser, an InGaAs laser, an InAsP laser, a $CdSnP_2$ laser and a GaSb laser; chemical lasers and dye lasers may also be utilized by appropriate selection corresponding to targeted application. Of these, laser light by a semiconductor laser having a wavelength of 600-1200 nm is preferably utilized with respect to maintenance of the laser and the size of the light source. Further, in laser light utilized in a laser imager and a laser image setter, the beam spot diameter during scanning on the photothermographic material is generally 5-75 μm as the lateral axis and 5-100 μm as the longitudinal diameter on the material surface, and the laser light scanning rate can be set to the optional value for each thermally developable material based on sensitivity at the laser emission wavelength of the thermally developable material, and laser power.

Thermal Development Apparatus

Figure 2:
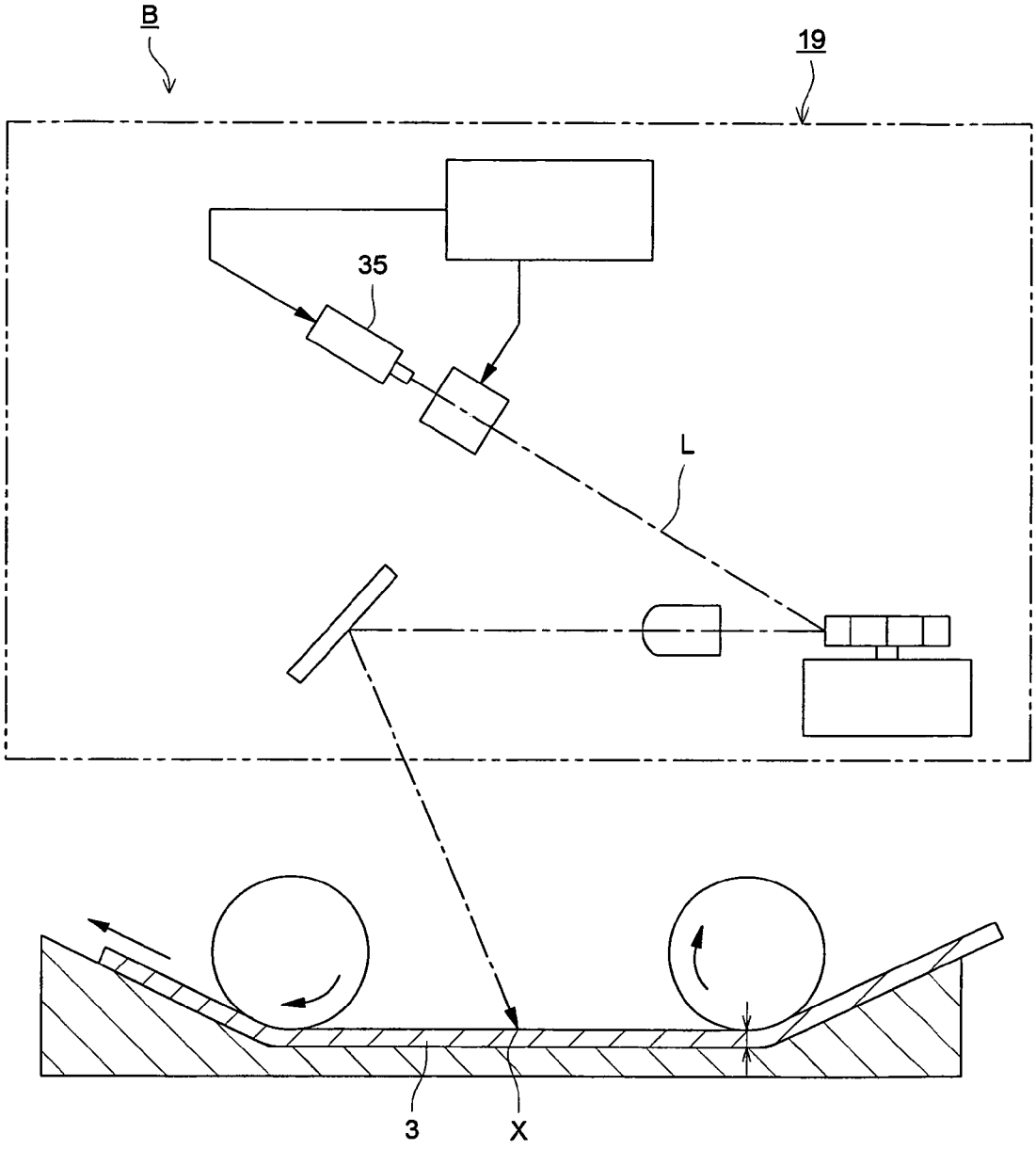
FIG. 2 shows a simplified diagram of the transport section, which transports photothermographic recording material in sheet form, and an integral scanning-exposing section, in this laser recording apparatus.

A thermal development apparatus is constituted of a film supply section such as a film tray, a laser image recording section, a thermal developing section which supplies uniform and stable heat to the entire surface of a photosensitive material sheet, a transport section extending from a film supply section through laser recording to delivery of a photosensitive material, on which an image has been formed by thermal development, out of the apparatus. A specific example of a thermal development apparatus of this embodiment is shown in FIGS. 1 and 2. To simultaneously perform the exposure and the thermal development processes, that is, to start development in the part of the sheet having already been exposed while exposing the remaining parts of the sheet type photosensitive material, the distance between the exposing section, which performs an exposure process, and a developing section is preferably 0-50 cm, which enables significantly shortened processing time of exposure–development. The above distance is more preferably in the range of 3-40 cm but most preferably 5-30 cm.

Herein, "an exposing section" refers to a portion of the apparatus where light from an exposing light source is irradiated on a photosensitive material, while "a developing section" refers to a portion where the photothermographic material is initially heated for thermal development. Location X in FIG. 2 is in exposing section B, and the photothermographic material transported from 53 of FIG. 1 firstly contacts Y of the plate of panel heater 51*a*, is the developing section.

Further, the transport rate of the photothermographic material through the thermal developing section is preferably in the range of 20-200 mm/sec but more preferably 25-200 mm/sec. By setting the transport rate in this range, it is possible to reduce uneven density during thermal development and shorten the processing time, resulting in enabling response for urgent diagnosis.

The development condition of the photothermographic material varies depending on equipment, the apparatus, and the utilized procedure, however, typically, development is performed by heating a photothermographic material, which has been image-wise exposed, at a suitably high temperature. The latent image obtained after exposure is heated at a medium high temperature (approximately 80-200° C., preferably 100-140° C. but more preferably 110-130° C.) for a sufficient time.

Sufficient image density cannot be obtained when the heating temperature is lower than 80° C., while when it is over 200° C., the binder is melted while transferred to the rollers resulting in adverse effects to the transport property and of the development apparatus in addition to the image itself. A silver image is formed via an oxidation-reduction reaction between an organic silver salt (which functions as an oxidizing agent) and a reducing agent. This reaction process proceeds without supply of any processing solution such as water.

As equipment, an apparatus or a means for heating, a typical heating means as a heat generating device, employing such as a hot plate, an iron, a hot roller, carbon, or white titanium, may be utilized. More preferably, a thermally developable material, provided with a protective layer, is preferably heat processed by contacting a surface provided with a protective layer with a heating means, with respect to performing uniform heating, as well as heat efficiency and working property. It is preferable to thermally develop the material while it is being transported, keeping the surface of the side provided with a protective layer in contact with a heated roller.

EXAMPLES

In the following paragraphs, this invention will be detailed referring to examples, however, embodiments of this invention are not limited thereto. Herein, "%" in examples represents "weight %" and "part(s)" represents "weight part(s)", unless otherwise noted.

Example 1

Preparation of PET Support

By utilizing terephthalic acid and ethylene glycol, PET having an intrinsic viscosity (IV)=0.66 [being measured in phenol/tetrachloroethane=6/4 (weight %) at 25° C.] was prepared according to a typical method. The PET was dried at 130° C. for 4 hours after having been pelleted, and was extruded from a T die to be rapidly cooled after having been fused at 300° C., resulting in preparation of a non-stretched film having a thickness after thermal fixing of 175 μm.

This film was longitudinally stretched by a factor of 3.3 times via rolls exhibiting different circumferential rates, and then laterally stretched by a factor of 4.5 times via a tenter. Temperatures during stretching were 110° C. and 130° C., respectively. Thereafter, the film was thermally fixed at 40° C. for 20 seconds, followed by being relaxed at 4% in the lateral direction at the same respective temperature. Then, both edgges were subjected to a knurling process after the chucked portion of film had been cut away, and the resulting film was wound up at 4 kg/cm$^2$, resulting in preparation of a PET roll having a thickness of 175 μm.

Corona Discharge Treatment

Both surfaces of the PET support were processed under room temperature at 20 m/min by use of Solid State Corona Discharger 6KVA Model manufactured by Pillar Corp. It was proved that the support had been processed at 0.375 kV·A·min/m$^2$ based on read out values of electrical current and volts at the process. At that time, the processing frequency was 9.6 kHz, and the gap clearance between an electrode and a dielectric roll was 1.6 mm.

Preparation of Under-coated Support

An undercoating layer coating composition of the following composition was prepared (Image Forming Layer Side Undercoating Layer Coating Composition).

| | |
|---|---|
| Pessresin A-520, manufactured by Takamatsu Oil and Fat Co., Ltd. (30 weight % solution) | 59 g |
| Polyethyleneglycol monononylphenylether (at a mean ethylene oxide number = 8.5, being a 10% solution) | 5.4 g |
| MP-1000, manufactured by Soken Chemicals Co., Ltd. (polymer micro-particles, mean particle diameter of 0.4 μm) | 0.91 g |
| Distilled water | 935 ml |
| Rear-surface Side First Undercoating Layer Coating Composition | |
| Styrene-butadiene copolymer latex (styrene/butadiene weight ratio = 68/32, solid content of 40%) | 158 g |
| 2,4-dichloro-6-hydroxy-s-triazine sodium salt (being an 8% aqueous solution) | 20 g |
| Sodium laurylbenzenesulfonate of 1% aqueous solution | 10 ml |
| Distilled water | 854 g |
| Rear-surface Side Second Undercoating Layer Coating Composition | |
| $SnO_2$/SbO (9/1 weight ratio, mean particle diameter of 0.038 μm, 17 weight % dispersion) | 84 g |
| Gelatin (being a 10% aqueous solution) | 89.2 g |
| Metholose TC-5, manufactured by Shin-Etsu Chemical Co., Ltd. (being a 2% aqueous solution) | 8.6 g |
| MP-1000, manufactured by Soken Chemicals Co., Ltd. (described above) | 0.01 g |
| Sodium dodecylbenzenesulfonate of 1% aqueous solution | 10 ml |
| Sodium hydroxide of 1% aqueous solution | 6 ml |
| Proxel, manufactured by ICI Corp. | 1 ml |
| Distilled water | 805 ml |

On both surfaces of the foregoing biaxially stretched PET support having a thickness of 175 μm, after the above-described corona discharge treatment had been applied, the above-described undercoating layer coating composition was coated on one surface (being the image forming layer surface) for a wet coating amount of 6.6 ml/m$^2$ (per surface) via a wire-bar followed by being dried at 180° C. for 5 minutes; successively, the above-described first undercoating layer coating composition was coated on the rear surface (the rear-surface) for a wet coating amount of 5.7 ml/m$^2$ via a wire-bar followed by being dried at 180° C. for 5 minutes, and the above-described second undercoating layer coating composition was also coated onto the resulting layer for a wet coating amount of 7.7 ml/m$^2$ (per surface) via a wire-bar followed by being dried at 180° C. for 6 minutes; resulting in preparation of an under coated support.

Preparation of Solid Micro-Particle Dispersion (a) of Base Precursor

Base precursor compound-1 of 64 g, 28 g of diphenylsulfone and 10 g of surfactant Demor N, manufactured by Kao Corp., were mixed with 220 ml of distilled water, after which the mixed solution was bead-dispersed via a sand mill (being ¼ Gallon Sand Grinder Mill, manufactured by Imex Corp.) resulting in preparation of solid micro-particle dispersion (a) of a base precursor having a mean particle diameter of 0.2 μm.

Preparation of Solid Dye Micro-particle Dispersion

Cyanine dye compound-1 of 9.6 g and 5.8 g of sodium dodecylbenzenesulfonate were mixed with 305 ml of distilled water, after which the mixed solution was bead-dispersed via a sand mill (¼ Gallon Sand Grinder Mill, described above) resulting in preparation of a solid dye micro-particle dispersion exhibiting a mean particle diameter of 0.2 μm.

Preparation of Anti-halation Layer Coating Composition

Gelatin of 17 g, 9.6 g of polyacrylamide, 2.4 g of above-described base precursor solid micro-particle dispersion (a), 50 g of the above-described solid dye micro-particle dispersion, 0.03 g of benzoisothiazoline, 2.2 g of sodium polyethylenesulfonate and 0.1 g of blue dye compound-1 were mixed in 844 ml of water, resulting in preparation of an anti-halation layer coating composition.

Preparation of Rear-surface Protective Layer Coating Composition

A vessel was heated to 40° C. and 50 g of gelatin, 0.2 g of sodium polystyrenesulfonate, 2.4 g of N,N-ethylene bis (vinylsulfonacetoamide), 1 g of sodium t-octylphenoxyethoxyethanesulfonate, 30 mg of benzoisothiazolinone, 125 mg of fluorine-containing surfactant $C_8F_{17}SO_2N(C_3H_7)CH_2COOK$ (F-1), 125 mg of a fluorine-containing surfactant (SF-17), 8.8 g of an acrylic acid/ethylacrylate copolymer (copolymerization weight ratio of 5/95), Aerosol OT (manufactured by American Cyanamide Corp.) and 0.6 g of a fluid paraffin emulsion (1.8 g as fluid paraffin) were mixed with 950 ml of water to be stirred and dissolved by use of Dissolver. Finally, 20.0 g of monodispersed silica, which had been dispersed in water at a concentration of 5% by use of Dynomill (employing 0.5 mm ceramics beads) and having a mono-dispersibility of 15%, were added to the resulting solution to prepare a rear-surface protective layer coating composition.

Preparation of Silver Halide Emulsion A1

Potassium iodide at a 1% aqueous solution of 4.3 ml was added to 1,420 ml of distilled water, further 3.5 ml of sulfuric acid having a concentration of 0.5 mol/L and 36.7 g of phthalated gelatin were added, and the resulting solution was kept at a solution temperature of 35° C. while being stirred in a stainless steel reaction pot, followed by being added to the whole amount of solution A, in which 22.22 g of silver nitrate were added with 195.6 ml of distilled water to be dissolved, and solution B, in which 21.8 g of potassium iodide were dissolved in 218 ml of distilled water, over 9 minutes. Thereafter, to the resulting solution, added was 10 ml of 3.5% hydrogen peroxide aqueous solution, to which further added was 10.8 ml of a 10% benzoimidazole aqueous solution.

Further, the resulting solution was added to the entire volume of solution C, in which 51.56 g of silver nitrate had been dissolved in 317.5 ml of distilled water, at a constant flow rate over 120 minutes, and solution D, in which 60 g of potassium iodide was dissolved in 600 ml of distilled water, was added by means of a controlled double jet method, while pAg was maintained at 8.1. The total amount of potassium hexairidate (III) was added to make $1\times10^{-4}$ mol per mol of silver after 10 minutes from start of addition of solutions C and D. Further, the total amount of $3\times10^{-4}$ mol per 1 mol of silver a potassium ferrous (II) hexacyanide aqueous solution was added 5 seconds after finishing addition of solution C. The pH was adjusted to 3.8 by use of sulfuric acid having a concentration of 0.5 mol/L, and stirring was stopped to allow a precipitation/desalting/washing process. The pH was adjusted to 5.9 by use of sodium hydroxide resulting in preparation of silver halide dispersion exhibiting a pAg of 8.0.

The above-described silver halide dispersion, which was kept at 38° C. while stirred, was added with 5 ml of a methanol solution of 0.34% 1,2-benzoisothiazoline-3-one, to which further added was $1.2\times10^{-3}$ mol of a methanol solution of 1/1 (mol ratio) mixture of spectral sensitization dye A and spectral sensitization dye B, per mol of silver as the total of A and B, then after one minute the solution was heated to 47° C. The resulting solution was added to $7.6\times10^{-5}$ mol per mol of silver of sodium benzenethiosulfonate as a methanol solution 20 minutes after temperature rising to 47° C., after further 5 minutes, added was 2.9×10−4 mol per mol of silver of tellurium sensitizer C as a methanol solution to be ripened for 91 minutes.

The resulting solution was added with 1.3 ml of a 0.8% methanol solution of N,N'-dihydroxy-N"-diethylmelamine, further after 4 minutes added was $4.8\times10^{-3}$ mol per mol of silver of 5-methyl-2-mercaptobenzoimidazole as a methanol solution and $5.4\times10^{-3}$ mol per mol of silver of 1-phenyl-5-mercapto-1,3,4-triazole as a methanol solution, resulting in preparation of silver halide emulsion A1. The grains of the prepared silver halide emulsion were pure silver iodide grains exhibiting a mean equivalent spherical diameter of 30 nm and a coefficient of variation of the equivalent spherical diameter of 18%. Such a grain size was determined based on an average of 1,000 random grains employing an electron-microscope.

Preparation of Silver Halide Emulsion B1

Silver Halide Emulsion B1 was prepared in a similar manner as the preparation of Silver Halide Emulsion A1, except that the temperature of the solution at the time of addition, via a controlled double jet method, was changed to 48° C. The grains of the prepared silver halide emulsion were pure silver iodide grains having a mean equivalent spherical diameter of 55 nm and a coefficient of variation of the equivalent spherical diameter of 18%. Such grain size was determined based on an average of 1,000 grains random via an electronmicroscope.

Preparation of Silver Halide Emulsion A2

Silver Halide Emulsion A2 was prepared in a manner similar to the preparation of Silver Halide Emulsion A1, except that a part of 21.8 g of potassium iodide was changed to potassium bromide to achieve a silver iodide content of 90 mol %. The grains of the prepared silver halide emulsion were silver iodido-bromide grains (at a silver iodide content of 90 mol %) having a mean equivalent spherical diameter of 30 nm and a coefficient of variation of 18%. Such grain size was determined based on an average of 1,000 random grains via an electronmicroscope.

Preparation of Silver Halide Emulsion B2

Silver Halide Emulsion B2 was prepared in a manner similar to the preparation of Silver Halide Emulsion B1, except that some of the 21.8 g of potassium iodide was changed to potassium bromide to achieve a silver iodide content of 90 mol %. The grains of the prepared silver halide emulsion were silver iodido-bromide grains (at a silver iodide content of 90 mol %) having a mean equivalent spherical diameter of 55 nm and a coefficient of variation of 18%. Such grain size was determined based on an average of 1,000 random grains via an electronmicroscope.

Preparation of Silver Halide Emulsion A3

Silver Halide Emulsion A3 was prepared in a manner similar to the preparation of Silver Halide Emulsion A1, except that 4 ml of an ethanol solution of compound ETTU were further added after the addition of 10 ml of a 3.5% hydrogen peroxide aqueous solution. The grains of the prepared silver halide emulsion were pure silver iodide grains exhibiting a mean equivalent spherical diameter of 30 nm and a coefficient of variation of 18%. Such grain size was determined based on an average of 1,000 random grains via an electronmicroscope.

Preparation of Silver Halide Emulsion B3

Silver Halide Emulsion B3 was prepared in a manner similar to the preparation of Silver Halide Emulsion B1, except that 4 ml of an ethanol solution of compound ETTU were further added after the addition of 10 ml of a 3.5% hydrogen peroxide aqueous solution. The grains of the prepared silver halide emulsion were pure silver iodide grains exhibiting a mean equivalent spherical diameter of 55 nm and a coefficient of variation of 18%. Such grain size was determined based on an average of 1,000 random grains via an electronmicroscope.

Preparation of Silver Halide Emulsion A4

Silver Halide Emulsion A4 was prepared in a manner similar to the preparation of Silver Halide Emulsion A1, except that 40 ml of a 5% aqueous solution of 4-hydroxy-6-methyl-1,3,3a,7-tetrazindene were further added after the addition of 10 ml of a 3.5% hydrogen peroxide aqueous solution. The grains of the prepared silver halide emulsion were pure silver iodide grains exhibiting a mean equivalent spherical diameter of 3 nm and a coefficient of variation of 18%. Such grain size was determined based on an average of 1,000 random grains via an electronmicroscope.

Preparation of Silver Halide Emulsion B4

Silver Halide Emulsion B4 was prepared in a manner similar to the preparation of silver halide emulsion B1, except that 40 ml of a 5% aqueous solution of 4-hydroxy-6-methyl-1,3,3a,7-tetrazindene were further added after the addition of 10 ml of a 3.5% hydrogen peroxide aqueous solution. The grains of the prepared silver halide emulsion were pure silver iodide grains exhibiting a mean equivalent spherical diameter of 55 nm and a coefficient of variation of 18%. Such grain size was determined based on an average of 1,000 random grain via an electronmicroscope.

Preparation of Silver Halide Emulsion C

Silver Halide Emulsion C was prepared in a manner similar to the preparation of Silver Halide Emulsion A1, except that some of the 21.8 g of potassium iodide was changed to potassium bromide to achieve a silver iodide content of 3.5 mol %. The grains of the prepared silver halide emulsion were silver iodido-bromide grains (at a silver iodide content of 3.5 mol %) exhibiting a mean equivalent spherical diameter of 30 nm and a coefficient of variation of 18%. Such grain size was determined based on an average of 1,000 random grains via an electronmicroscope.

Preparation of Silver Halide Mixed Emulsion E1 for Coating Composition

Silver Halide Emulsion A1 and Silver Halide Emulsion B1 were dissolved together to achieve a weight ratio of 8/2 respectively, and the mixed emulsion was added to $7\times10^{-3}$ mol per mol of silver in a 1% aqueous solution of benzothiazolium iodide. Further, for the coating composition, water was added to the emulsion to achieve a silver halide content of 38.2 g based on silver per kg of the mixed emulsion.

Preparation of Silver Halide Mixed Emulsion E2 for Coating Composition

Silver Halide Emulsion A2 and Silver Halide Emulsion B2 were dissolved together to achieve a weight ratio of 8/2 respectively, and the mixed emulsion was added to $7\times10^{3}$ mol per mol of silver in a 1% aqueous solution of benzothiazolium iodide. Further, for the coating composition, water was added to the emulsion to achieve a silver halide content of 38.2 g based on silver per kg of the mixed emulsion.

Preparation of Silver Halide Mixed Emulsion E3 for Coating Composition

Silver Halide Emulsion A3 and Silver Halide Emulsion B3 were dissolved together to achieve a weight ratio of 8/2 respectively, and the mixed emulsion was added to 7×10−3 mol per mol of silver in a 1% aqueous solution of benzothiazolium iodide. Further, water was added to the emulsion to achieve a silver halide content per kg of the mixed emulsion for a coating composition of 38.2 g.

Preparation of Silver Halide Mixed Emulsion E4 for Coating Composition

Silver Halide Emulsion A4 and Silver Halide Emulsion B4 were dissolved together to achieve a weight ratio of 8/2 respectively, and the mixed emulsion was added to $7\times10^{-3}$ mol per mol of silver in a 1% aqueous solution of benzothiazolium iodide. Further, for the coating composition, water was added to the emulsion to achieve a silver halide content of 38.2 g based on silver per kg of the mixed emulsion.

Preparation of Silver Halide Emulsion E5 for Coating Composition

Silver Halide Emulsion C was dissolved and added to $7\times10^{3}$ mol per mol of silver in a 1% aqueous solution of benzothiazolium iodide. Further, for the coating composition, water was added to the emulsion to achieve a silver halide content of 38.2 g based on silver per kg of the mixed emulsion.

Preparation of Silver Behenate Dispersion

Behenic acid (being Edenor C22-85R, manufactured by Henckel Corp.) of 87.6 kg, 423 L of distilled water, 49.2 L of sodium hydroxide at a concentration of 5 mol/L and 120 L of t-butylalcohol were mixed, and the mixture was allowed react at 75° C. while stirred for 1 hour, resulting in preparation of a sodium behenate solution. Separately, 206.2 L (pH of 4.0) of an aqueous solution containing 40.4 kg of silver nitrate were prepared and temporarily stored at 10° C.

A reaction vessel charged with 635 L of distilled water and 30 L of t-butyl alcohol and heated at 30° C., after which the total amount of the foregoing sodium behenate solution and the total amount of the silver nitrate aqueous solution were added to the mixture over 93 minutes and 15 seconds, and over 90 minutes, respectively. During that time, in the first 11 minutes, the silver nitrate aqueous solution only was added, thereafter addition of a sodium behenate solution was begun, and only the sodium behenate solution was added for 14 minutes and 15 seconds after finishing of addition of the silver nitrate solution. Herein, the interior temperature of the reaction vessel was maintained at 30° C. Further, the piping for the addition system of sodium behenate solution was heated via hot circulating water outside via double piping means, and adjusted to maintain a solution temperature of 75° C. at the outlet end of the addition nozzle. Further, the piping for the addition system of silver nitrate aqueous solution was cooled via circulating cold water in the outer pipe of a double piping system. The addition point of the sodium behenate solution and the silver nitrate aqueous solution were arranged symmetrically to achieve a stirring means, and set at a sufficient height to not contact the reaction solution.

After addition of the sodium behenate solution, the system allowed to stand at the same temperature while stirred for 20 minutes, then the temperature of the system was raised to 35° C. over 30 minutes to perform ripening for 210 minutes. Immediately after ripening, solid portions were filtered out by means of a centrifugal filtration, and the solid precipitates were washed with water until their electrical conductivity reached 30 μS/cm. The solid portion was kept as a wet cake without being dried. Thus, silver behenate was prepared.

The form of silver behenate particles prepared as above was evaluated via electronmicroscopic photography, to be flake crystals being a=0.14 μm, b=0.4 μm and c=0.6 μm based on an average (a, b and c are defined previously), a mean aspect ratio of 5.2, a mean equivalent spherical diameter of 0.52 μm and a coefficient of variation of equivalent spherical diameter of 15%.

The wet cake, as 260 kg of a dried solid was added to 19.3 kg of polyvinyl alcohol (being PVA-217, manufactured by Kuraray Co., Ltd.) and water, and the total volume was brought to 1,000 kg, followed by being made into a slurry via a dissolver fan and further pre-dispersed with a PM-10 type pipe-line mixer, manufactured by Mizuho Industry Co., Ltd. Next, the pre-dispersed original solution was subjected three times to treatment of a Microfluidizer M-610 homogenizer, (manufactured by Microfluidex•International Corp.), employing a Z type interaction chamber at an adjusted pressure of $12.3\times10^7$ Pa to prepare a silver behenate dispersion. The dispersion temperature was set to 18° C. by installing spiral condensers before and after the interaction chamber, and controlling the temperature of a refrigerant.

Preparation of Reducing Agent Dispersion

Water, specifically 10 kg, was added to a reducing agent (the compound and amount as described in Table 1) and 16 kg of a 10% aqueous solution modified polyvinyl alcohol, specifically Poval MP203, (manufactured by Kuraray Co., Ltd.) and the resulting solution was sufficiently stirred to prepare a slurry. This slurry was then transferred via a diaphragm pump and dispersed for 3.5 hours via a horizontal sand mill, specifically UVM-2, manufactured by Imex Corp., filled with 0.5 mm mean diameter zirconia beads, 0.2 g of sodium benzothiazolinone and water were added to achieve a reducing agent concentration of 25%, resulting in preparation of a reducing agent dispersion.

Reducing agent particles contained in the thus obtained reducing agent dispersion exhibited a median size of 0.40 μm and the maximum particle diameter of 1.5 μm. This reducing agent dispersion was filtered, through a 3.0 μm polypropylene filter to eliminate foreign matters, and was stored.

Preparation of Hydrogen Bonding Compound-1 Dispersion

Hydrogen bonding compound-1, of 10 kg, and 16 kg of a 10% aqueous solution of modified polyvinyl alcohol (being Poval MP203, as described previously) were added with 10 kg of water, the resulting solution was sufficiently mixed to form a slurry. This slurry was then transferred via a diaphragm pump and dispersed for 3.5 hours via a UVM-2 horizontal sand mill, described above, filled with 0.5 mm mean diameter zirconia beads, after which 0.2 g of sodium benzothiazolinone and water were added to achieve a 25% concentration of hydrogen bonding compound-1, resulting in preparation of hydrogen bonding compound-1 dispersion.

Hydrogen bonding compound-1 particles contained in the thus obtained hydrogen bonding compound-1 dispersion exhibited a median size of 0.35 μm and a maximum particle diameter of 1.5 μm. This hydrogen bonding compound-1 dispersion was filtered, via a 3 μm polypropylene filter to eliminate foreign matters, and stored.

Preparation of Development Accelerator-1 Dispersion

Development Accelerator-1, of 10 kg, and 20 kg of a 10% aqueous solution of modified polyvinyl alcohol (Poval MP203; described above) were mixed with 10 kg of water, the resulting solution was sufficiently mixed to form a slurry. This slurry was then transferred via a diaphragm pump and dispersed for 3.5 hours via a UVM-2 horizontal sand mill, described above, filled with 0.5 mm mean diameter zirconia beads, after which 0.2 g of sodium benzothiazolinone and sufficient water were added to achieve a 20% concentration of development accelerator-1, resulting in preparation of Development Accelerator-1 Dispersion.

Development Accelerator-1 particles contained in the thus obtained Development Accelerator-1 Dispersion had a median size of 0.48 μm and a maximum particle diameter of 1.4 μm. This development Accelerator-1 Dispersion was filtered, via a 3.0 μm polypropylene filter to eliminate foreign matters, and stored.

Development Accelerator-2, Development Accelerator-3, tone modifier-1 (a yellow leuco dye, specifically YA-1) and tone modifier-2 (a cyan leuco dye, specifically CA-12) were also dispersed according to the manner similar to Development Accelerator-1, resulting in preparation of each dispersion exhibiting a 20% concentration.

Preparation of Polyhalogen Compound-1 Dispersion

Initially, 10 kg of polyhalogen compound-1, specifically tribromomethane sulfonylbenzene, 10 kg of a 20% aqueous solution of modified polyvinyl alcohol, specifically Poval MP203, (described above) and 0.4 kg of a 20% aqueous solution of sodium tri-i-propylnaphthalenesulfonate were added with 14 kg of water, and the resulting solution was sufficiently mixed to form a slurry. This slurry was then transferred via a diaphragm pump and dispersed for 5 hours via a UVM-2 horizontal sand mill, described above, filled with 0.5 mm mean diameter zirconia beads, after which 0.2 g of sodium benzothiazolinone and water were added to achieve a 26% concentration of polyhalogen compound-1, resulting in preparation of polyhalogen compound-1 dispersion.

Polyhalogen compound-1 particles contained in the thus obtained polyhalogen compound-1 dispersion exhibited a median size of 0.41 μm and a maximum particle diameter of 2.0 μm. This polyhalogen compound-1 dispersion was filtered, via a 10.0 μm polypropylene filter to eliminate foreign matters, and stored.

Preparation of Polyhalogen Compound-2 Dispersion

Polyhalogen compound-2, specifically N-butyl-3-tribromomethanesulfonyl benzamide, of 10 kg, and 20 kg of a 10% aqueous solution of modified polyvinyl alcohol, specifically previously described Poval MP203, were added with 0.4 kg of a 20% aqueous solution of sodium tri-i-propylnaphthalenesulfonate, and the resulting solution was sufficiently mixed to form a slurry. This slurry was then transferred via a diaphragm pump and dispersed for 5 hours via a UVM-2 horizontal sand mill, described previously, filled with 0.5 mm mean diameter zirconia beads, after which 0.2 g of sodium benzothiazolinone and sufficient water were added to achieve a 30% concentration of polyhalogen compound-2, resulting in preparation of polyhalogen compound-2 dispersion.

Polyhalogen compound-2 particles contained in the thus obtained polyhalogen compound-1 dispersion exhibited a median diameter of 0.40 μm and a maximum particle diameter of 1.3 μm. This polyhalogen compound-2 dispersion was filtered, via a 3.0 μm polypropylene filter to eliminate foreign matters, and stored.

Preparation of Phthalazine Compound-1 Solution

Modified polyvinyl alcohol, specifically MP 203, described above, of 8 kg was dissolved in 174.57 kg of water, and then, the resulting solution was added with 3.15 kg of a 20% aqueous solution of sodium tri-i-propylnaphthalenesulfonate and 14.28 kg of a 70% aqueous solution of phthalazine compound-1, specifically 6-i-propylphthalazine, resulting in preparation of a 5% solution of phthalazine compound-1.

Preparation of Mercapto Compound-2 Aqueous Solution

Mercapto compound-2, [being 1-(3-methylureidophenyl)-5-mercaptotetrazole sodium salt] of 20 g was dissolved in 980 g of water to prepare a 2.0% solution.

Preparation of Pigment-1 Dispersion

C. I. Pigment Blue 60 at 64 g and 6.4 g of Demor N, (manufactured by Kao Corp.), were added with 250 g of water, after which the resulting system was sufficiently mixed to form a slurry. Zirconia beads, at a mean diameter of 0.5 mm, of 800 g were prepared and charged into a vessel together with the above slurry, and dispersed for 25 hours via previously described ¼ Gallon Sand Grinder Mill homogenizer, to prepare Pigment-1 Dispersion. Pigment-1 Particles contained in the thus obtained pigment-1 dispersion exhibiting a mean particle diameter of 0.21 μm.

Preparation of SBR Latex Solution

By employing ammonium persulfate as a polymerization initiator and an anionic surfactant as an emulsifier, 70.0 parts of styrene, 27.0 parts of butadiene and 3.0 parts of acrylic acid were emulsion polymerized, after which the product was aged at 80° C. for 8 hours. The product was then cooled to 40° C., the pH was adjusted to 7.0 with ammonium water, and further added was Sandet BL, (manufactured by Sanyo Chemicals Co., Ltd.) to achieve a concentration of 0.22%. Next, pH was adjusted to 8.3 via a 5% sodium hydroxide aqueous solution, and the pH was further adjusted to 8.4 via ammonia water. The mol ratio of $Na^+$ ions to $NH^{4+}$ ions, which was utilized here, was 1/2.3 respectively. Further, 1 kg of this solution was added with 0.15 ml of a 7% aqueous solution of benzoisothiazolinnone sodium salt, resulting in preparation of SBR latex solution.

This latex solution exhibited a 22° C. Tg, a 0.1 0181 m mean particle diameter, a 43% concentration, an 0.6% equilibrium moisture content at 25° C.·60% RH, a 4.2 mS/cm ion conductivity measured with respect to 25° C. latex original solution via a CM-30S conductivity meter, (manufactured by To a Electronics Ltd.) and an 8.4 pH.

SBR latex exhibiting a different Tg can be prepared in a similar manner by appropriately changing the styrene/butadiene ratio.

SBR latex: latex of styrene/butadiene/acrylic acid (at a respective 70/20/3 mol ratio) copolymer Preparation of Image Forming Layer Coating Composition An image forming layer coating composition in which 1000 g of the above-prepared silver behenate dispersion, 276 ml of water, 32.8 g of pigment-1 dispersion, 21 g of polyhalogen compound-1 dispersion, 58 g of polyhalogen compound-2 dispersion, 173 g of phthalazine compound-1 solution, 1082 g of SBR latex solution (at a 22° C.), 155 g of a reducing agent (of the type described in Table 1) dispersion, 55 g of hydrogen bonding compound-1 dispersion, 6 g of development accelerator-1 dispersion, 2 g of development accelerator-2 dispersion, 3 g of development accelerator-3 dispersion, 2 g of tone modifier-1 dispersion, 2 g of tone modifier-2 dispersion and 6 ml mercapto compound-2 aqueous solution were added in the system in the sequence, while 117 g of silver halide emulsion for a coating composition were added immediately before coating. The mixture was then sufficiently stirred to form an image forming layer coating composition, which was transferred to a coating die as it is and applied.

The viscosity of the above-described image forming layer coating composition was measured via a B-type viscometer to be 40 mPa·s at 40° C. (with a No. 1 rotor at 60 rpm). The viscosity of the coating composition at 25° C. measured via an RFS Fluid Spectrometer (manufactured by Roeometrix Far East Corp.), was 530, 144, 96, 51 and 28 mPa·s at a share rate of 0.1, 1, 10, 100 and 1,000 (1/sec), respectively. The amount of zirconium in the coating composition was 0.25 g per 1 g of silver.

Preparation of Intermediate Layer Coating Composition

Polyvinyl alcohol, specifically PVA-205, (manufactured by Kuraray Co., Ltd.), of 1,000 g, 272 g of a 5% dispersion of a pigment, specifically C. I. Pigment Blue 60, 4,200 ml of 19% latex solution of a methylmethacrylate/styrene/butylacrylate/hydroxyethylmethacty late/acrylic acid copolymer (at a 64/9/20/5/2 respective weight ratio) were added with 27 ml of a 5% aqueous solution, specifically Aerosol OT, (manufactured by American Cyanamide Corp.) and 135 ml of a 20% aqueous solution of diammonium phthalate, with sufficient water to achieve a total amount of 10 kg, while pH was adjusted to 7.5 with sodium hydroxide to obtain an intermediate layer coating composition. The composition was fed to a coating die and applied at 9.1 ml/$m^2$. The viscosity of the coating composition was measured at 58 mPa·s via a B-type viscometer at 40° C., with the No. 1 rotor, spining at 60 rpm.

Preparation of Protective First Layer Coating Composition

Inert gelatin of 64 g was dissolved in water, to which was added 80 g of a 27.5% latex solution of a methylmethacrylate/styrene/butylacrylate/hydroxyethyl methacrylate/acrylic acid copolymer (at a 64/9/20/5/2 respective weight ratio), 23 ml of a 10% methanol solution of phthalic acid, 23 ml of a 10% methanol solution of 4-methylphthalic acid, 28 ml of sulfuric acid exhibiting a concentration of 0.5 mol/L, 5 ml of a 5% aqueous solution, specifically previously described Aerosol OT, 0.5 g of phenoxyethanol and 0.1 g of benzothiazolinone, with sufficient water to acieve a total amount of 750 g of a coating composition. The resulting composition was mixed with 26 ml of a 4% chromium alum aqueous solution immediately before coating via a static mixer and sent to a coating die to be applied at 18.6 ml/m$^2$. The viscosity of the coating composition was measured by a B-type viscometer to be 20 mPa·s at 40° C., with the No. 1 rotor, spining at 60 rpm.

Preparation of Protective Second Layer Coating Composition

Inert gelatin of 80 g was dissolved in water, which was added with 102 g of a 27.5% latex solution of a methylmethacrylate/styrene/butylacrylate/hydroxyethyl methacrylate/acrylic acid copolymer (at a 64/9/20/5/2 respective weight ratio), 15 ml of fluorine-containing surfactant, specifically F-11, of Formula (F), 15 ml of a fluorine-containing surfactant, FF-1 at a 5% solution, 23 ml of a 5% aqueous solution of specifically previously described Aerosol OT, 1.6 g of 4-methylphthalic acid, 4.8 g of phthalic acid, 44 ml of sulfuric acid having a concentration of 0.5 mol/L, and 10 mg of benzothiazolinone, and sufficient water to bring a total amount to 650 g, after which the resulting solution was stirred in dissolver and dissolved. Then 132.0 g of monodispersed silica, (at a 3 μm mean particle size, and the surface being treated with 1% of the silica total weight of aluminium), was dispersed in water, at a concentration of 5%, employing 0.5 mm ceramics beads in a Dynomill, and exhibiting a monodispersibility of 15%, was added to the solution and stirred until dissolved. The resulting solution was then mixed with 445 ml of an aqueous solution, containing 4% of chromium alum and 0.67% of phthalic acid, immediately before coating via a static mixer to form a protective second layer coating composition, which was fed to a coating die and applied at 8.3 ml/m$^2$. The viscosity of the coating composition was measured by a B-type viscometer to be 18 mPa·s at 40° C., with the No. 1 rotor, spining at 60 rpm.

Preparation of Photothermographic Material

Simultaneously multi-coated which was dried, resulting in preparation of a rear layer on the rear-surface of the foregoing under-coated support, were an anti-halation layer coating composition to achieve a solid coating weight of solid micro-particle dye of 0.04 g/m$^2$, and a rear-surface protective layer coating composition to achieve a gelatin coating weight of 1.7 g/m$^2$.

On the surface opposite the rear layer surface, an image forming layer, an intermediate layer, a first protective layer and a second protective layer, were simultaneously multi-coated via a slide bead coating method, in the order starting from the under-coat surface, resulting in preparation of photothermographic material samples 1-14. At that time, temperature control was carried out, to adjust the image forming layer and the intermediate layer at 31° C., the first protective layer at 36° C. and the second protective layer at 37° C. The coating weight ratio (in parts) of each compound of the image forming layer was as follows. Herein, each sample was prepared to achieve the coated silver weight as shown in Table 1, while keeping the relative ratio, listed in parts of a coating weight of each compound (at as the ratio) described below.

| | |
|---|---|
| Silver behenate | 5.55 |
| Pigment (C. I. Pigment Blue 60) | 0.036 |
| Polyhalogen compound-1 | 0.12 |
| Polyhalogen compound-2 | 0.37 |
| Phthalazine compound-1 | 0.19 |
| SBR latex | 9.67 |

-continued

| | |
|---|---|
| Reducing agent (being a compound described in Table 1) | 0.81 |
| Hydrogen bonding compound-1 | 0.30 |
| Development accelerator-1 | 0.024 |
| Development accelerator-2 | 0.010 |
| Development accelerator-3 | 0.015 |
| Tone modifier-1 | 0.010 |
| Tone modifier-2 | 0.010 |
| Mercapto compound-2 | 0.002 |
| Silver halide (based on Ag) | 0.091 |

The coating•drying conditions were as follows. Coating was performed at 160 m/min, the interval between the coating die orifice and the support being 0.10-0.30 mm, and the pressure in a reduced pressure space was set lower than atmospheric pressure, being by 196-882 Pa. The support was discharged via ionized air blow. The coated solution, after having been cooled via blown ionized air at a dry bulb temperature of 10-20° C. in successive chilling areas, was transported via non-contact and dried in a helically floating dryer, via the blown air at a dry bulb temperature of 23-45° C. and a wet bulb temperature of 15-21° C. After drying and rehumidified at 25° C. and a relative humidity of 40-60%, the film surface was heated to 70-90° C., and then cooled to 25° C.

In the following paragraphs, chemical structure of the compounds employed in the examples are shown.

FF-1: $C_8F_{17}SO_2N(C_3H_7)CH_2COOK$

Base precursor compound-1

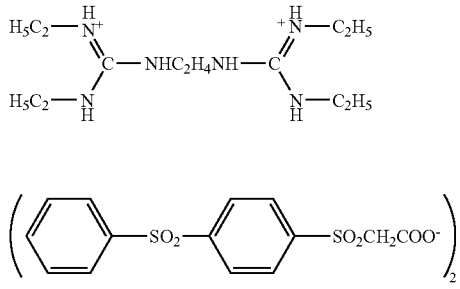

Cyanine dye compound-1

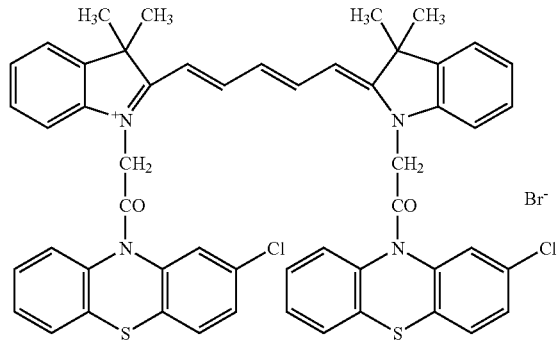

-continued

Blue dye compound-1

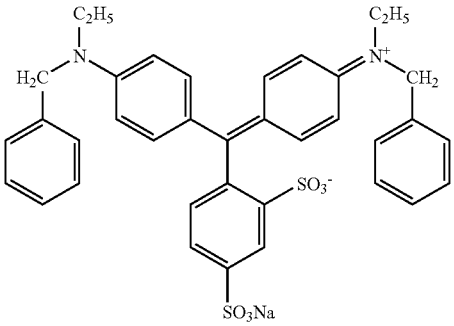

SF-17

$LiO_3S(CF_2)_3SO_3Li$

Spectral sensitizing dye A

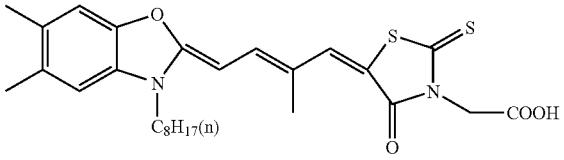

Spectral sensitizing dye B

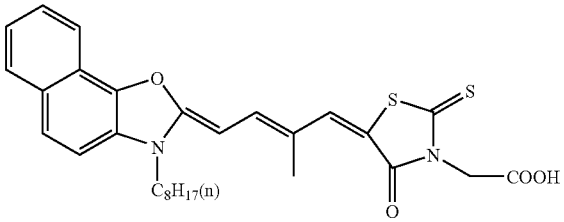

Tellurium sensitizer C

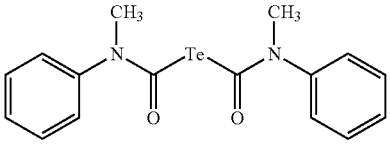

ETTU

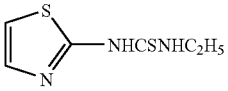

hydrogen bonding compound-1

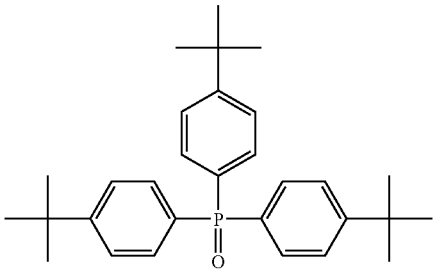

Development accelerator-1

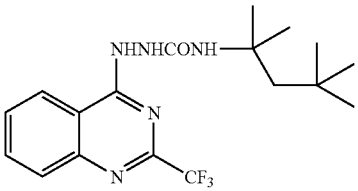

-continued

Development accelerator-2

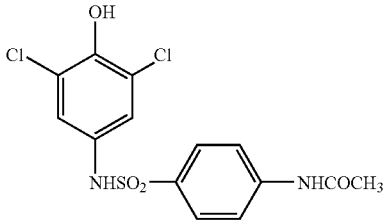

Development accelerator-3

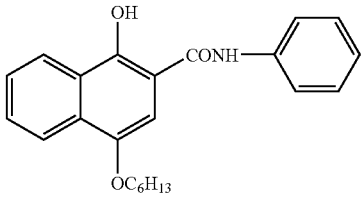

Polyhalogen compound-1

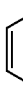

Polyhalogen compound-2

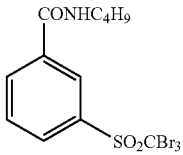

Phthalazine compound-1

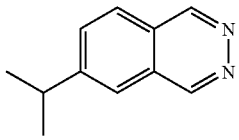

Mercapto compound-2

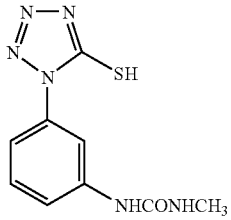

Sample 10 was prepared in a manner similar to preparation of Sample 3, except that $C_8F_{17}SO_3Li$ was employed instead of fluorine-containing surfactant (FF-1) during preparation of the second protective layer coating composition.

Sample 14 was prepared in a manner similar to preparation of Sample 3, except that development accelerator-1, development accelerator-2 and development accelerator-3 were not employed.

Exposure and Development Process

Photothermographic material Samples 1-14, which were prepared in the above manner, and cut 34.5×43.0 cm size, were packed with the following packaging material under an environment of 25° C.·50% RH and stored at room temperature for two weeks, after which exposure and development processes were carried out via the following procedures.

Packaging Material

A barrier bag comprising layers of: 10 μm PET/12 μm PE/9 μm Aluminum foil/15 μm Ny/50 μm carbonpolyethylene containing 3% carbon, and the bag exhibiting an oxygen permeability of 0 ml/atm·$m^2$·25° C.·day and a moisture permeability of 0 g/atm·$m^2$·25° C.·day, and a paper tray were employed as packaging materials.

The sample was simultaneously thermally developed over a total of 13.5 seconds with three panel heaters 51*a*, 51*b* and 51*c* set at 107° C.-123° C.-123° C. respectively, for exposure via laser recording apparatus 150 shown in FIGS. 1 and 2 [featuring a 660 nm semiconductor laser 35 at a maximum output of 50 mW (being a IIIB)] to form images. Herein, "simultaneously thermally developed for exposure" means that, in one sheet of photothermographic material 3 supplied from a photothermographic material of 15*a*, 15*b* or 15*c*, development is started in the parts of the sheet having been exposed at location X with light beam L, while the remaining parts of the sheet are then exposed. The lateral distance between location X in exposing section B and developing section Y was 12 cm. At this time, transporting rate from photosensitive material supply section A to scanning exposing section 19, as well as transporting rate in scanning exposing section 19 and the transporting rate at thermal developing section C were both 25 mm/sec. Further, the lowest height of thermophotographic material trays 10*a*, 10*b* and 10*c* was 45 cm from the floor. Herein, exposure and development were carried out in a room humidified at 25° C.·59% RH. Exposure was performed in distinct steps by decreasing the exposure energy by log E of 0.05 each from the maximum output.

Capability Evaluation

Each thermally developed image was evaluated with respect to the following parameters.

Image Density

The maximum density value of an image obtained under the above conditions was measured via a densitometer.

Sensitivity

With respect to images obtained under the above conditions, density measurement was performed via a densitometer as described above and a characteristic curve was obtained by plotting the exposure quantity as abscissa and density as the ordinate. The reciprocal of the exposure quantity, which provides a density higher by 1.0 than that of the unexposed portion, was designated as sensitivity, whereby sensitivity was determined. Herein, sensitivity is expressed based on relative value setting of Sample 1 as 100.

(Remarks) The values in parenthese of the relative sensitivity, with respect to comparison of sensitivity in the case that the photosensitive material was thermally processed at the thermal development temperature before being exposed to white light, followed by being exposed to white light through an optical wedge and thermally developed, and sensitivity in the case of being exposed to white light under the same conditions as above described but thermally developed without being thermally processed before exposure, showed the relative sensitivity value of the former when the latter sensitivity was 100. Herein, in this relative comparison, it was proved that the primary reason for decrease of relative sensitivity of a sample thermally processed at the thermal development temperature before being white light exposed is a relative relationship between the surface sensitivity and internal sensitivity of silver halide grains due to disappearance or decrease of the spectral sensitizing effect, based on observation/measurement of such variation of spectral sensitivity.

Image Storage Stability

Each sample, after having been exposed and developed as described above, was placed on a 1,000 lux viewing box and kept there for 10 days, during which changes of the images were visually evaluated based on the following criteria at 0.5 intervals.

5: Almost no change was observed.
4: A little change in tone was visible.
3: Scattered tone change and fog increase were observed.
2: Considerable tone change and fog increase were observed in a number of areas.
1: Tone change and fog increase were significant and major density unevenness was generated over the entire surface.

Silver Tone at High Density Portions

A chest X-ray image was printed on each sample, which was thermally developed while appropriately controlling the processing time so as to achieve a maximum density (Dmax) of not less than 3.6. Silver tone at the high density portions.

(basically at a density of 3.0) was visually evaluated via a viewing box. A wet processing type laser imager film, manufactured by Konica Corp., was employed as a standard film for this evaluation, and tone relative to the standard sample was visually evaluated based on the following criteria at 0.5 intervals.

5: Image tone was the same as that of the standard sample.
4: Image tone was nearly the same as that of the standard sample, being in the desired rang.
3: Image tone was somewhat different from that of the standard sample, however, it was not problematic in practice.
2: Image tone obviously differed from that of the standard sample.
1: Image tone differed considerably from that of the standard sample and was unpleasant to view.

Uneven Density

Uneven density after thermal development was visually evaluated based on the following criteria.

5: Image density was uniform.
4: Negligible uneven density was apparent.
3: Slight density was scattered over the images.
2: Strong but scattered uneven density was generated.
1: Strong and overall uneven density was generated over the surface.

Absorbance of Image Forming Layer

A photosensitive material, the rear-surface of which had been removed, was placed facing the photosensitive emulsion surface toward a light source side (perpendicular to the incident light), and absorption value, being absorbance, at an exposure wavelength of 660 nm, was measured, extracting the support as a reference. Light transmitted through the photosensitive material was captured via an integrating sphere (opening area of 20 mm×15 mm), which was arranged approximately 12 cm ahead, and focused onto a photomultiplier.

Surface Roughness

Surface roughness of samples before thermal development was measured based on the method described below via RST/PLUS, being a non-contact three-dimensional surface analyzer, manufactured by Wyko Co., Ltd.

Employing:

(1) Objective lens: ×10.0, Intermediate lens: ×1.0
(2) Measurement range: 463.4×623.9 μm
(3) Pixel size: 368×238
(4) Filter: a cylindrical correction and inclination correction (5) Smoothing: Medium smoothing
(6) Scanning rate: Low Herein, the definition of mean roughness Rz was based on JIS surface roughness (JIS B 0601). Each 10×10 cm sample was divided checker-wise into 100 squares at 1 cm intervals, and measurement was performed at the center of each 10 $cm^2$ square.

The overall results are shown in Table 1.

TABLE 1

| Sample No. | Coating weight of silver ($g/m^2$) | Absorbance | Type of silver halide emulsion for coating composition | Type and amount (g) of reducing agent of general formula (1) | Type and amount (g) of reducing agent of Formula (2) | Image density | Relative sensitivity | Image lasting property | Silver tone at high density area | Uneven density at thermal development |
|---|---|---|---|---|---|---|---|---|---|---|
| 1(Inv.) | 1.67 | 0.60 | E1 | (1-1) = 1.50 | (2-6) = 8.50 | 4.2 | 100(15) | 4.5 | 5.0 | 5.0 |
| 2(Inv.) | 1.67 | 0.60 | E2 | (1-1) = 1.50 | (2-6) = 8.50 | 4.2 | 100(15) | 4.5 | 5.0 | 5.0 |
| 3(Inv.) | 1.67 | 0.60 | E3 | (1-1) = 1.50 | (2-6) = 8.50 | 4.1 | 101(5) | 5.0 | 5.0 | 5.0 |
| 4(Inv.) | 1.67 | 0.60 | E4 | (1-1) = 1.50 | (2-6) = 8.50 | 4.1 | 101(5) | 5.0 | 5.0 | 5.0 |
| 5(Inv.) | 1.67 | 0.60 | E3 | (1-7) = 1.50 | (2-6) = 8.50 | 4.2 | 101(4) | 5.0 | 5.0 | 5.0 |
| 6(Inv.) | 1.67 | 0.60 | E3 | (1-10) = 1.50 | (2-6) = 8.50 | 4.5 | 102(4) | 5.0 | 5.0 | 5.0 |
| 7(Inv.) | 1.67 | 0.60 | E3 | (1-10) = 1.50 | (2-2) = 8.50 | 4.5 | 102(4) | 5.0 | 5.0 | 5.0 |
| 8(Inv.) | 1.59 | 0.57 | E3 | (1-10) = 1.50 | (2-6) = 8.50 | 4.0 | 100(4) | 5.0 | 5.0 | 4.5 |
| 9(Inv.) | 1.51 | 0.56 | E3 | (1-10) = 1.50 | (2-6) = 8.50 | 3.8 | 100(4) | 5.0 | 5.0 | 4.0 |
| 10(Inv.) | 1.67 | 0.60 | E3 | (1-10) = 1.50 | (2-6) = 8.50 | 4.2 | 101(5) | 5.0 | 5.0 | 4.5 |
| 11(Inv.) | 1.67 | 0.60 | E5 | (1-1) = 1.50 | (2-6) = 8.50 | 4.2 | 99(21) | 4.0 | 4.0 | 4.0 |
| 12(Comp.) | 1.43 | 0.54 | E5 | (1-1) = 1.50 | (2-6) = 8.50 | 3.6 | 99(22) | 4.0 | 2.0 | 2.0 |
| 13(Comp.) | 2.07 | 0.74 | E5 | (1-1) = 1.50 | (2-6) = 8.50 | 5.2 | 98(21) | 1.0 | 3.0 | 3.0 |
| 14(Comp.) | 2.40 | 0.86 | E5 | (1-1) = 1.50 | (2-6) = 8.50 | 4.2 | 94(24) | 2.0 | 3.0 | 3.0 |

Inv.: Invention
Comp.: Comparison

It is clear from Table 1 that samples of this invention, compared to comparative samples, show excellent image storage stability and excellent silver tone at higher density portions, as well as exhibiting less uneven density during thermal development, while maintaining higher density.

Further, it has been proved that, when sample 10 and sample 3 are compared, sample 3 exhibits more excellent characteristics with respect to transport property and environmental adaptability (less bioaccumulation).

Further, with respect to Samples 1-14, center line mean roughness (Ra) of the outermost surface of the image forming layer side of each sample was 95 nm for all samples. Further, a mean roughness at ten points (Rz) of the outermost surface of the image forming layer side of each sample was 95 nm for all samples. Mean roughness measured at ten points of each front and rear-surface was measured to determine Rz(E)/Rz(B) which was calculated to be 0.42 for all samples.

What is claimed is:

1. A method of forming an image comprising the steps of:

(a) exposing a photothermographic material comprising a support having thereon an image forming layer comprising organic silver salt grains, silver halide grains, a reducing agent, a development accelerator and a binder, wherein the total coating weight of the silver is 1.45-2.30 $g/m^2$ the image forming layer being formed by application of a coating composition comprising more than 30% water as a solvent of the coating composition, and (b) conducting thermal development of the exposed photothermographic material employing a thermal developing device at a distance of 0 to 50 cm between an exposing section and a developing section to obtain a maximum density of 4.0 to 5.0 of the photothermographic material after the thermal development, and wherein the thermal development temperature is 100° C. to 140° C. and a conveying rate in the thermal developing section is 20-200 mm/sec.

2. The method of forming an image of claim 1, wherein the development accelerator is represented by any one of Formulas (A-1) and (A-2):

$Q_1$—NHNH-$Q_2$ Formula (A-1)

wherein, $Q_1$ is an aromatic group or a heterocyclic group which bonds to —NHNH-$Q_2$ via a carbon atom, and $Q_2$ is a carbamoyl group, an acyl group, an alkoxycarbonyl group, an aryloxycarbonyl group, a sulfonyl group or a sulfamoyl group:

Formula (A-2)

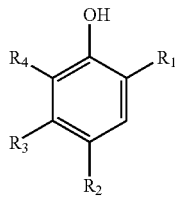

wherein, $R_1$ is an alkyl group, an acyl group, an acylamino group, a sulfonamide group, an alkoxycarbonyl group or a carbamoyl group, $R_1$ is a hydrogen atom, a halogen atom, an alkyl group, an alkoxy group, an aryloxy group, an alkylthio group, an arylthio group, an acyloxy group or a carboxylic acid ester group, $R_1$ and $R_2$ are each a group substituted on a benzene ring, and $R_3$ and $R_4$ may bond each other to form a condensed ring.

3. The method of forming an image of claim 1, wherein the image forming layer incorporates a radiation absorbing compound having a total absorbance of 0.30-1.00 at an exposure wavelength as the sum of the all layers applied onto the side of the support carrying the image forming layer.

4. The method of forming an image of claim 1, wherein a surface sensitivity of the silver halide grains is lower compared to the sensitivity before the thermal development due to being converted from surface latent image type grains to internal latent image type grains.

5. The method of forming an image of claim 1, wherein a silver iodide content of the silver halide grains is 5-100 mol %.

6. The method of forming an image of claim 1, wherein the photothermographic material contains a compound represented by following Formula (F):

Formula (F)

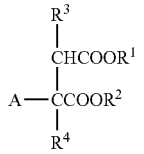

wherein, $R^1$ and $R^2$ are each a substituted or unsubstituted alkyl group, at least one of them is a fluoroalkyl group having at least 2 carbon atoms and at most 13 fluorine atoms, $R^3$ and $R^4$ are each a hydrogen atom or an alkyl group, A is $-L-SO_3M^1$ and $M^1$ is a hydrogen atom or a cation, and L is a single bond or a substituted or unsubstituted alkylene group.

7. The method of forming an image of claim 1, wherein the silver halide grains are at a mean particle size of 10-50 nm.

8. The method of forming an image of claim 7, wherein the silver halide grains further contain silver halide grains having a mean particle size of 55-100 nm.

9. The method of forming an image of claim 1, wherein the silver halide grains are chemically sensitized by a chalcogen compound.

10. The method of forming an image of claim 1, wherein $R_z(E)/R_z(B)$ is 0.1-0.7 when $R_z$ (E) is a mean roughness measured at ten points of the outermost surface of the image forming layer side, and $R_z(B)$ is a mean roughness measured at ten points of the outermost surface of the opposite side to the image forming layer on the support.

11. The method of forming an image of claim 1, wherein $L_b/L_e$ is 2.0-10 when $L_e$ (μm) is a mean particle size of a matting agent having a maximum mean particle size among those contained in layers of the image forming layer side on the support and $L_b$ (μm) is a mean particle size of the matting agent having a maximum mean particle size among those contained in layers on the opposite side of the image forming layer on the support.

12. The method of forming an image of claim 1, wherein one sheet of the photothermographic material comprising a photothermographic material, starts to be partially developed having already been exposed while the remaining part of the sheet is exposed.

13. The method of forming an image of claim 1, wherein the thermal development is conducted employing a thermal developing device with a photothermographic material stock tray at not higher than 55 cm from a base of the floor.

14. The method of forming an image of claim 1, wherein the photothermographic material exposing section of the thermal developing device is structured at a higher level than the photothermographic material stock tray.

15. The method of forming an image of claim 1, wherein the image forming layer contains a dye image forming agent exhibiting an increased absorbance by oxidation of 360-450 nm.

16. The method of forming an image of claim 1, wherein the image forming layer contains a dye image forming agent exhibiting an increased absorbance by oxidation of 600-700 nm.

17. The method of forming an image of claim 1, wherein the conveying rate in the thermal developing section is 25-200 mm/sec.

18. The method of forming an image of claim 1, wherein the thermal development of the exposed photothermographic material obtains a maximum density of 4.0 to 4.5.

* * * * *